US006114081A

United States Patent [19]

Oikawa

[11] Patent Number: 6,114,081

[45] Date of Patent: Sep. 5, 2000

[54] SILVER HALIDE PHOTOGRAPHIC LIGHT-SENSITIVE MATERIAL

[75] Inventor: Tokuju Oikawa, Minami-ashigara, Japan

[73] Assignee: Fuji Photo Film Co., Ltd., Kanagawa-ken, Japan

[21] Appl. No.: 09/398,037

[22] Filed: Sep. 17, 1999

[30] Foreign Application Priority Data

Sep. 21, 1998 [JP] Japan ..... 10-284787

[51] Int. Cl.[7] ..... G03C 1/06

[52] U.S. Cl. ..... 430/264; 430/569

[58] Field of Search ..... 430/264, 569

[56] References Cited

FOREIGN PATENT DOCUMENTS

0682288A1 11/1995 European Pat. Off. .
4-331951 11/1992 Japan .

*Primary Examiner*—Hoa Van Le
*Attorney, Agent, or Firm*—Sughrue, Mion, Zinn, Macpeak & Seas, PLLC

[57] ABSTRACT

There is disclosed a silver halide photographic light-sensitive material comprising a support having thereon at least one of spectrally sensitized light-sensitive silver halide emulsion layers, wherein at least one of the silver halide emulsion layers contains at least two kinds of silver halide emulsions, at least one kind of the emulsions being one in which silver halide grains have been formed and grown in the presence of at least one of nitrogen-containing heterocyclic compounds that are capable of forming a complex with silver; and at least one kind of the emulsions being one in which silver halide grains have been formed and grown in the absence of nitrogen-containing heterocyclic compounds that are capable of forming a complex with silver, and wherein at least one of the said emulsion layers or another hydrophilic colloid layer contains at least one hydrazine derivative nucleating agent, and also at least one nucleating accelerator selected from a group consisting of amine derivatives, onium salts, disulfide derivatives, and hydroxymethyl derivatives. The silver halide photographic light-sensitive material can be processed with a stable developing solution, and provides high sensitivity.

9 Claims, No Drawings

SILVER HALIDE PHOTOGRAPHIC LIGHT-SENSITIVE MATERIAL

FIELD OF THE INVENTION

The present invention relates to a silver halide photographic light-sensitive material, and more particularly to a silver halide photographic light-sensitive material for photomechanical plate-making, exhibiting ultrahigh-contrast photographic characteristics.

BACKGROUND OF THE INVENTION

In the field of graphic arts, in order to improve the reproduction of continuous gradation images with halftone dot images or the reproduction of line images, image formation systems exhibiting ultrahigh-contrast (particularly, γ is 10 or more) photographic characteristics are required.

An image formation system capable of obtaining ultrahigh-contrast photographic characteristics by development with a processing solution that has good storage stability has been demanded. To cope with this demand, as described in U.S. Pat. Nos. 4,166,742, 4,168,977, 4,221,857, 4,224,401, 4,243,739, 4,272,606, and 4,311,781, a system of forming an ultrahigh-contrast negative image having a γ value exceeding 10 was proposed.

In the system, a surface latent image-type silver halide photographic light-sensitive material, having added thereto a specific acylhydrazine compound, is processed with a developer containing 0.15 mol/l or more of a sulfurous acid preservative and having a pH of from 11.0 to 12.3. This new system is characterized in that silver iodobromide or silver chloroiodobromide can be used, though only silver chlorobromide having a high silver chloride content can be used in a conventional ultrahigh-contrast image formation system. Further, the new system is characterized in that a large amount of sulfurous acid preservative can be contained, and relatively good storage stability is achieved, though use of only a very small amount of sulfurous acid preservative is allowed in conventional lith developers.

In European Unexamined Patent Publication (EP) 0 208 514A, JP-A-61-223734 ("JP-A" means unexamined published Japanese patent application), and JP-A-63-46437, high-contrast photographic light-sensitive materials containing two types of silver halide grains, and further containing a hydrazine derivative, are described. These light-sensitive materials are processed with developers having a high pH of about 11.5. However, developers having a pH of 11 or more are prone to air oxidation, and they are unstable and not endurable in use or storage for a long period of time. In addition, since attention must be given to both handling and processing of a waste solution of the developers, a solution having a high pH is unfavorable from an ecological viewpoint. Rather, a means for subjecting to development a silver halide photographic light-sensitive material containing a hydrazine compound with a developer having a lower pH, is preferred in forming a high-contrast image.

On the other hand, when the pH of the developer is low, the contrast-increasing effect induced by the hydrazine derivative is so lowered that a high-contrast image cannot be obtained. In order to accelerate the contrast-increasing effect, development of hydrazine derivatives having higher activity and nucleation accelerators has been attempted. However, use of these compounds, on some occasion, deteriorates long-term storage stability of the light-sensitive material.

JP-A-4-331951 describes, in its claim, a high-contrast light-sensitive material that comprises a hydrazine derivative and silver halide grains that have been subjected to color sensitization in higher concentration of a dye per the surface area of a silver halide grain, than the other silver halide grains do. Further, British unexamined patent publication (GB-A) 9407599 describes, in its claim, a high-contrast light-sensitive material that comprises silver halide grains spectrally sensitized by an undetachable sensitizing dye, and silver halide grains not spectrally sensitized, and further a hydrazine derivative. In both cases, the spectrally sensitized light-sensitive grains and the spectrally unsensitized non-light-sensitive grains contribute to a silver image formed by image-wise exposure and development, due to the presence of the hydrazine derivative, thereby achieving a reduction in amount of the sensitizing dye and improvement on residual color, while maintaining both high sensitivity and high density. However, the former case had a problem that, when photographic emulsions were left standing for a long time in a mixed state, the distribution of the dye in the mixed emulsions became homogeneous, so that a reduction in sensitivity was caused. Further, in the latter case, because the dye to be used was restricted to an undesorbable dye, which was hardly desorbed from a photographic emulsion, satisfactory results on residual color could not be achieved. Further, these patent publications do not disclose anything about the differences of grain formation methods for emulsions to be mixed.

SUMMARY OF THE INVENTION

An object of the present invention is to provide a silver halide photographic light-sensitive material, in which, by using a stable developer, high sensitivity, extremely high contrast, and high density of black can be obtained, and in addition both a reduction in amount of a sensitizing dye and a reduction in contamination by the dye are made possible.

Other and further objects, features, and advantages of the invention will appear more fully from the following description.

DETAILED DESCRIPTION OF THE INVENTION

The object of the present invention has been accomplished by the following inventions:

(1) A silver halide photographic light-sensitive material comprising a support having thereon at least one of spectrally sensitized light-sensitive silver halide emulsion layers; wherein at least one of the silver halide emulsion layers contains at least two kinds of silver halide emulsions, at least one kind of the emulsions being one in which silver halide grains have been formed and grown in the presence of at least one of nitrogen-containing heterocyclic compounds that are capable of forming a complex with silver, and at least one kind of the emulsions being one in which silver halide grains have been formed and grown in the absence of nitrogen-containing heterocyclic compounds that are capable of forming a complex with silver; and wherein at least one of the said emulsion layers or another hydrophilic colloid layer contains at least one hydrazine derivative nucleating agent, and also at least one nucleating accelerator selected from a group consisting of amine derivatives, onium salts, disulfide derivatives, and hydroxymethyl derivatives.

(2) The silver halide photographic light-sensitive material as described in the preceding (1), wherein the nitrogen-containing heterocyclic compound that is capable of forming a complex with silver, is a compound represented by the following formula (I):

formula (I)

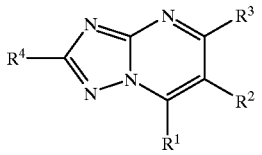

Wherein $R^1$, $R^2$, $R^3$ and $R^4$, which may be the same, or different, each represent a hydrogen atom, an alkyl group, an aryl group, an amino group, a hydroxyl group, an alkoxy group, an alkylthio group, a carbamoyl group, a halogen atom, a cyano group, a carboxyl group, an alkoxycarbonyl group, or a heterocyclic residual group; $R^1$ and $R^2$, or $R^2$ and $R^3$ may bond together to form a 5- or 6-membered ring, with the proviso that at least one of $R^1$ and $R^3$ represents a hydroxyl group.

(3) The silver halide photographic light-sensitive material as described in the preceding (1) or (2), wherein the silver halide emulsion is spectrally sensitized with at least one of spectral sensitizing dyes represented by formula (II), (III), or (IV) described below.

formula (II)

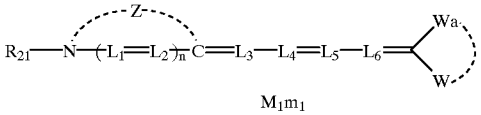

In formula (II), $R_{21}$ represents an alkyl group. Z represents an atomic group necessary to form a 5- or a 6-membered, nitrogen-containing heterocyclic ring. W and $W_a$ each represent an atomic group necessary to form an acyclic or cyclic acidic nucleus. $L_1$, $L_2$, $L_3$, $L_4$, $L_5$ and $L_6$ each represent a methine group. $M_1$ represents a counter ion to neutralize a charge. $m_1$ is a number of 0 or more necessary to neutralize a charge in a molecule. n represents 0 or 1.

formula (IV)

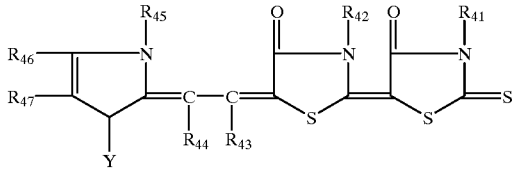

In formula (IV), Y represents —S—, or —Se—. At least two of $R_{41}$, $R_{42}$, $R_{43}$, $R_{44}$ and $R_{45}$ represent an organic group having at least one water-soluble group. The other group(s) of $R_{41}$ to $R_{45}$ that do not represent the above-described organic group having at least one water-soluble group, each represent a hydrogen atom, a substituted or unsubstituted alkyl group, a substituted or unsubstituted alkenyl group, or a substituted or unsubstituted aryl group. $R_{46}$ and $R_{47}$, which may be the same or different, each represents a substituted or unsubstituted, alkyl group, alkenyl group, alkynyl group, alkoxy group, alkylthio group, arylthio group, aryl group, acyl group, alkoxycarbonyl group, alkylsulfonyl group, carbamoyl group, or sulfamoyl group, a hydrogen atom, a hydroxyl group, a halogen atom, a carboxyl group, or a cyano group. Further, $R_{46}$ and $R_{47}$ may bond together to complete a carbocyclic ring series. Each of the above-described ring series may have one or more substituents, which may be the same or different, selected from the above-described substituents for $R_{46}$ and $R_{47}$.

The silver halide emulsion for use in the present invention is obtained by mixing at least two kinds of emulsions, one of which is an emulsion in which silver halide grains have been formed and grown in the presence of at least one of nitrogen-containing heterocyclic compounds that are capable of forming a complex with silver.

The proportion of the silver halide emulsion in which silver halide grains have been formed and grown in the presence of at least one of nitrogen-containing heterocyclic compounds that are capable of forming a complex with silver in a mixed emulsion, is not restricted in particular.

formula (III)

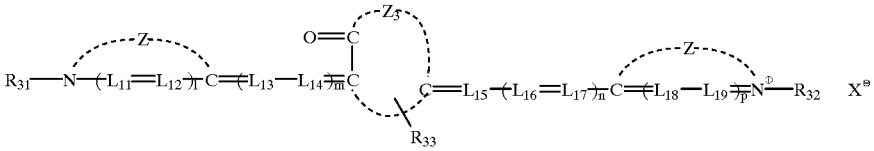

In formula (III), $Z_1$ and $Z_2$ each represent an atomic group necessary to a 5- or 6-membered heterocyclic ring. $Z_3$ represents an atomic group necessary to a 5- or 6-membered, nitrogen-containing heterocyclic ring, wherein the nitrogen atom has a substituent ($R_{33}$). $R_{31}$ and $R_{32}$ each represent an alkyl group, an alkenyl group, an aralkyl group, or an aryl group. $R_{33}$ has the same meaning as $R_{31}$ or $R_{32}$ and may be the same or different from $R_{31}$ or $R_{32}$, or $R_{33}$ represents a substituted amino group, an amide group, an imino group, an alkoxy group, or a heterocyclic group. At least one of $R_{31}$, $R_{32}$ and $R_{33}$ represents a water-soluble group. $L_{11}$ to $L_{19}$ each represent a methine group. m and n each represent 0, 1, or 2. 1 and p each represent 0 or 1. X represents a counter ion.

However, the ratio of the silver halide emulsion in which silver halide grains have been neither formed nor grown in the presence of at least one of nitrogen-containing heterocyclic compounds that are capable of forming a complex with silver, to the silver halide emulsion in which silver halide grains have been formed and grown in the presence of at least one of nitrogen-containing heterocyclic compounds that are capable of forming a complex with silver, is preferably 1:1 to 1:20, and more preferably 1:1 to 1:10, based on the amount of silver contained in the silver halide emulsions.

Examples of the nitrogen-containing heterocycle of the nitrogen-containing heterocyclic compound capable of forming a complex with silver, for use in the present invention, include a pyrazole ring, a pyrimidine ring, a 1,2,4-triazole ring, a 1,2,3-triazole ring, a 1,3,4-thiadiazole ring, a 1,2,3-thiadiazole ring, a 1,2,4-thiadiazole ring, a 1,2,5-thiadiazole ring, a 1,2,3,4-tetrazole ring, a pyridazine ring, a 1,2,3-triazine ring, a 1,2,4-triazine ring, a 1,3,5-triazine ring, a benzotriazole ring, a benzimidazole ring, a benzothiazole ring, a quinoline ring, a benzoxazole ring, a benzoselenazole ring, a naphthothiazole ring, a naphthoimidazole ring, a rhodanine ring, a thiohydantoin ring, an oxazole ring, a thiazole ring, an oxadiazole ring, a selenadiazole ring, a naphthoxazole ring, an oxazolidinedione ring, a triazolotriazole ring, an azaindene ring (e.g. a diazaindene ring,-a triazaindene ring, a tetrazaindene ring, a pentazaindene ring), a phthalazine ring, and an indazole ring.

Among these, compounds that each have an azaindene ring are preferred. Azaindene compounds that each have a hydroxyl group as a substituent are more preferred, such as hydroxytriazaindene compounds, tetrahydroxyazaindene compounds, and hydroxypentazaindene compounds.

The heterocycle may have a substituent other than a hydroxyl group. Examples of the substituent include an alkyl group, an alkylthio group, an amino group, a hydroxyamino group, an alkylamino group, a dialkylamino group, an arylamino group, a carboxy group, an alkoxycarbonyl group, a halogen atom, an acylamino group, a cyano group, and a mercapto group.

Specific examples of the nitrogen-containing heterocyclic compound for use in the present invention are set forth below, but they are not intended to limit the scope of the invention.

(N-1) 2,4-Dihydroxy-6-methyl-1,3a,7-triazaindene
(N-2) 2,5-Dimethyl-7-hydroxy-1,4,7a-triazaindene
(N-3) 5-Amino-7-hydroxy-2-methyl-1,4,7a-triazaindene
(N-4) 4-Hydroxy-6-methyl-1,3,3a,7-tetrazaindene
(N-5) 4-Hydroxy-1,3,3a,7-tetrazaindene
(N-6) 4-Hydroxy-6-phenyl-1,3,3a,7-tetrazaindene
(N-7) 4-Methyl-6-hydroxy-1,3,3a,7-tetrazaindene
(N-8) 2,6-Dimethyl-4-hydroxy-1,3,3a,7-tetrazaindene
(N-9) 4-Hydroxy-5-ethyl-6-methyl-1,3,3a,7-tetrazaindene
(N-10) 2,6-Dimethyl-4-hydroxy-5-ethyl-1,3,3a,7-tetrazaindene
(N-11) 4-Hydroxy-5,6-dimethyl-1,3,3a,7-tetrazaindene
(N-12) 2,5,6-Trimethyl-4-hydroxy-1,3,3a,7-tetrazaindene
(N-13) 2-Methyl-4-hydroxy-6-phenyl-1,3,3a,7-tetrazaindene
(N-14) 4-Hydroxy-6-methyl-1,2,3a,7-tetrazaindene
(N-15) 4-Hydroxy-6-ethyl-1,2,3a,7-tetrazaindene
(N-16) 4-Hydroxy-6-phenyl-1,2,3a,7-tetrazaindene
(N-17) 4-Hydroxy-1,2,3a, 7-tetrazaindene
(N-18) 4-Methyl-6-hydroxy-1,2,3a,7-tetrazaindene
(N-19) 7-Hydroxy-5-methyl-1,2,3,4,6-pentazaindene
(N-20) 5-Hydroxy-7-methyl-1,2,3,4,6-pentazaindene
(N-21) 5,7-Dihydroxy-1,2,3,4,6-pentazaindene
(N-22) 7-Hydroxy-5-methyl-2-phenyl-1,2,3,4,6-pentazaindene
(N-23) 5-Dimethylamino-7-hydroxy-2-phenyl-1,2,3,4,6-pentazaindene
(N-24) 1-Phenyl-5-mercapto-1,2,3,4-tetrazole
(N-25) 6-Aminopurine
(N-26) Benzotriazole
(N-27) 6-Nitrobenzimidazole
(N-28) 3-Ethyl-2-methylbenzothiazolium p-toluenesulfonate
(N-29) 1-Methylquinoline
(N-30) Benzothiazole
(N-31) Benzoxazole
(N-32) Benzoselenazole
(N-33) Benzimidazole
(N-34) Naphthothiazole
(N-35) Naphthoselenazole
(N-36) Naphthoimidazole
(N-37) Rhodanine
(N-38) 2-Thiohydantoin
(N-39) 2-Thio-2,4-oxazolidinedione
(N-40) 3-Benzyl-2-mercaptobenzimidazole
(N-41) 2-Mercapto-1-methylbenzothiazole
(N-42) 5-(m-Nitrophenyl)tetrazole
(N-43) 2,4-Dimethylthiazole
(N-44) 1-Methyl-5-ethoxybenzothiazole
(N-45) 2-Methyl-β-naphthothiazole
(N-46) 1-Ethyl-5-mercaptotetrazole
(N-47) 5-Methylbenzotriazole
(N-48) 5-Phenyltetrazole
(N-49) 1-Methyl-2-mercapto-5-benzoylamino-1,3,5-triazole
(N-50) 1-Benzoyl-2-mercapto-5-acetylamino-1,3,5-triazole
(N-51) 2-Mercapto-3-aryl-4-methyl-6-hydroxypyrimidine
(N-52) 2,4-Dimethyloxazole
(N-53) 1-Methyl-5-phenoxybenzoxazole
(N-54) 2-Ethyl-β-naphthoxazole
(N-55) 2-Mercapto-5-aminothiadiazole
(N-56) 2-Mercapto-5-aminoxadiazole
(N-57) 2-Mercapto-5-aminoselenadiazole
(N-58) Sodium 3-(5-mercaptotetrazole)benzenesulfonate
(N-59) Sodium 3-(5-mercaptotetrazole)benzenecarboxylate Of the nitrogen-containing heterocyclic compounds that are capable of forming a complex with silver for use in the present invention, compounds represented by formula (I) are preferably used. The compounds represented by formula (I) for use in the present invention are described below in detail. In formula (I), $R^1$, $R^2$, $R^3$ and $R^4$, which may be the same or different, each represent a hydrogen atom; an unsubstituted or substituted alkyl group having 1 to 20 carbon atoms, which may be branched, or cyclic; a monocyclic or bicyclic, unsubstituted or substituted aryl group; an unsubstituted or substituted amino group; a hydroxyl group; an alkoxy group having 1 to 20 carbon atoms; an alkylthio group having 1 to 6 carbon atoms; a carbamoyl group which may be substituted with an aliphatic group or an aromatic group; a halogen atom; a cyano group; a carboxyl group; an alkoxycarbonyl group having 2 to 20 carbon atoms; or a heterocyclic residual group containing a 5- or 6-membered ring having a heteroatom such as a nitrogen atom, an oxygen atom, and a sulfur atom. $R^1$ and $R^2$, or $R^2$ and $R^3$ may bond together to form a 5- or 6-membered ring. However, at least one of $R^1$ and $R^3$ represents a hydroxyl group. Specific examples of the above-described unsubstituted alkyl group include a methyl group, an ethyl group, a n-propyl group, an i-propyl group, a n-butyl group, a t-butyl group, a hexyl group, a cyclohexyl group, a cyclopentylmethyl group, an octyl group, a dodecyl group, a tridecyl group, and a heptadecyl group. Examples of the substituent of the above-described substituted alkyl group include a monocyclic or bicyclic aryl group, a heterocyclic residual group, a halogen atom, a carboxyl group, an alkoxycarbonyl group having 2 to 6 carbon atoms, an alkoxy group having 20 or less carbon atoms, and a hydroxyl group. Specific examples of the substituted alkyl group include a benzyl group, a phenethyl group, a chloromethyl group, 2-chloroethyl group, a trifluoromethyl group, a carboxymethyl group, a 2-carboxyethyl group, a 2-(methoxycarbonyl)methyl group, an ethoxycarbonylmethyl group, a 2-methoxyethyl group, a hydroxymethyl group, and a 2-hydroxyethyl group. Examples of the above-described unsubstituted aryl group include a phenyl group and a naphthyl group. Example of the substituent of the substituted aryl group include an alkyl group having 1 to 4 carbon atoms, a halogen atom, a nitro group, a carboxyl group, an alkoxycarbonyl group having 2 to 6 carbon atoms, a hydroxyl group, and an alkoxy group having 1 to 6 carbon atoms. Specific examples of the substituted aryl group include a p-toryl group, a m-toryl group, a p-chlorophenyl group, a p-bromophenyl group, an o-chlorophenyl group, a m-nitrophenyl group, a p-carboxyphenyl group, an o-carboxyphenyl group, an o-(methoxycarbonyl) phenyl group, a p-hydroxyphenyl group, a p-methoxyphenyl group, and a m-ethoxyphenyl group. The amino group each represented by $R^1$, $R^2$, $R^3$ and $R^4$ may be substituted with a substituent, examples of which include an alkyl group (e.g., methyl, ethyl, butyl) and an acyl group (e.g., acetyl, methylsulfonyl). Specific examples of the substituted amino group include a dimethyl amino group, a diethylamino group, a butylamino group, and an acetylamino group. Specific examples of the alkoxy group each represented by $R^1$, $R^2$, $R^3$ and $R^4$ include a methoxy group, an ethoxy group, a butoxy group, and a heptadecyloxy group. The carbamoyl group each represented by $R^1$, $R^2$, $R^3$ and $R^4$ may have one or two substituents such as an alkyl group having 1 to 20 carbon atoms and a monocyclic or bicyclic aryl group. Specific examples of the substituted carbamoyl group include a methylcarbamoyl group, a dimethylcarbamoyl group, an ethylcarbamoyl group, and a phenylcarbamoyl group. Specific examples of the alkoxycarbonyl group each represented by $R^1$, $R^2$, $R^3$ and $R^4$ include a methoxycarbonyl group, an ethoxycarbonyl group, and a butoxycarbonyl group. Specific examples of the halogen atom each represented by $R^1$, $R^2$, $R^3$ and $R^4$ include a fluorine atom, a chlorine atom, and a bromine atom. The heterocyclic residual group each represented by $R^1$, $R^2$, $R^3$ and $R^4$ may be monocyclic, or may have a condensed ring consisting of two or three rings. Specific examples of the heterocyclic residual group include a furyl group, a pyridyl group, a 2-(3-methyl)benzothiazolyl group, and a 1-benzotriazolyl group. Specific examples of the ring formed by $R^1$ and $R^2$, or $R^2$ and $R^3$ include a cyclopentane ring, a cyclohexane ring, a cyclohexene ring, a benzene ring, a furan ring, a pyrrolidine ring, and a thiophene ring. When $R^4$ represents a substituted alkyl group, the substituent thereof may be a heterocyclic ring.

Substituted alkyl groups represented by the following formula are preferred.

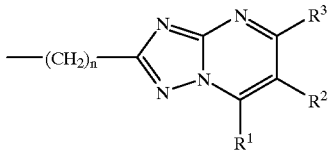

wherein $R^1$, $R^2$ and $R^3$ each have the same meanings as described above, and n represents 2 or 4.

Specific examples of the compound represented by formula (I) are shown below.

1

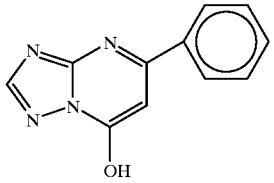

-continued

2

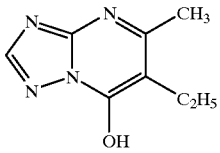

3

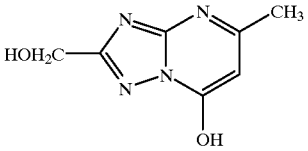

4

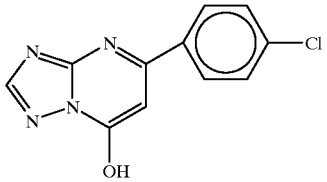

5

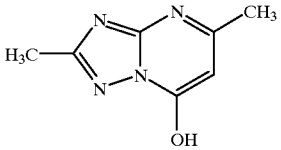

6

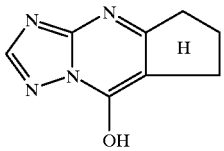

7

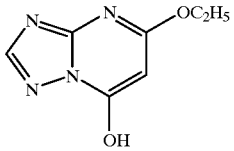

8

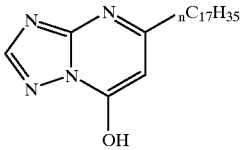

9

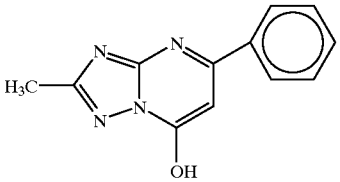

10

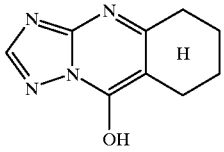

-continued

11

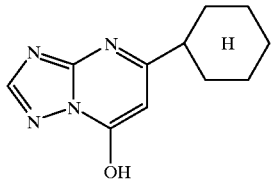

12

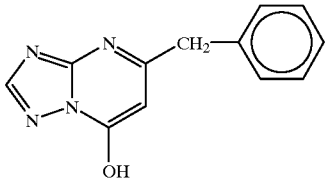

13

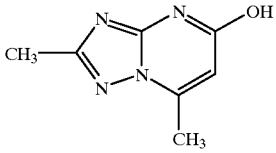

14

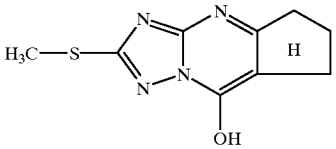

15

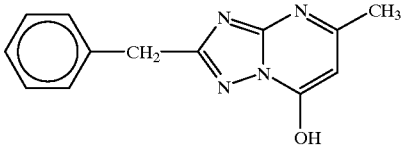

16

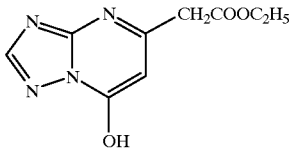

17

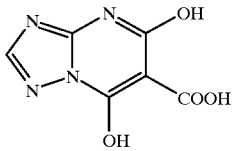

18

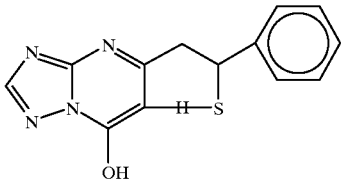

19

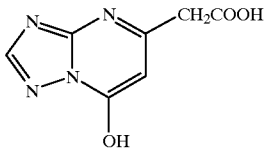

-continued

20

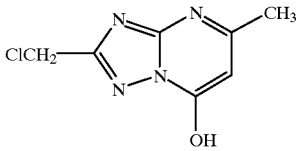

21

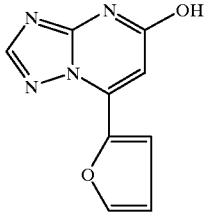

22

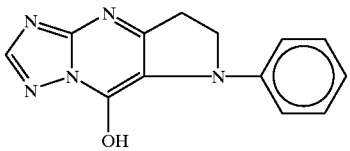

23

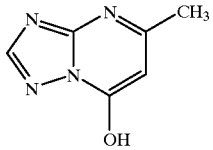

24

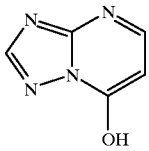

As a method of adding, to an emulsion, a nitrogen-containing heterocyclic compound for use in the present invention, the compound may be dissolved in an appropriate solvent that does not exert any harmful function on the emulsion (e.g. water or an alkaline aqueous solution), to add the resultant solution to the emulsion.

The nitrogen-containing heterocyclic compound that is capable of forming a complex with silver and the compound represented by formula (I), are added before or during the grain formation of a silver halide, respectively. In advance, they may be added to an aqueous gelatin solution. The addition amount thereof is preferably from $1\times10^{-4}$ mol to $5\times10^{-2}$ mol, and especially preferably from $5\times10^{-4}$ mol to $1\times10^{-2}$ mol, per mol of silver, respectively.

The halogen composition of the silver halide emulsion for use in the present invention is not restricted in particular, and the silver halide may be any of silver chloride, silver bromide, silver chlorobromide, silver iodobromide, silver iodochloride, and silver iodochlorobromide. Silver chloride content of the silver halide in the emulsion for use in the present invention is preferably 50 mol % or more.

The silver halide grains may have any shape of cubic, tetradecahedral, octahedral, amorphous, and tabular forms, and cubic or tabular grains are preferred.

The photographic emulsion for use in the present invention can be prepared using methods described, for example, by P. Glafkides, in *Chimie et Physique Photographique,* Paul Montel (1967); by G. F. Duffin, in *Photographic Emulsion Chemistry,* The Focal Press (1966); and by V. L.

Zelikman et al., in *Making and Coating Photographic Emulsion,* The Focal Press (1964).

More specifically, either an acid process or a neutral process may be used. Further, a method of reacting a soluble silver salt and a soluble halogen salt may be carried out by any of a single jet method, a double jet method, and a combination thereof.

A method of forming grains in the presence of excessive silver ion (the so-called reverse-mixing method) may also be used. As one form of the double jet method, a method of maintaining the pAg constant in the liquid phase where silver halide is produced, namely, a so-called controlled double jet method, may be used. Further, it is preferred to form grains using a so-called silver halide solvent, such as ammonia, thioether, or tetra-substituted thiourea, more preferably using a tetra-substituted thiourea compound, and this is described in JP-A-53-82408 and JP-A-55-77737. Preferred examples of the thiourea compound include tetramethylthiourea and 1,3-dimethyl-2-imidazolidinethione. The amount of silver halide solvent added varies depending on the kind of the compound used or the grain size and the halogen composition expected, but it is preferably from $2\times10^{-5}$ to $10^{-2}$ mol per mol of silver halide.

According to the controlled double jet method or the method of forming grains using a silver halide solvent, a silver halide emulsion comprising grains having a regular crystal form and a narrow grain size distribution can be easily prepared. These methods are useful means for preparing the silver halide emulsion for use in the present invention.

In order to render the grain size uniform, it is preferred to rapidly grow grains within the range not exceeding the critical saturation degree, using a method of changing the addition rate of silver nitrate or alkali halide according to the grain growth rate, as described in British Patent No. 1,535,016, JP-B-48-36890 ("JP-B" means examined Japanese patent publication), and JP-B-52-16364, or a method of changing the concentration of the aqueous solution, as described in British Patent No. 4,242,445 and JP-A-55-158124.

The emulsion for use in present invention is preferably a monodisperse emulsion having a coefficient of variation (deviation coefficient) obtained by the equation: {(standard deviation of grain size)/(average grain size)}×100, of 20% or less, more preferably 15% or less. The silver halide emulsion grains preferably have an average grain size of 0.5 μm or less, more preferably 0.1 μm to 0.4 μm.

The silver halide emulsion for use in the present invention may contain a metal that belongs to the group VIII. It is especially preferred that a light-sensitive material suitable for a high intensity exposure such as a scanner exposure and a light-sensitive material for a line image photographing each contain such a metal compound as a rhodium compound, an iridium compound and a ruthenium compound, to thereby attain a high contrast and a low fog. Further, it is preferred that an iron compound is contained to attain a high sensitivity.

As a rhodium compound for use in the present invention, a water-soluble rhodium compound can be used. Examples of the rhodium compound include rhodium (III) halide compounds, or rhodium coordination complex salts having a halogen atom, amines, or oxalato as a ligand, such as a hexachloro rhodium (III) complex salt, a hexabromo rhodium (III) complex salt, a hexamine rhodium (III) complex salt, and a trioxalato rhodium (III) complex salt. The above-described rhodium compound is dissolved in water or an appropriate solvent before use, and a method generally, commonly used for stabilizing a solution of the rhodium compound, namely, a method of adding an aqueous solution of hydrogen halogenide (e.g. hydrochloric acid, hydrobromine acid, hydrofluoric acid) or an alkali halide (e.g. KCl, NaCl, KBr, NaBr), may be used. It is also possible to add and dissolve separately prepared silver halide grains that are previously doped with rhodium, in place of a water-soluble rhodium compound, at the preparation of silver halide.

Examples of the iridium compound for use in the present invention include hexachloro iridium, hexabromo iridium and hexamine iridium. Examples of the ruthenium compound for use in the present invention include hexachloro ruthenium, and pentachloronitrosyl ruthenium. Examples of the iron compound for use in the present invention include potassium hexacyanoferrate(II) and ferrous thiocyanate.

The amount of these compounds to be added is generally from $1\times10^{-8}$ to $5\times10^{-6}$ mol, and preferably from $5\times10^{-8}$ to $1\times10^{-6}$ mole, per mole of silver in the silver halide emulsion.

The addition of these compounds may optionally be practiced at the time of production of silver halide emulsion grains, or at any stage before coating an emulsion. However, it is especially preferred that these compounds are added at the time of formation of the emulsion grains, so that they are incorporated (built) in the silver halide grains.

The silver halide emulsion for use in the present invention is preferably being subjected to chemical sensitization. The chemical sensitization may be performed using a known method, such as sulfur sensitization, selenium sensitization, tellurium sensitization, or noble metal sensitization, and these sensitization methods may be used singly or in combination. When these sensitization methods are used in combination, a combination of sulfur sensitization and gold sensitization; a combination of sulfur sensitization, selenium sensitization, and gold sensitization; and a combination of sulfur sensitization, tellurium sensitization, and gold sensitization, are preferred. Further, it is preferably that at least one of the silver halide emulsions for use in the present invention is being subjected to selenium sensitization and/or tellurium sensitization.

The sulfur sensitization for use in the present invention is usually performed by adding a sulfur sensitizer and stirring the emulsion at a high temperature of 40° C. or higher for a predetermined time. The sulfur sensitizer to be used may be a known compound, and examples thereof include, in addition to the sulfur compound contained in gelatin, various sulfur compounds, such as thiosulfates, thioureas, thiazoles, and rhodanines. Preferred sulfur compounds are a thiosulfate and a thiourea compound. The amount of the sulfur sensitizer added varies depending on various conditions, such as the pH and the temperature at the time of chemical ripening and the size of silver halide grains, but it is preferably from $10^{-7}$ to $10^{-2}$ mol, more preferably from $10^{-5}$ to $10^{-3}$ mol, per mol of silver halide.

The selenium sensitizer for use in the present invention may be a known selenium compound. The selenium sensitization is generally performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, and Japanese Patent Application Nos. 2-13097, 2-229300, and 3-121798, and among these, particularly preferred are the compounds represented by formula (VIII) or (IX) of JP-A-4-322855.

Further, a low-decomposition-activity selenium compound can also be preferably used. The low-decomposition-activity selenium compound is a selenium compound such that, when a water/1,4-dioxane (1/1 by volume) mixed solution (pH: 6.3), containing 10 mmol of $AgNO_3$, 0.5 mmol of the selenium compound, and 40 mmol of 2-(N-morpholino)ethanesulfonic acid buffer, is reacted at 40° C., the half-life of the selenium compound is 6 hours or more. Preferred examples of the low-decomposition-activity selenium compound include Exemplified compounds SE-1 to SE-10 of Japanese Patent Application No. 7-288104.

The tellurium sensitizer for use in the present invention is a compound for forming silver telluride, which is presumed to become a sensitization nucleus, on the surface of or inside a silver halide grain. The formation rate of silver telluride in a silver halide emulsion can be examined according to a method described in JP-A-5-313284.

Specific examples of the tellurium sensitizer to be used include the compounds described in U.S. Pat. Nos. 1,623,499, 3,320,069, and 3,772,013, British Patent Nos. 235,211, 1,121,496, 1,295,462, and 1,396,696, Canadian Patent No. 800,958, Japanese Patent Application Nos. 2-333819, 3-53693, 3-131598, and 4-129787, *J. Chem. Soc. Chem. Commun.,* 635(1980); ibid., 1102 (1979); ibid., 645 (1979); *J. Chem. Soc. Perkin. Trans.,* 1, 2191 (1980); S. Patai (compiler), *The Chemistry of Organic Selenium and Tellurium Compounds,* Vol. 1 (1986); and ibid., Vol. 2 (1987). The compounds represented by formulae (II), (III), and (IV) of Japanese Patent Application NO. 4-146739 are particularly preferred.

The amount to be used of the selenium sensitizer or the tellurium sensitizer for use in the present invention varies depending on the silver halide grains used or the chemical ripening conditions, but it is generally in the order of $10^{-8}$ to $10^{-2}$ mol, preferably from $10^{-7}$ to $10^{-3}$ mol, per mol of silver halide. The conditions of chemical sensitization in the present invention are not particularly restricted, but the pH is generally from 5 to 8, the pAg is generally from 6 to 11, preferably from 7 to 10, and the temperature is generally from 40 to 95° C., preferably from 45 to 85° C.

Examples of the noble metal sensitizer for use in the present invention include gold, platinum, palladium, and iridium, and gold sensitization is particularly preferred. Specific examples of the gold sensitizer for use in the present invention include chloroauric acid, potassium chloroaurate, potassium auric thiocyanate, and gold sulfide. The gold sensitizer can be used in an amount of approximately from $10^{-7}$ to $10^{-2}$ mol per mol of silver halide.

In the silver halide emulsion for use in the present invention, a cadmium salt, a sulfite, a lead salt, or a thallium salt may be present together during formation or physical ripening of silver halide grains.

In the present invention, reduction sensitization may be used. Examples of the reduction sensitizer to be used include stannous salts, amines, formamidinesulfinic acid, and silan compounds.

To the silver halide emulsion for use in the present invention, a thiosulfonic acid compound may be added, according to the method described in European Unexamined Patent Publication (EP) 293,917.

The light-sensitive silver halide emulsion for use in the present invention is spectrally sensitized to blue light, green light, red light, or infrared light, by a sensitizing dye. Examples of the sensitizing dye that can be used include a cyanine dye, a merocyanine dye, a complex cyanine dye, a complex merocyanine dye, a holopolar cyanine dye, a styryl dye, a hemicyanine dye, an oxonol dye, and a hemioxonol dye.

Useful sensitizing dyes for use in the present invention are described, for example, in *Research Disclosure,* Item 17643, IV-A, page 23 (December, 1978); ibid., Item 1831 X, page 437 (August 1979), and publications cited therein.

In particular, sensitizing dyes having spectral sensitivity suitable for spectral characteristics of various light sources in a scanner, an image setter, or a photomechanical process camera, can be advantageously selected.

For example, A) for an argon laser light source, Compounds (I)-1 to (I)-8 described in JP-A-60-162247, Compounds I-1 to I-28 described in JP-A-2-48653, Compounds I-1 to I-13 described in JP-A-4-330434, Compounds of Examples 1 to 14 described in U.S. Pat. No. 2,161,331, and Compounds 1 to 7 described in West Germany Patent No. 936,071; B) for a helium-neon laser light source, compounds I-1 to I-38 described in JP-A-54-18726, compounds I-1 to I-35 described in JP-A-6-75322, and compounds I-1 to I-34 described in JP-A-7-287338; C) for an LED light source, Dyes 1 to 20 described in JP-B-55-39818, Compounds I-1 to I-37 described in JP-A-62-284343, and Compounds I-1 to I-34 described in JP-A-7-287338; D) for a semiconductor laser light source, Compounds I-1 to I-12 described in JP-A-59-191032, Compounds I-1 to I-22 described in JP-A-60-80841, Compounds I-1 to I-29 described in JP-A-4-335342, and Compounds I-1 to I-18 described in JP-A-59-192242; and E) for a tungsten or xenon light source of a photomechanical camera, Compounds (1) to (19) represented by formula (I) of JP-A-55-45015, Compounds I-1 to I-97 described in Japanese Patent Application No. 7-346193, and Compounds 4-A to 4-S, Compounds 5-A to 5-Q, and Compounds 6-A to 6-T described in JP-A-6-242547, may be advantageously selected.

More preferably, the silver halide photographic light-sensitive material of the present invention is spectrally sensitized by at least one dye selected from compounds represented by formulae (II), (III) and (IV).

Formula (II) is illustrated in detail. In formula (II), $R_{21}$ represents an alkyl group. Z represents an atomic group necessary to form a 5- or a 6-membered, nitrogen-containing heterocyclic ring. W and $W_a$ each represent an atomic group necessary to form an acyclic or cyclic acidic nucleus. $L_1$, $L_2$, $L_3$, $L_4$, $L_5$ and $L_6$ each represent a methine group. $M_1$ represents a counter ion to neutralize a charge. $m_1$ represents a number of 0 or more necessary to neutralize a charge in a molecule. n represents 0 or 1.

Preferable examples of $R_{21}$ include an alkyl group having 8 or less carbon atoms, an alkyl group substituted with a substituent (e.g., a carboxyl group, a sulfo group, a cyano group, a halogen atom), a hydroxyl group, an alkoxycarbonyl group, an alkane sulfonylaminocarbonyl group, an alkoxy group, an alkylthio group, an arylthio group, an aryloxy group, an acyloxy group, an acylthio group, an acyl group, a carbamoyl group, a sulfamoyl group, and an aryl group. Of these groups, an unsubstituted alkyl group, a carboxyalkyl group, a sulfoalkyl group, and methane sulfonyl carbamoylmethyl group are more preferred.

Examples of the nucleus formed by Z include a thiazole nucleus, a benzothiazole nucleus, a naphthothiazole nucleus, a thiazoline nucleus, an oxazole nucleus, a benzoxazole nucleus, a naphthoxazole nucleus, an oxazoline nucleus, a selenazole nucleus, a benzoselenazole nucleus, a naphthoselenazole nucleus, a tellurazole nucleus, a benzotellurazole nucleus, a naphthotellurazole nucleus, a tellurazoline nucleus, a 3,3-dialkylindolenine nucleus, an imidazole nucleus, a benzimidazole nucleus, a naphthoimidazole nucleus, a pyridine nucleus, a quinoline nucleus, an isoquinoline nucleus, an imidazo[4,5-b]quinoxaline nucleus, an oxadiazole nucleus, a thiadiazole nucleus, a tetrazole nucleus, and pyrimidine nucleus. Of these nuclei, a benzothiazole nucleus, a naphthothiazole nucleus, a benzoxazole nucleus, a naphthoxazole nucleus, a 2-quinoline nucleus, and a 4-quinoline nucleus are preferred.

W and $W_a$ each represent an atomic group necessary to form an acidic nucleus. The acidic nucleus may be any one of acidic nuclei of a general merocyanine dye. The term "acidic nucleus" herein referred to is defined by, for example, James, *The Theory of the Photographic Process*, the fourth edition, Macmillan Company (1977), page 198. In a preferable form, examples of the substituent which participates in resonance of W include a carbonyl group, a cyano group, a sulfonyl group, and a sulfenyl group. $W_a$ represents a residual atomic group necessary to form an acidic nucleus. Specific examples of the acidic nucleus include those described in, for example, U.S. Pat. Nos. 3,567,719, 3,575,869, 3,804,634, 3,837,862, 4,002,480, 4,925,777, and JP-A-3-167546.

Of these acidic nuclei, 2-thiohydantoin, 2-oxazoline-5-one, and rhodanine nuclei are preferred.

$L_1$, $L_2$, $L_3$, $L_4$, $L_5$ and $L_6$ each represent a methine group, or a substituted methine group (a methine group substituted with a substituent such as a substituted or unsubstituted alkyl group, a substituted or unsubstituted aryl group, a heterocyclic group, a halogen atom, an alkoxy group, an amino group, and an alkylthio group). Further, they may bond together to form a ring, or they may bond to an auxochrome to form a ring.

$M_1$ and $m_1$ are incorporated in the formula so as to show the presence or the absence of a cation or an anion, when it is necessary to neutralize an ionic charge of the dye.

Further preferably, the compound represented by formula (II) is selected from those represented by formula (II-a) described below.

formula (II-a)

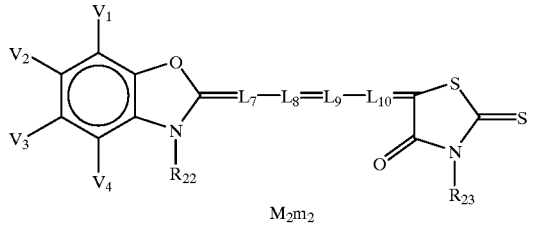

In formula (II-a), $R_{21}$ and $R_{23}$ each represent an alkyl group having a group that gives said compound water-solubility. Preferable examples of the group that gives the compound water-solubility include a sulfo group (or a salt thereof), a carboxyl group (or a salt thereof), a hydroxyl group, a mercapto group, an amino group, an acylamino group, an ammonio group, a sulfonamide group, an acylsulfamoyl group, and a sulfonylsulfamoyl group. Of these groups, a sulfo group (or a salt thereof), a carboxyl group (or a salt thereof), a hydroxyl group, and an acylamino group are especially preferred. $V_1$, $V_2$, $V_3$ and $V_4$ each represent a hydrogen atom, or a monovalent substituent with the proviso that said substituents ($V_1$, $V_2$, $V_3$, $V_4$) do not bond together to form a ring, and the total molecular weight of said substituents is 100 or less. $L_7$, $L_8$, $L_9$ and $L_{10}$ each represent a methine group. $M_2$ represents a counter ion to neutralize a charge. $m_2$ is a number of 0 or more necessary to neutralize a charge in the molecule.

Typical examples of the compound represented by formula (II) or (II-a) for use in the present invention is shown below. However, it is not intended to restrict the scope of this invention to them.

TABLE 1

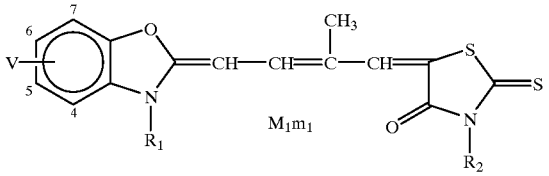

| Compound No. | $R_1$ | $R_2$ | V | $M_1$ | $m_1$ |
|---|---|---|---|---|---|
| II-1 | $(CH_2)_2SO_3^-$ | $CH_2CO_2$ | H | $Na^+$ | 2 |
| II-2 | " | " | " | $K^+$ | " |
| II-3 | " | " | " | $(C_2H_5)_3NH^+$ | " |
| II-4 | $(CH_2)_4SO_3^-$ | " | " | " | " |
| II-5 | $(CH_2)_3SO_3^-$ | " | " | " | " |
| II-6 | $(CH_2)_2CH(CH_3)SO_3^-$ | " | " | " | " |
| II-7 | $(CH_2)_4SO_3^-$ | " | 5-$OCH_3$ | " | " |
| II-8 | " | " | 5-F | $Na^+$ | " |
| II-9 | $(CH_2)_3SO_3^-$ | " | 5-$CH_3$ | " | " |
| II-10 | " | " | 5,6-$(CH_3)_2$ | " | " |
| II-11 | $(CH_2)_4SO_3^-$ | $(CH_2)_2SO_3^-$ | IL | $K^+$ | " |
| II-12 | $CH_2CO_2^-$ | $CH_2CO_2^-$ | " | $Na^+$ | " |
| II-13 | $CH_2CO_2^-$ | $(CH_2)_2SO_3$ | " | " | " |
| II-14 | $(CH_2)_3CO_3^-$ | " | " | " | " |
| II-15 | $(CH_2)_4SO_3^-$ | $(CH_2)_2OH$ | " | $K^+$ | 1 |
| II-16 | " | $(CH_2)_2CO_2^-$ | " | " | 2 |
| II-17 | " | $(CH_2)_3CO_2^-$ | " | " | " |

TABLE 1-continued
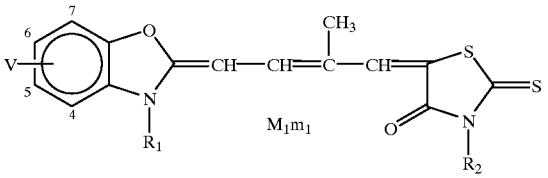
| Compound No. | $R_1$ | $R_2$ | V | $M_1$ | $m_1$ |
|---|---|---|---|---|---|
| II-18 | " | $(CH_2)_5CO_2^-$ | " | " | " |
| II-19 | " | $(CH_2)_2NHC(=O)CH_3$ | " | " | 1 |
| II-20 | 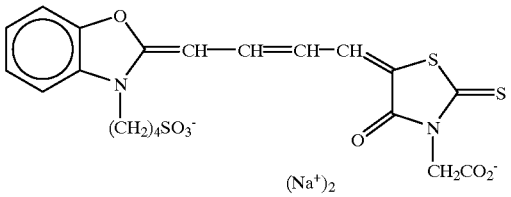 | | | | |
| II-21 | 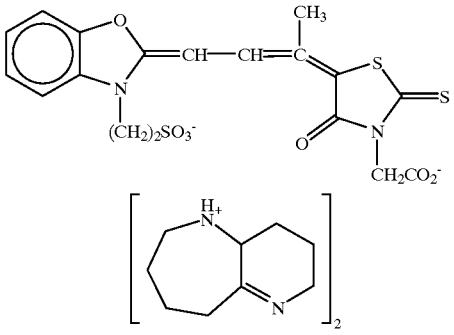 | | | | |
| II-22 | 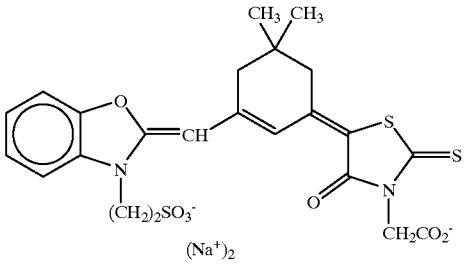 | | | | |
| II-23 | 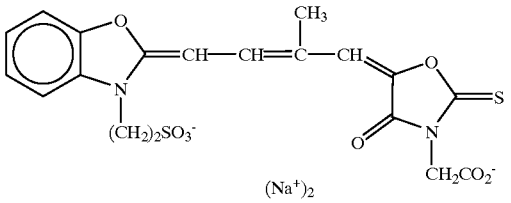 | | | | |

TABLE 1-continued
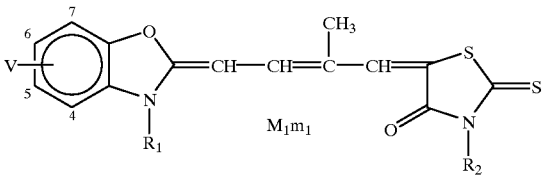
| Compound No. | $R_1$ | $R_2$ | V | $M_1$ | $m_1$ |
|---|---|---|---|---|---|
| II-24 | 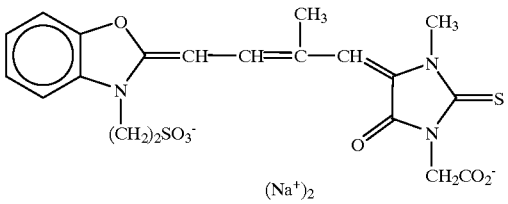 | | | | |
| II-25 | 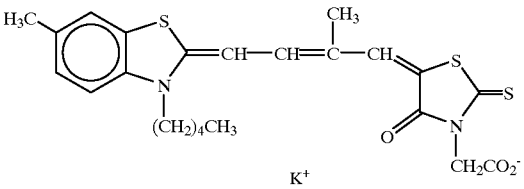 | | | | |
| II-26 | 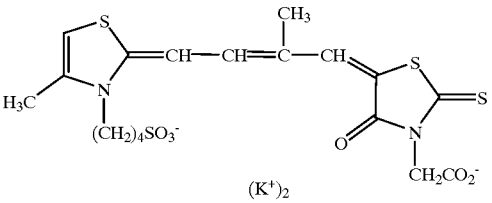 | | | | |
| II-27 | 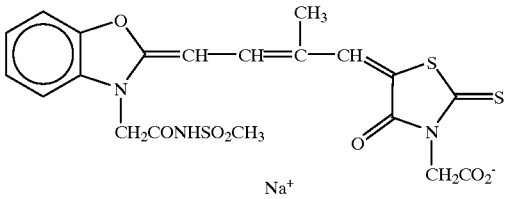 | | | | |
| II-28 | 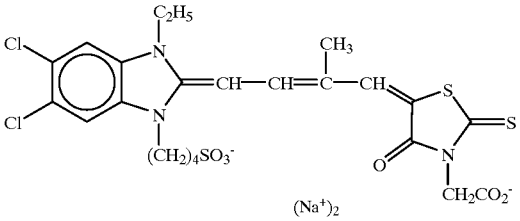 | | | | |
| II-29 | 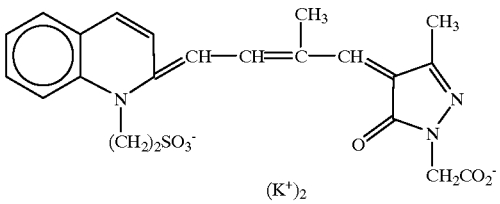 | | | | |

TABLE 1-continued

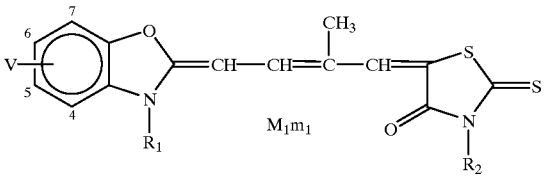

| Compound No. | $R_1$ | $R_2$ | V | $M_1$ | $m_1$ |
|---|---|---|---|---|---|
| II-30 | 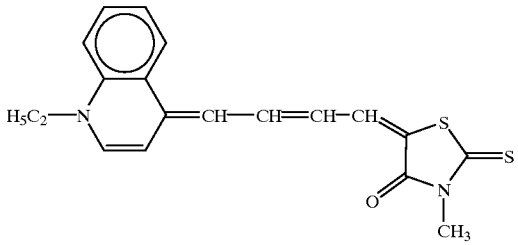 | | | | |
| II-31 | 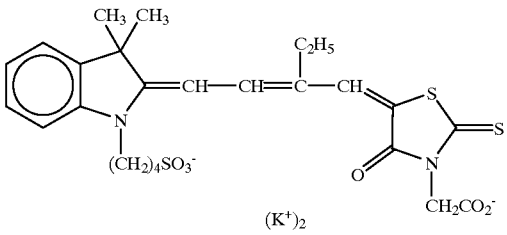 | | | | |
| II-32 | 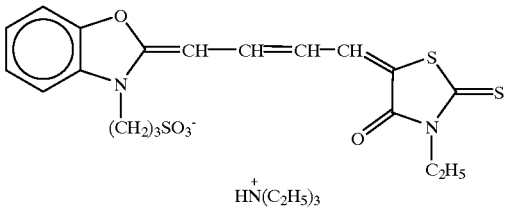 | | | | |
| II-33 | 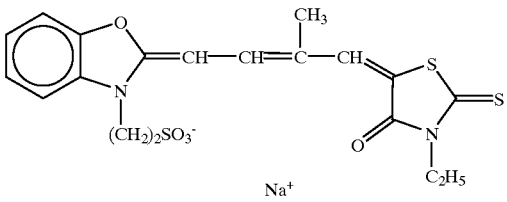 | | | | |
| II-34 | 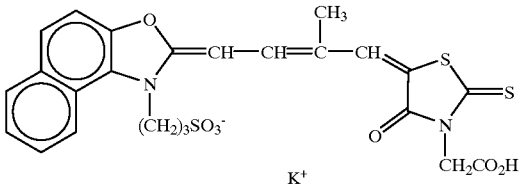 | | | | |

Subsequently, formula (III) is explained in detail. In formula (III), $Z_1$ and $Z_2$ each represent an atomic group necessary to complete a heterocyclic ring. $Z_3$ represents an atomic group necessary to form a nitrogen-containing heterocyclic ring in which the nitrogen atom has a substituent ($R_{33}$). $R_{31}$ and $R_{32}$ each represent an alkyl group, an alkenyl group, an aralkyl group, or an aryl group. $R_{33}$ has the same meaning as $R_{31}$ or $R_{32}$ and is the same or different from $R_{31}$ or $R_{32}$, or $R_{33}$ represents a substituted amino group, an amide group, an imino group, an alkoxy group, or a heterocyclic group. At least one of $R_{31}$, $R_{32}$ and $R_{33}$ represents a water-soluble group.

$L_{11}$ to $L_{19}$ each represent a methine group. m and n each represent 0, 1 or 2. 1 and p each represent 0 or 1. X represents a counter ion.

Examples of the heterocyclic ring formed by $Z_1$ or $Z_2$ of the above-described formula (III) include oxazoline, oxazole, benzoxazole, benzisoxazole, naphthoxazole, thiazoline, thiazole, benzothiazole, naphthothiazole, selenazoline, selenazole, benzoselenazole, naphthoselenazole, tellurazole, benzotellurazole, pyridine, quinoline, benzoquinoline, indolenine, benzoindolenine, benzimidazole, and pyrroline rings.

These heterocyclic rings may be substituted with a known substituent such as an alkyl group, an alkoxy group, an aryl group, a hydroxyl group, a carboxyl group, an alkoxycarbonyl group, and a halogen atom.

The 5- or 6-membered nitrogen-containing heterocyclic ring formed by $Z_3$ is preferably a residue corresponding to hydantoin, 2- or 4-thiohydantoin, 2-oxazoline-5-one, 2-thioxazoline-2,4-dione, thiazolidine-2,4-dione, rhodanine, thiazolidine-2,4-dithione, burbituric acid, or 2-thioburbituric acid, in each of which an oxo group, or a thioxo group is taken away; more preferably the residue corresponding to hydantoin, 2- or 4-thiohydantoine, 2-oxazoline-5-one, rhodanine, burbituric acid, or 2-thioburbituric acid, in each of which an oxo group, or a thioxo group is taken away; and especially preferably the residue corresponding to 2- or 4-thiohydantoin, 2-oxazoline-5-one, or rhodanine, from each of which an oxo group, or a thioxo group is taken away.

The alkyl group represented by $R_{31}$, $R_{32}$, and $R_{33}$ of the above-described formula (III) is preferably an alkyl group having 1 to 6 carbon atoms, and may be a straight chain, branched chain, or cyclic alkyl group. The alkyl group may have a substituent. Examples of the alkyl group include methyl, ethyl, iso-propyl, cyclohexyl, allyl, trifluoromethyl, β-hydroxyethyl, acetoxymethyl, carboxymethyl, ethoxycarbonylmethyl, β-methoxyethyl, γ-methoxypropyl, β-benzoyloxyethyl, γ-sulfopropyl, and δ-sulfobutyl.

Examples of the alkenyl group include an allyl group. Examples of the aralkyl group include benzyl, phenethyl, and sulfobenzyl. Examples of the aryl group include phenyl, tolyl, chlorophenyl, and sulfophenyl.

Further, examples of the group bonded to the nitrogen atom or the oxygen atom of the group represented by $R_{33}$, include an alkyl group, an alkenyl group, an aralkyl group, an aryl group, an acyl group, an alkylsulfonyl group, and a heterocyclic group. Such a group may bond to the nitrogen atom or the oxygen atom through a double bond, or it may form a ring together with the nitrogen atom or the oxygen atom. Examples of such a group of $R_{33}$ which substituted with such group(s) include dimethylamino, diethylamino, N-methylanilino, 1-piperidino, 1-morpholino, N-methyl-2-pyridinoamino, benzylideneimino, dibenzylamino, N-acetylmethylamino, benzylamino, acetoamino, N-methylsulfonylamino, N-methylureido, and 3-methylbenzothiazolideneimino. Examples of the alkoxy group represented by $R_{33}$ include methoxy, and ethoxy.

However, at least one of $R_{31}$, $R_{32}$ and $R_{33}$ represents a group having at least one water-soluble group. Herein water-soluble group represents a substituent such as a sulfo group (or a salt thereof), a carboxyl group (or a salt thereof), a hydroxyl group, a mercapto group, an amino group, an ammonio group, a sulfonamide group, an acylsulfamoyl group, a sulfonylsulfamoyl group, an active methine group, or a substituent containing such a group. Preferable examples of the water-soluble group include a sulfo group (or a salt thereof), a carboxyl group (or a salt thereof), a hydroxyl group, and an amino group.

The counter ion represented by X does not exist, when the compound forms an intramolecular salt. On the other hand, when two acidic groups (e.g., sulfo, sulfate, carboxyl) exist in a molecule, X represents a cation such as an alkali metal atom, and an organic ammonium. $L_{11}$ to $L_{19}$ each represent a methine group which may have a substituent such as alkyl, aryl, and alkoxy.

Specific examples of the compound represented by formula (III) for use in the present invention are shown below. However, it is not intended to restrict the scope of this invention to them.

III-1

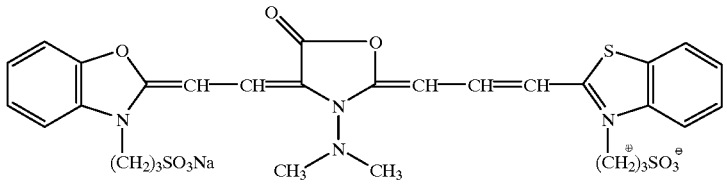

III-2

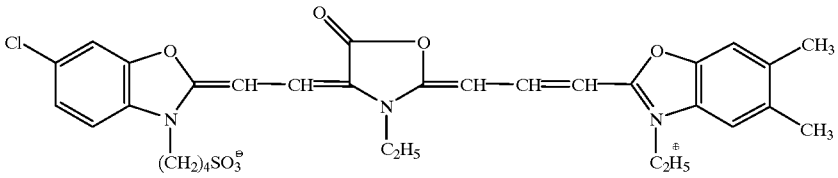

III-3

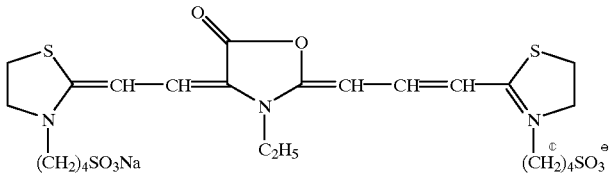

-continued
III-4
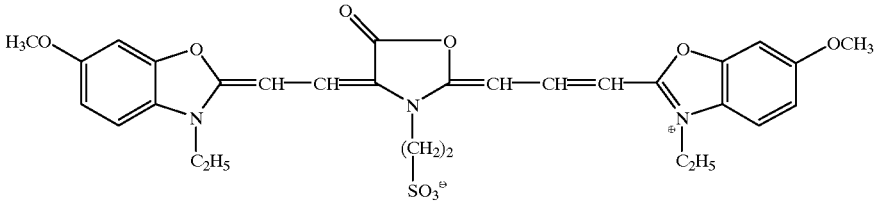
III-5
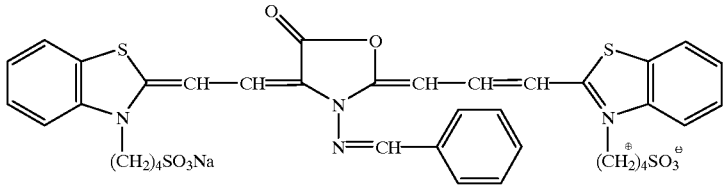
III-6
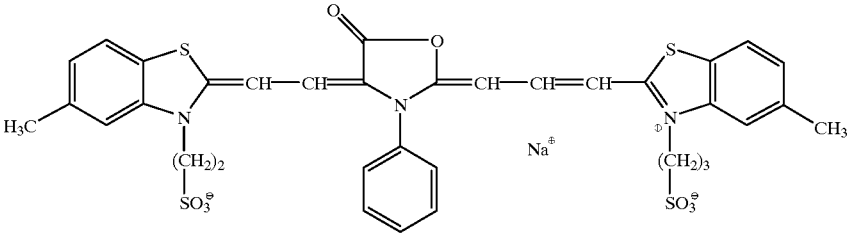
III-7
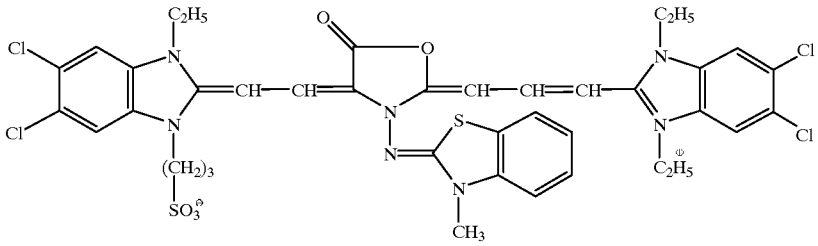
III-8
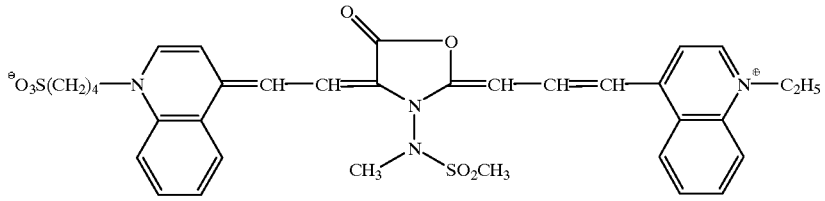
III-9
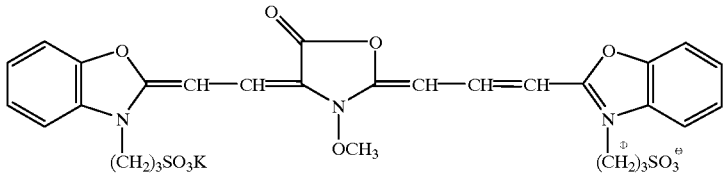
III-10
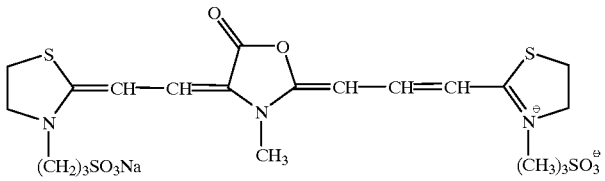

-continued
III-11
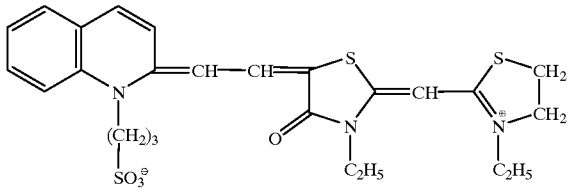
III-12
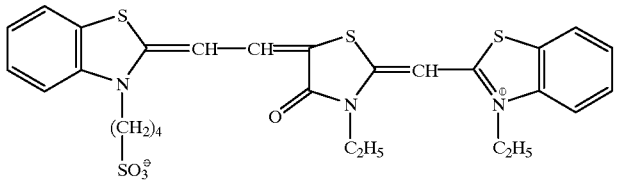
III-13
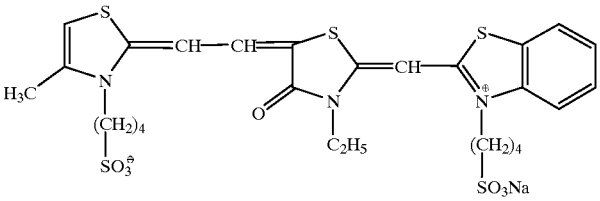
III-14
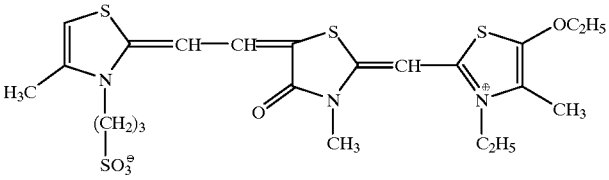
III-15
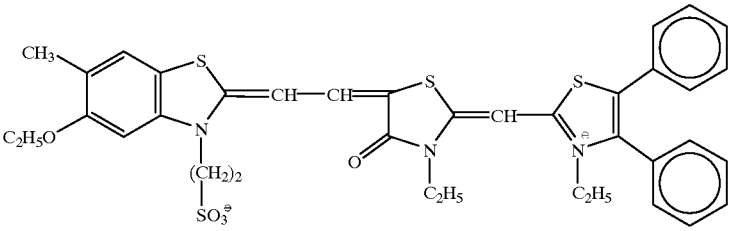
III-16
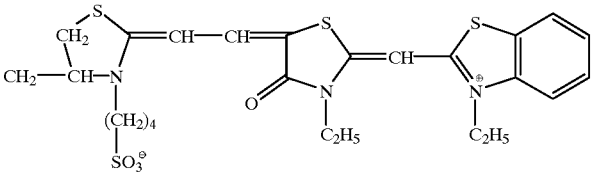
III-17
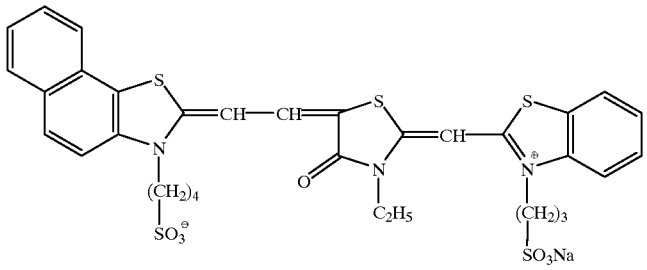

-continued

III-18

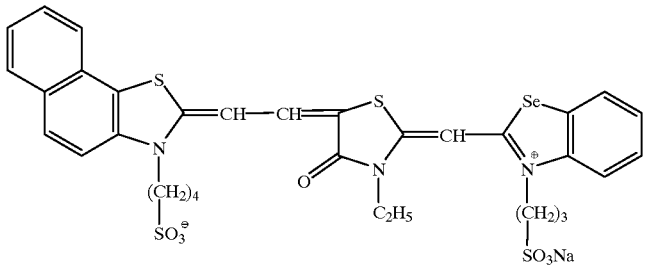

III-19

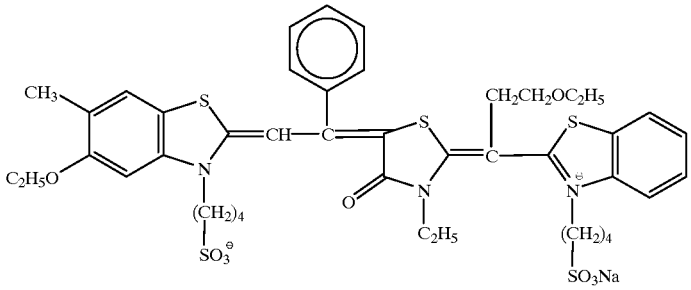

III-20

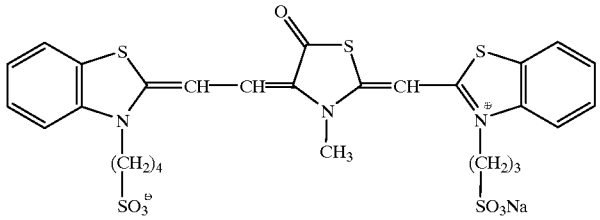

III-21

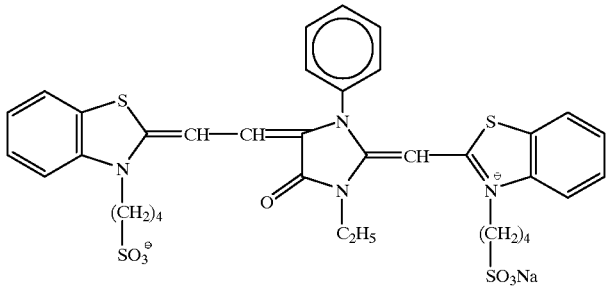

Subsequently, formula (IV) is illustrated. In formula (IV), Y represents —S—, or —Se—. At least two of $R_{41}$, $R_{42}$, $R_{43}$, $R_{44}$ and $R_{45}$ each represent an organic group having a water-soluble group. Other group(s) of $R_{41}$ to $R_{45}$ which do not represent the above-described organic group having a water-soluble group, each represent a hydrogen atom, an alkyl group, a substituted alkyl group, an alkenyl group, a substituted alkenyl group, an aryl group, or a substituted aryl group. $R_{46}$ and $R_{47}$, which may be the same or different, each represents a substituted, or unsubstituted, alkyl group, alkenyl group, alkynyl group, alkoxy group, alkylthio group, arylthio group, aryl group, acyl group, alkoxycarbonyl group, alkylsulfonyl group, carbamoyl group, or sulfamoyl group, a hydrogen atom, a hydroxyl group, a halogen atom, a carboxyl group, or a cyano group. Further, $R_{46}$ and $R_{47}$ may bond together to complete a carbocyclic ring series. Each of the above-described ring series may have one or more substituents, which may be the same or different, selected from the above-described substituents for $R_{46}$ and $R_{47}$.

The term "water-soluble group" referred to in the specification of this application denotes a group having a negative value in terms of π value of the Hansch method which is used in so-called structure-activity correlations capturing a relationship between a chemical structure of the compound and a physiological activity thereof. The Hansch method is minutely described in J. Med. Chem., 16, 1207 (1973) and ibid. 20, 304 (1977).

The number of water-soluble group(s) in each of the sensitizing dyes represented by formulae (II) to (IV) for use in the present invention, is preferably 2 or 3.

Examples of the above-described organic group having at least one water-soluble group are shown below. However, it is not intended to restrict the scope of this invention to them. That is, they are selected from $—(CH_2)_n—COOM$, $—C_2H_4—COOM$, $—CH_2—C_2H_4—COOM$, $—(CH_2)_n—SO_3M$, $—C_2H_4—SO_3M$, $—CH_2—C_2H_4—SO_3M$, $—CH_2—COO—CH_2—COO—R_{48}$, and $—CH_2—COO—C_2H_4—COO—R_{48}$, wherein n is an integer of 1 to 4, M represents a hydrogen atom, an ammonium group, an alkali metal atom, or an organic amine salt, and $R_{48}$ represents an alkyl group.

The other group(s) of $R_{41}$ to $R_{45}$, which do not represent an organic group having at least one water-soluble group, are selected from a hydrogen atom, an alkyl group (e.g., methyl, ethyl), a substituted alkyl group, an alkenyl group (e.g., allyl), a substituted alkenyl group, an aryl group (e.g., phenyl), and a substituted aryl group (e.g., p-tolyl).

$R_{46}$ and $R_{47}$ in formula (IV), which may be the same or different, each represents a hydrogen atom, a hydroxyl group, a halogen atom, an alkyl group (e.g., methyl, ethyl, propyl), a substituted alkyl group (e.g., trifluoromethyl, 2,2,2-trifluoroethyl), an alkenyl group (e.g., allyl), a substituted alkenyl group, an alkoxy group (e.g., methoxy, ethoxy), an alkylthio group (e.g., ethylthio), a substituted alkylthio group, an arylthio group (e.g., phenylthio), a substituted arylthio group, an aryl group (e.g., phenyl), a substituted aryl group (e.g., p-tolyl), an acyl group (e.g., acetyl, propionyl), an acyloxy group (e.g., acetoxy, propionyloxy), an alkoxycarbonyl group (e.g., methoxycarbonyl), an alkylsulfonyl group (e.g., methylsulfonyl), a carbamoyl group, a substituted carbamoyl group, a sulfamoyl group, a substituted sulfamoyl group, a carboxyl group, or a cyano group. Alternatively, $R_{46}$ and $R_{47}$, which are bonding together, represent an atomic group necessary to complete a carbocyclic ring series (e.g., benzene or naphthalene ring series), which may have one or more substituents, which may be the same, or different, selected from the above-described substituents each recited for $R_{46}$ and $R_{47}$.

Specific examples of the compound are shown below.

IV-1

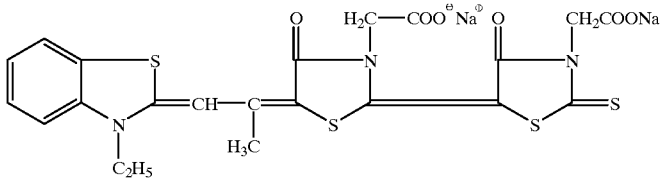

IV-2

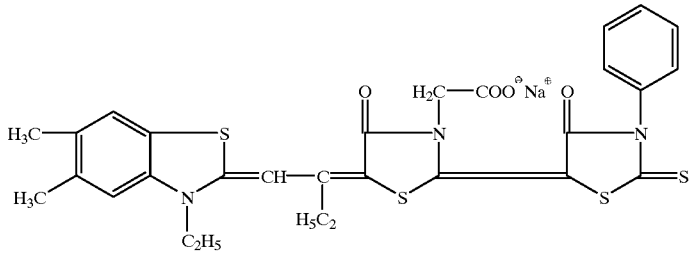

IV-3

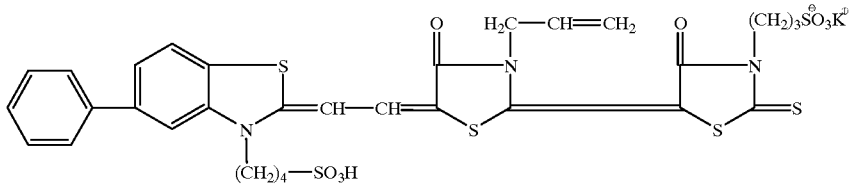

IV-4

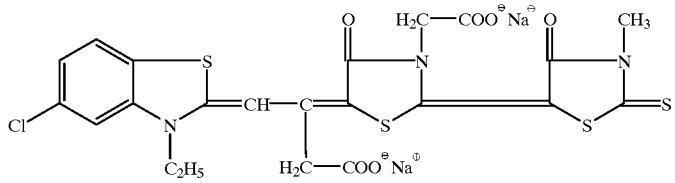

IV-5

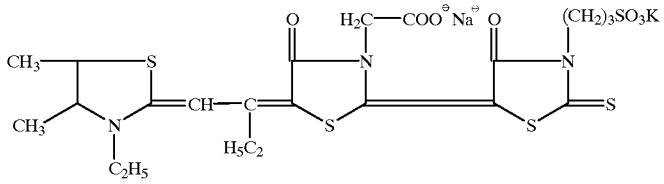

-continued

IV-6

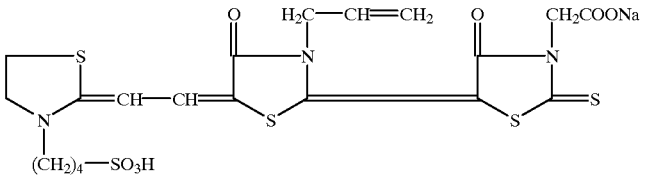

The compounds represented by the above-described formulae (II) to (IV) can be synthesized based on the methods as described in, for example, F. M. Hamer, *Heterocyclic Compounds-Cyanine Dyes and Related Compounds*, John Wiley &; Sons, New York, London, 1964, D. M. Sturmer, *Heterocyclic Compounds—Special topics in heterocyclic chemistry,* The Chapter 18, Section 14, pp. 482 to 515, John Wiley &; Sons, New York, London (1977); and *Rodd's Chemistry of Carbon Compounds,* 2nd Ed. vol. IV, part B (1977), The Chapter 15, pp. 369 to 422, and 2nd Ed. vol. IV, part B (1985), The Chapter 15, pp. 267–296, Elsevier Science Publishing Company Inc., New York.

These sensitizing dyes may be used singly or in combination, and a combination of sensitizing dyes is often used for the purpose of, particularly, supersensitization. In combination with the sensitizing dye, a dye which itself has no spectral sensitization effect, or a material that adsorbs substantially no visible light, but that exhibits supersensitization, may be incorporated into the emulsion.

Useful sensitizing dyes, combinations of dyes that exhibit supersensitization, and materials that show supersensitization are described, for example, in *Research Disclosure,* Vol. 176, 17643, page 23, Item IV-J (December 1978); JP-B-49-25500, JP-B-43-4933, JP-A-59-19032, and JP-A-59-192242.

The sensitizing dyes for use in the present invention may be used in a combination of two or more thereof. The sensitizing dye may be added to a silver halide emulsion by dispersing it directly in the emulsion, or by dissolving it in a sole or mixed solvent of such solvents of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide, and then adding the solution to the emulsion.

Alternatively, the sensitizing dye may be added to the emulsion by a method disclosed in U.S. Pat. No. 3,469,987, in which a dye is dissolved in a volatile organic solvent, the solution is dispersed in water or a hydrophilic colloid, and the dispersion is added to the emulsion; a method disclosed, for example, in JP-B-44-23389, JP-B-44-27555, and JP-B-57-22091, in which a dye is dissolved in an acid, and the solution is added to the emulsion, or a dye is formed into an aqueous solution in the co-existence of an acid or base and then it is added to the emulsion; a method disclosed, for example, in U.S. Pat. Nos. 3,822,135 and 4,006,025, in which a dye is formed into an aqueous solution or a colloid dispersion in the presence of a surface-active agent together, and the solution or dispersion is added to the emulsion; a method disclosed in JP-A-53-102733 and JP-A-58-105141, in which a dye is directly dispersed in a hydrophilic colloid, and the dispersion is added to the emulsion; or a method disclosed in JP-A-51-74624, in which a dye is dissolved using a compound capable of red-shift, and the solution is added to the emulsion. Ultrasonic waves may also be used for the solution.

The sensitizing dye for use in the present invention may be added to a silver halide emulsion for use in the present invention at any step known to be useful during the preparation of a photographic emulsion. For example, the dye may be added at a step of formation of silver halide grains, and/or in a period before desalting, or at a step of desalting, and/or in a period between after desalting and before initiation of chemical ripening, as disclosed, for example, in U.S. Pat. Nos. 2,735,766, 3,628,960, 4,183,756, and 4,225,666, JP-A-58-184142, and JP-A-60-196749, or the dye may be added in any period or at any step before coating of the emulsion, such as immediately before or during chemical ripening, or in a period after chemical ripening but before coating, as disclosed, for example, in JP-A-58-113920. Also, a sole kind of compound alone, or compounds different in structure in combination, may be added in divided manner; for example, a part during grain formation, and the remaining during chemical ripening, or after completion of the chemical ripening; or a part before or during chemical ripening, and the remaining after completion of the chemical ripening, as disclosed, for example, in U.S. Pat. No. 4,225,666 and JP-A-58-7629. The kind of compounds added in divided manner, or the kind of the combination of compounds, may be changed.

The addition amount of the sensitizing dye for use in the present invention varies depending upon the shape, size, the halogen composition of silver halide grains, the method and degree of chemical sensitization, the kind of antifoggant, and the like, but the addition amount can be from $4\times10^{-6}$ to $8\times10^{-3}$ mol per mol of silver halide. For example, when the silver halide grain size is from 0.2 to 1.3 $\mu$m, the addition amount is preferably from $2.0\times10^{-7}$ to $3.5\times10^{-6}$, more preferably from $6.5\times10^{-7}$ to $2.0\times10^{-6}$ mol, per $m^2$ of the surface area of a silver halide grain.

As a binder of the silver halide emulsion layer and another hydrophilic colloid layer for use in the present invention, gelatin is preferably used. Further, other hydrophilic colloid (s) besides gelatin can also be used, and they can also be used in combination with gelatin. Examples of the above other hydrophilic colloid include various kinds of synthetic hydrophilic high-molecular materials, such as gelatin derivatives, graft copolymers of gelatin and another high-molecular compound; proteins including albumin and casein; cellulose derivatives, such as hydroxyethyl cellulose, carboxymethyl cellulose, and cellulose sulfate ester; sugar derivatives, such as sodium alginate and starch derivatives; and homo- or co-polymers, such as polyvinyl alcohol, partial acetals of polyvinyl alcohol, poly-N-vinylpyrrolidone, polyacrylic acid, polymethacrylic acid, polyacrylamide, polyvinylimidazole, and polyvinylpyrazole.

As a gelatin, in addition to a lime-treated gelatin, an acid-treated gelatin, a hydrolytic product of gelatin, and an enzymatic decomposition product of gelatin can also be used.

The coating amount of gelatin as a binder for use in the present invention is generally 3 g/$m^2$ or less (preferably from 1.0 to 3.0 g/m$^2$), in terms of the gelatin amount of all hydrophilic colloid layers coated on the same side as a coated silver halide emulsion layer; and generally 6.0 g/m$^2$ or less and preferably from 2.0 to 6.0 g/m$^2$, in terms of the total gelatin amount of the above-said all hydrophilic colloid layers coated on the same side as a coated silver halide emulsion layer and all hydrophilic colloid layers coated on the side opposite to the coated silver halide emulsion layer.

The degree of swelling of the hydrophilic colloid layers of the silver halide photographic light-sensitive material of the present invention, including a silver halide emulsion layer and a protective layer, is preferably from 80 to 150%, and more preferably from 90 to 140%. The degree of swelling of the hydrophilic colloid layers is obtained by measuring the thickness (d0) of the hydrophilic colloid layers, including a silver halide emulsion layer and a protective layer, of the silver halide photographic light-sensitive material, measuring the swollen thickness (Δd) of the said silver halide photographic light-sensitive material after it has been dipped in distilled water at 25° C. for 1 minute, and following the calculating equation set forth below. Degree of swelling (%)=((Δd)÷d0)×100

Examples of the support (base) that can be used in practice of the present invention include a baryta paper, a polyethylene-laminated paper, a polypropylene synthetic paper, a glass plate, cellulose acetate, cellulose nitrate, and polyester films, such as polyethylene terephthalate. These supports are properly selected in accordance with the use purpose of each silver halide photographic light-sensitive material.

The hydrazine derivatives for use in the present invention are now explained.

Preferable hydrazine derivatives for use in the present invention are those represented by formula (N) set forth below:

formula (N)

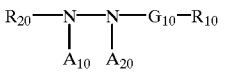

wherein $R_{20}$ represents an aliphatic group, an aromatic group, or a heterocyclic group; $R_{10}$ represents a hydrogen atom or a blocking group; $G_{10}$ represents a —CO—, —COCO—, —C(=S)—, —$SO_2$—, —SO—, or —PO($R_{30}$)— group (in which $R_{30}$ is selected from the same range of groups for $R_{10}$ as defined above, and $R_{30}$ and $R_{10}$ may be the same or different), or an iminomethylene group; $A_{10}$ and $A_{20}$ each represent a hydrogen atom, or one of them is a hydrogen atom and the other is a substituted or unsubstituted alkylsulfonyl group, a substituted or unsubstituted arylsulfonyl group, or a substituted or unsubstituted acyl group.

In formula (N), the aliphatic group represented by $R_{20}$ is preferably a substituted or unsubstituted straight-chain, branched-chain, or cyclic alkyl, alkenyl, or alkynyl group, each having 1 to 30 carbon atoms.

In formula (N), the aromatic group represented by $R_{20}$ is a monocyclic or condensed-ring aryl group. Examples of the ring include a benzene ring and a naphthalene ring. The heterocyclic group represented by $R_{20}$ is a monocyclic or condensed-ring, saturated or unsaturated, aromatic or non-aromatic heterocyclic group. Examples of the ring include a pyridine, a pyrimidine, an imidazole, a pyrazole, a quinoline, an isoquinoline, a benzimidazole, a thiazole, a benzothiazole, a piperidine, and a triazine ring. $R_{20}$ is preferably an aryl group, and especially preferably a phenyl group.

$R_{20}$ may be substituted with a substituent. Typical examples of the substituent include a halogen atom (fluorine, chlorine, bromine, or iodine), an alkyl group, which includes an aralkyl group, a cycloalkyl group, and an active methine group; an alkenyl group, an alkinyl group, an aryl group, a heterocyclic group, a quarternized nitrogen atom-containing heterocyclic group (e.g. a piperidinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group; an alkoxy group, which group contains a group containing a repeating unit of an ethyleneoxy group or a propyleneoxy group; an aryloxy group, a heterocyclic oxy group, an acyloxy group, an (alkoxy or aryloxy)carbonyloxy group, a carbamoyloxy group, a sulfonyloxy group, an amino group, an (alkyl, aryl, or heterocyclic)amino group, an N-substituted nitrogen-containing heterocyclic group, an acylamino group, a sulfonamide group, a ureido group, a thioureido group, an imido group, an (alkoxy or aryloxy)-carbonylamino group, a sulfamoylamino group, a semicarbazido group, a thiosemicarbazido group, a hydrazino group, a quaternary ammonio group, an oxamoyl amino group, an (alkyl or aryl) sulfonylureido group, an acylureido group, an acylsulfamoylamino group, a nitro group, a mercapto group, an (alkyl, aryl, or heterocyclic)-thio group, an (alkyl, or aryl) sulfonyl group, an (alkyl or aryl)sulfinyl group, a sulfo group or a salt thereof, a sulfamoyl group, an acylsulfamoyl group, a sulfonylsulfamoyl group or a salt thereof, and a group having a phosphonamide or phosphate structure.

These substitutes may be further substituted by any of the above substituents.

Preferable examples of the substituent that $R_{20}$ may have include an alkyl group having 1 to 20 carbon atoms, wherein an active methylene group is included; an aralkyl group, a heterocyclic group, a substituted amino group, an acrylamino group, a sulfonamide group, a ureido group, a sulfamoylamino group, an imido group, a thioureido group, a phosphonamide group, a hydroxyl group, an alkoxy group, an aryloxy group, an acyloxy group, an acyl group, an alkoxycarbonyl group, an aryloxycarbonyl group, a carbamoyl group, a carboxyl group or a salt thereof, an (alkyl, aryl, or heterocyclic)thio group, a sulfo group or a salt thereof, a sulfamoyl group, a halogen atom, a cyano group, and a nitro group.

In formula (N), $R_{10}$ represents a hydrogen atom or a blocking group, and specific examples of the blocking group include an alkyl group, an alkenyl group, an alkynyl group, an aryl group, a heterocyclic group, an alkoxy group, an aryloxy group, an amino group, and a hydrazino group.

The alkyl group represented by RIO is preferably an alkyl group having 1 to 10 carbon atoms. Specific examples of the alkyl group include a methyl group, a trifluoromethyl group, a difluoromethyl group, a 2-carboxytetrafluoroethyl group, a piridiniomethyl group, a difluoromethoxymethyl group, a difluorocarboxymethyl group, a 3-hydroxypropyl group, a 3-methanesulfonamidopropyl group, a phenylsulfonylmethyl group, and an o-hydroxybenzyl group. The alkenyl group is preferably an alkenyl group having 1 to 10 carbon atoms. Examples of the alkenyl group include a vinyl group, a 2-ethoxycarbonylvinyl group, and a 2-trifluoro-2-methoxycarbonylvinyl group. The alkynyl group is preferably an alkynyl group having 1 to 10 carbon atoms. Examples of the alkynyl group include an ethynyl group and a 2-methoxycarbonylethynyl group. The aryl group is preferably a monocyclic or condensed-ring aryl group, and especially preferably an aryl group containing a benzene ring. Examples of the aryl group include a phenyl group, a 3,5-dichlorophenyl group, a 2-methanesulfonamidephenyl group, a 2-carbamoylphenyl group, a 4-cyanophenyl group, and a 2-hydroxymethylphenyl group.

The heterocyclic group is preferably a 5- or 6-membered, saturated or unsaturated, monocyclic or condensed-ring heterocyclic group that contains at least one nitrogen, oxygen, or sulfur atom. Examples of the heterocyclic group include a morpholino group, a piperidino group (N-substituted), an imidazolyl group, an indazolyl group (e.g. a 4-nitroindazolyl group), a pyrazolyl group, a triazolyl group, a benzoimidazolyl group, a tetrazolyl group, a pyridyl group, a pyridinio group (e.g. a N-methyl-3-pyridinio group), a quinolinio group, and a quinolyl group. Among these, especially preferred are a morpholino group, a piperidino group, a pyridyl group, a pyridinio group, and an indazolyl group.

The alkoxy group is preferably an alkoxy group having 1 to 8 carbon atoms. Examples of the alkoxy group include a methoxy group, a 2-hydroxyethoxy group, and a benzyloxy group. The aryloxy group is preferably a phenyloxy group. The amino group is preferably an unsubstituted amino group, an alkylamino group having 1 to 10 carbon atoms, an arylamino group, or a saturated or unsaturated heterocyclic amino group, wherein a quarternized nitrogen atom-containing heterocyclic group is included. Examples of the amino group include a 2,2,6,6-tetramethylpiperidine-4-ylamino group, a propylamino group, a 2-hydroxyethylamino group, an anilino group, an o-hydroxyanilino group, a 5-benzotriazolylamino group, and a N-benzyl-3-piridinioamino group. The hydrazino group is especially preferably a substituted or unsubstituted hydrazino group, or a substituted or unsubstituted phenylhydrazino group (e.g. a 4-benzenesulfonamidophenylhydrazino group).

These groups represented by $R_{10}$ may have a substituent. Preferable examples of the substituent are the same as those mentioned as the substituent of $R_{20}$.

In formula (N), $R_{10}$ may be an atomic group capable of splitting part of $G_{10}$—$R_{10}$ from the remainder of molecule, and subsequently of taking place cyclization reaction by which a cyclic structure containing atoms of the —$G_{10}$—$R_{10}$ part is formed. Examples of the atomic groups include those described, for example, in JP-A-63-29751.

The hydrazine derivatives represented by formula (N) may contain an adsorbing group capable of being adsorbed onto the silver halide. Examples of the adsorbing group include an alkylthio group, an arylthio group, a thiourea group, a thioamide group, a mercapto heterocyclic group, and a triazole group, described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246. Further, these groups capable of being adsorbed onto the silver halide may be modified into a precursor thereof. Examples of the precursor include those groups described in JP-A-2-285344.

$R_{10}$ or $R_{20}$ of formula (N) may contain a polymer or a ballasting group that is usually used for immobile photographic additives, such as a coupler. The ballasting group has 8 or more carbon atoms, and it is a group relatively inactive to photographic properties. The ballasting group can be selected from an alkyl group, an aralkyl group, an alkoxy group, a phenyl group, an alkylphenyl group, a phenoxy group, and an alkylphenoxy group. Examples of the polymer include those described, for example, in JP-A-1-100530.

$R_{10}$ or $R_{20}$ of formula (N) may contain a plurality of hydrazino groups as a substituent. At this time, the compound represented by formula (N) is a multimer of the hydrazino group. Specific examples of the compound include those described, for example, in JP-A-64-86134, JP-A-4-16938, JP-A-5-197091, WO95-32452, WO95-32453, Japanese Patent Application Nos. 7-351132, 7-351269, 7-351168, and 7-351287, and JP-A-9-179229.

$R_{10}$ or $R_{20}$ of formula (N) may contain a cationic group (e.g. a group containing a quaternary ammonio group, or a nitrogen-containing heterocyclic group containing a quarternarized nitrogen atom), a group containing a repeating unit of an ethyleneoxy group or a propyleneoxy group; an alkyl-, aryl-, or heterocyclic- thio group, or a dissociating group capable of dissociating due to a base (e.g. a carboxyl group, a sulfo group, an acylsulfamoyl group, a carbamoylsulfamoyl group). Examples of the compounds containing these groups include those described, for example, in JP-A-7-234471, JP-A-5-333466, JP-A-6-19032, JP-A-6-19031, JP-A-5-45761, U.S. Pat. Nos. 4,994,365 and 4,988,604, JP-A-7-259240, JP-A-7-5610, JP-A-7-244348, and German Patent No. 4006032.

In formula (N), $A_{10}$ and $A_{20}$ each represent a hydrogen atom or an alkyl or arylsulfonyl group having 20 or less carbon atoms (preferably, a phenylsulfonyl group, or a phenyl sulfonyl group substituted with a substituent(s) so that the total of the Hammett substituent constant of the substituent becomes −0.5 or more), or an acyl group having 20 or less carbon atoms (preferably, a benzoyl group, a benzoyl group substituted with a substituent(s) so that the total of the Hammett substituent constant of the substituent becomes −0.5 or more, or a straight-chain, branched, or cyclic, substituted or unsubstituted, aliphatic acyl group, wherein examples of the substituent include a halogen atom, an ether group, a sulfonamide group, a carbonamide group, a hydroxyl group, a carboxyl group, and a sulfo group). $A_{10}$ and $A_{20}$ each are most preferably a hydrogen atom.

Next, especially preferable hydrazine derivatives for use in the present invention are explained.

$R_{20}$ is especially preferably a substituted phenyl group, preferably substituted with at least one substituent that is bonded to the phenyl group through a sulfonamide group, an acylamino group, a ureido group, or a carbamoyl group, the substituent being selected from the group consisting of a ballasting group, a group adsorbable onto a silver halide, a group containing a quaternary ammonio group, a nitrogen-containing heterocyclic group containing a quaternized nitrogen atom, a group containing a repeating unit of an ethyleneoxy group; an alkyl, aryl, or heterocyclic thio group; a group capable of dissociating in an alkaline development-processing solution (e.g. a carboxyl group, a sulfo group, an acylsulfamoyl group, a carbamoylsulfamoyl group), and a hydrazino group capable of forming a multimer (a group represented by —NHNH—$G_{10}$—$R_{10}$). $R_{20}$ is most preferably a phenyl group substituted with a benzenesulfonamide group. As a substituent of the benzene ring constituting the benzenesulfonamide group, preferably at least one of the above-mentioned substituents is attached to the benzene ring, directly or via a connecting group.

Among those groups represented by $R_{10}$ when $G_{10}$ is a —CO— group, preferred are a hydrogen atom, an alkyl group, an alkenyl group, an alkynyl group, an aryl group, or a heterocyclic group, and more preferably a hydrogen atom, an alkyl group, or a substituted aryl group, wherein the substituent is especially preferably an electron-withdrawing group or an o-hydroxymethyl group. An alkyl group is most preferred.

When $G_{10}$ is a —COCO— group, an alkoxy group, an aryloxy group, and an amino group are preferred. Further, a substituted amino group, specifically an alkylamino group, an arylamino group, and a saturated or unsaturated heterocyclic amino group, is especially preferred.

Further, when $G_{10}$ is a —$SO_2$— group, $R_{10}$ is preferably an alkyl group, an aryl group, or a substituted amino group.

In formula (N), $G_{10}$ is preferably a —CO— group or a —COCO—group and especially preferably a —CO— group.

Next, specific examples of the compound represented by formula (N) are illustrated below, but it is not intended to restrict the scope of the invention to them.

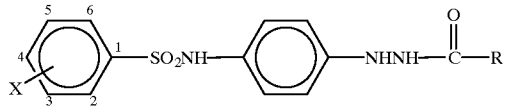
| | X = | R = —H | —$C_2F_4$—COOH (or —$C_2F_4$—$COO^{\ominus}K^{\ominus}$) | 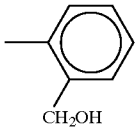 | 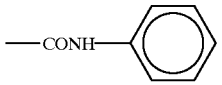 |
|---|---|---|---|---|---|
| 1 | 3-$NHCOC_9H_{19}$ | 1a | 1b | 1c | 1d |
| 2 | 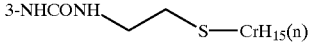 | 2a | 2b | 2c | 2d |
| 3 | 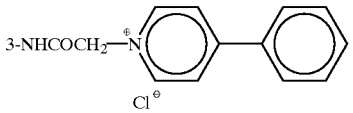 | 3a | 3b | 3c | 3d |
| 4 | 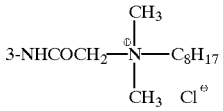 | 4a | 4b | 4c | 4d |
| 5 | 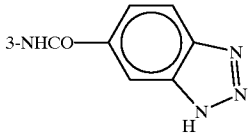 | 5a | 5b | 5c | 5d |
| 6 | 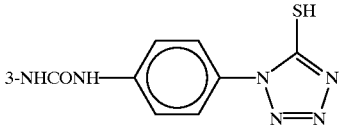 | 6a | 6b | 6c | 6d |
| 7 | 2,4-$(CH_3)_2$- | 7a | 7b | 7c | 7d |

-continued
| | | | | | |
|---|---|---|---|---|---|
| | 3-$SC_2H_4(—OC_2H_4)_4—OC_8H_{17}$ | | | | |
| | 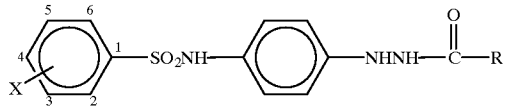 | | | | |
| | | R = | | | |
| | X = | —H | —$CF_2H$ | 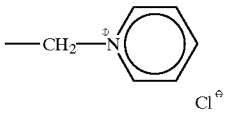 | 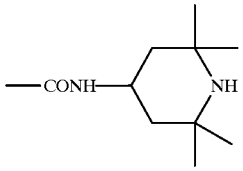 |
| 8 | 3-$CONHCH_2CH(C_2H_5)—C_4H_9$ | 8a | 8e | 8f | 8g |
| 9 | 6-$OCH_3$-3-$C_5H_{11}$ (t) | 9a | 9e | 9f | 9g |
| 10 | 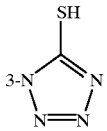 | 10a | 10e | 10f | 10g |
| 11 | 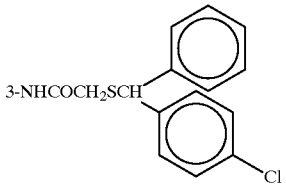 | 11a | 11e | 11f | 11g |
| 12 | 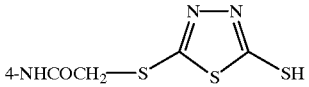 | 12a | 12e | 12f | 12g |

-continued
| | | | | | |
|---|---|---|---|---|---|
| 13 | 3-NHCOCH(CH$_2$COOH)—C$_8$H$_{17}$ | 13a | 13e | 13f | 13g |
| 14 | 3.5—(CONHCH$_2$CH(C$_2$H$_5$)—C$_4$H$_9$)$_2$ | 14a | 14e | 14f | 14g |
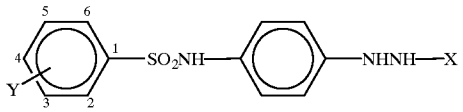
| | | X = | | | |
|---|---|---|---|---|---|
| | Y = | —CHO | —COCF$_3$ | —SO$_2$CH$_3$ | —P(=O)(OC$_2$H$_5$)$_2$ |
| 15 | 3-NHCOCH$_2$N$^{\oplus}$(Cl$^{\ominus}$)—CONHC$_4$H$_9$ | 15a | 15h | 15i | 15j |
| 16 | 4-NHCO(CH$_2$)$_2$N$^{\oplus}$(Cl$^{\ominus}$)—C$_6$H$_{13}$ | 16a | 16h | 16i | 16j |
| 17 | 3-SO$_2$NH—(CH$_2$)$_4$—O—(CH$_2$)$_4$—OC$_4$H$_9$ | 17a | 17h | 17i | 17j |
| 18 | 3.4-(COOCH(CH$_3$)COOC$_4$H$_9$)$_2$ | 18a | 18h | 18i | 18j |
| 19 | 3-NHCO—(CH$_2$)$_4$—(1,2-dithiolane) | 19a | 19h | 19i | 19j |
| 20 | 3-NHSO$_2$NH—C$_8$H$_{17}$ | 20a | 20h | 20i | 20j |

-continued
| | | | | | |
|---|---|---|---|---|---|
| 21 | 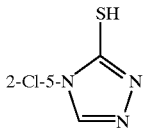 | 21a | 21h | 21i | 21j |
| | | R = | | | |
|---|---|---|---|---|---|
| | | —H | —$CF_2H$ | —$CF_3$ | —$CONHC_3H_7$ |
| 22 | 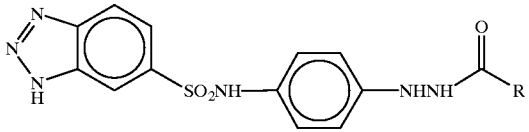 | 22a | 22e | 22k | 22l |
| 23 | 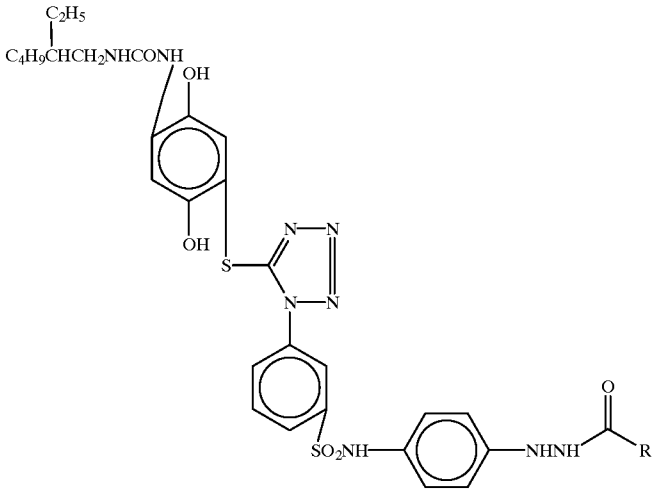 | 23a | 23e | 23k | 23l |

-continued
| | | | | | |
|---|---|---|---|---|---|
| 24 | 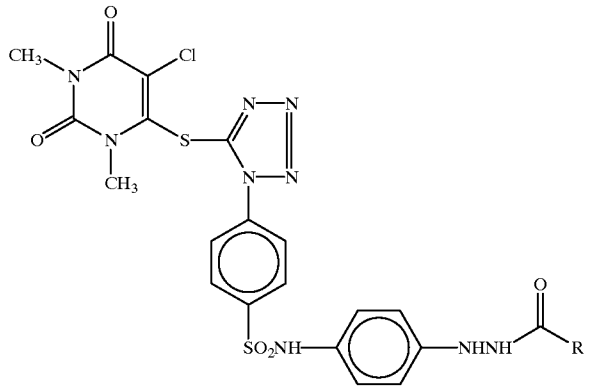 | 24a | 24e | 24k | 24l |
| 25 | 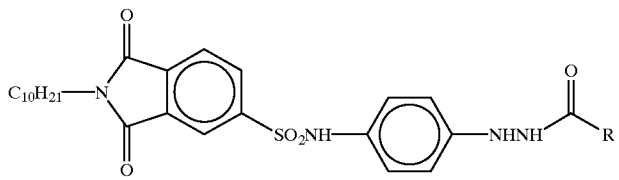 | 25a | 25e | 25k | 25l |
| 26 | 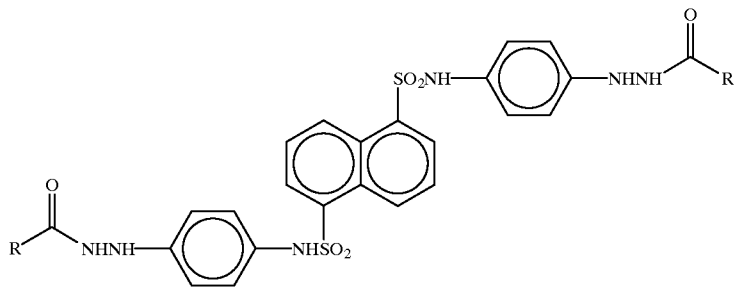 | 26a | 26e | 26k | 26l |

-continued
| | | | | | |
|---|---|---|---|---|---|
| 27 | 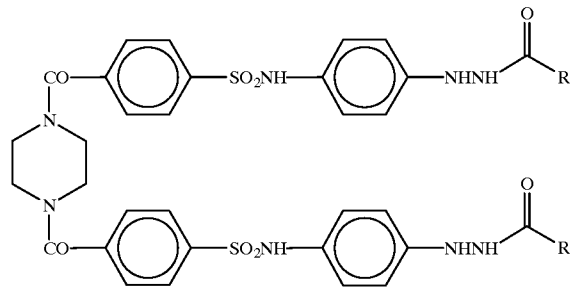 | 27a | 27e | 27k | 27l |
| 28 | 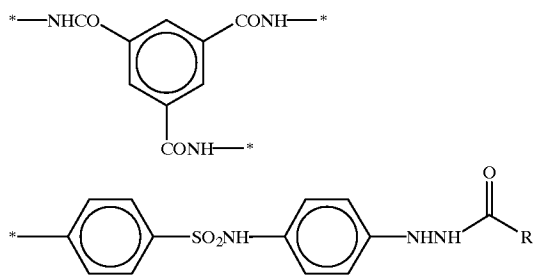 | 28a | 28e | 28k | 28l |
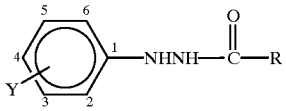
R =
| Y = | —H | —$CH_2OCH_3$ | 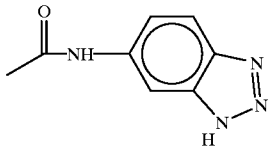 | 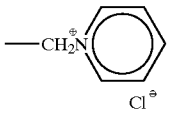 |
|---|---|---|---|---|
| 29 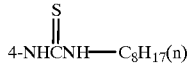 | 29a | 29m | 29n | 29f |

-continued
| | | | | | |
|---|---|---|---|---|---|
| 30 | 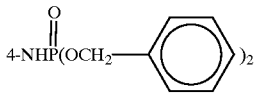 | 30a | 30m | 30n | 30f |
| 31 | 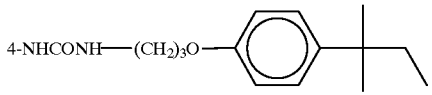 | 31a | 31m | 31n | 31f |
| 32 | 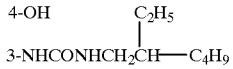 | 32a | 32m | 32n | 32f |
| 33 | 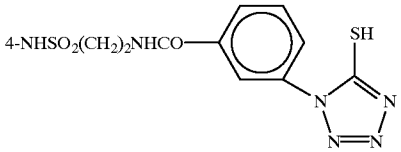 | 33a | 33m | 33n | 33f |
| 34 | 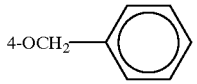 | 34a | 34m | 34n | 34f |
| 35 | 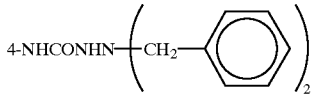 | 35a | 35m | 35n | 35f |
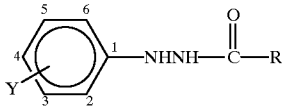
| | R = | | | |
|---|---|---|---|---|
| Y = | —H | —$C_3H_6$—COOH | —$CONHCH_3$ | 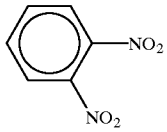 |

-continued
| | | | | | |
|---|---|---|---|---|---|
| 36 | 2-$NHSO_2CH_3$—<br>4-$NHCONH(CH_2)_3S$— 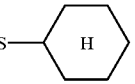 | 36a | 36o | 36p | 36q |
| 37 | 2-$OCH_3$—<br>4-$NHSO_2C_{12}H_{25}$ | 37a | 37o | 37p | 37q |
| 38 | 3-$NHCOC_{11}H_{23}$—<br>4-$NHSO_2CF_3$ | 38a | 38o | 38p | 38q |
| 39 | 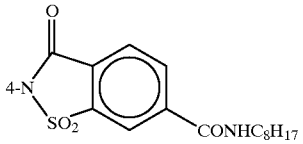 | 39a | 39o | 39p | 39q |
| 40 | 4-$OCO(CH_2)_2COOC_6H_{13}$ | 40a | 40o | 40p | 40q |
| 41 | 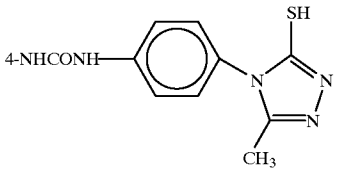 | 41a | 41o | 41p | 41q |
| 42 | 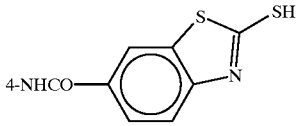 | 42a | 42o | 42p | 42q |
| 43 | 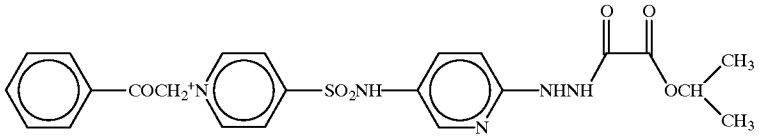 | | | | |

-continued
44
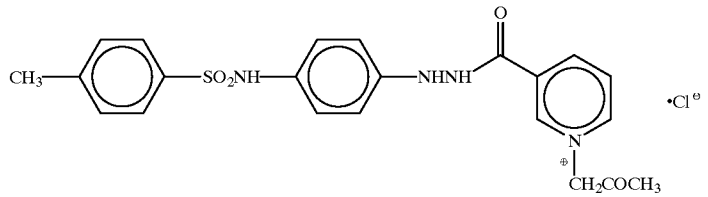
45
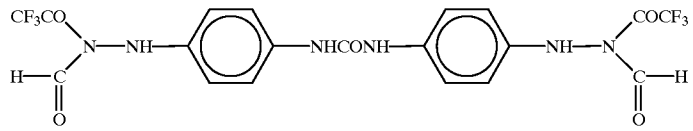
46
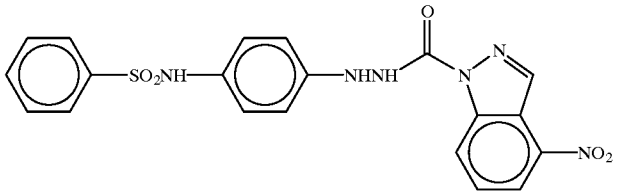
47
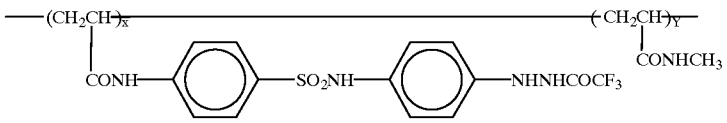
X:Y = 3:97
average of molecular weight'= 100,000
48
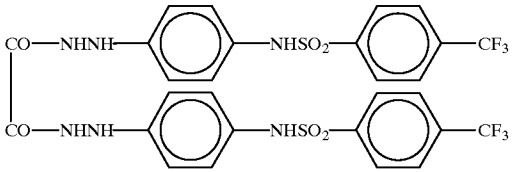

-continued
49
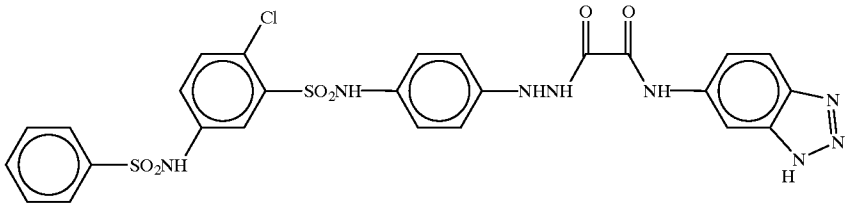
50
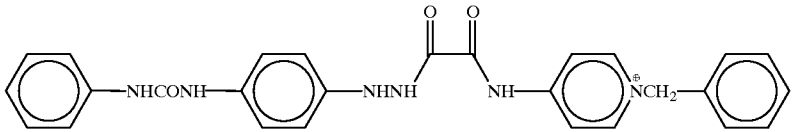
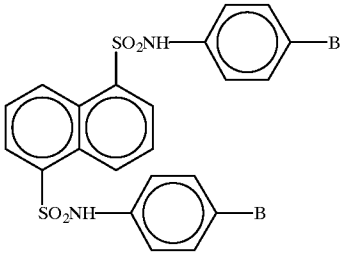
| R = | —H | —$CF_2H$ | —$CONHCH_3$ | —$CF_3$ |
|---|---|---|---|---|
| 51 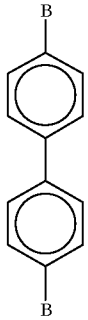 | 51a | 51e | 51p | 51r |

-continued
| | | | | | |
|---|---|---|---|---|---|
| 52 | 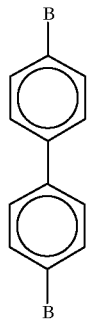 | 52a | 52e | 52p | 52r |
| 53 | 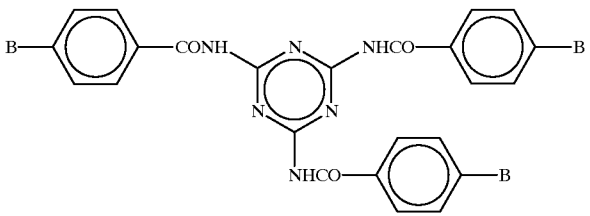 | 53a | 53e | 53p | 53r |
| 54 | 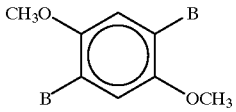 | 54a | 54e | 54p | 54r |
| 55 | 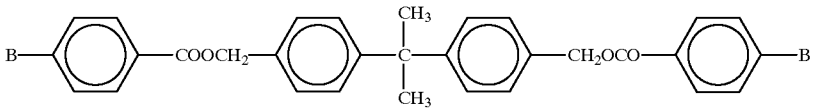 | 55a | 55e | 55p | 55r |
| 56 | 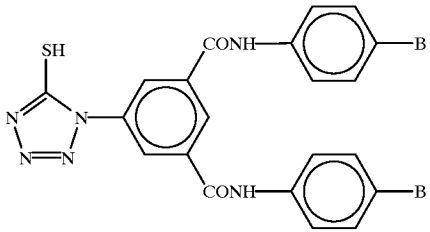 | 56a | 56e | 56p | 56r |

-continued
| | | | | | |
|---|---|---|---|---|---|
| 57 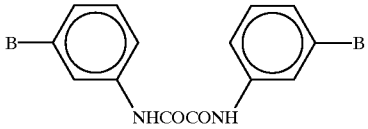 | 57a | 57e | 57p | 57r |
| B′ = 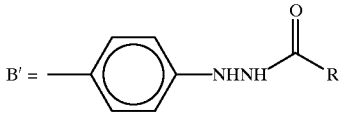 | | | | |
| R = | —H | —$CF_3$ | 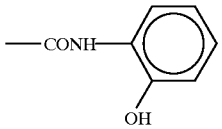 | 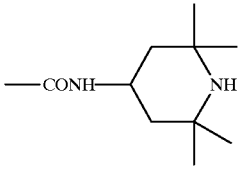 |
| 58 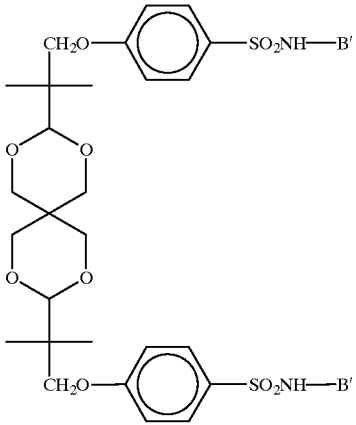 | 58a | 58e | 58s | 58g |
| 59 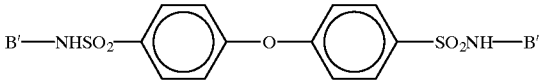 | 59a | 59e | 59s | 59g |

-continued
| | | | | | |
|---|---|---|---|---|---|
| 60 | 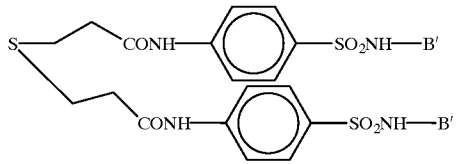 | 60a | 60e | 60s | 60g |
| 61 | 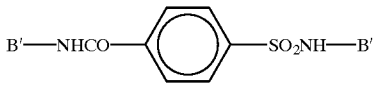 | 61a | 61e | 61s | 61g |
| 62 | 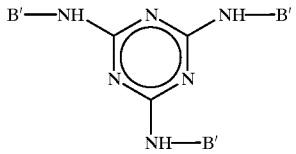 | 62a | 62e | 62s | 62g |
| 63 | 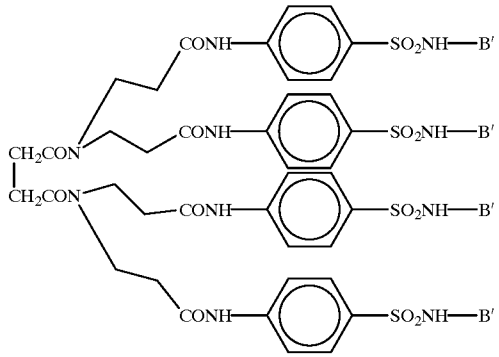 | 63a | 63e | 63s | 63g |
| 64 | 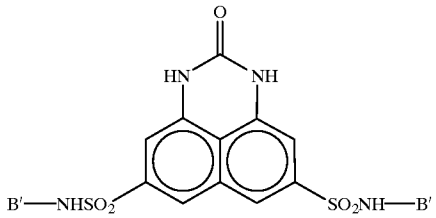 | 64a | 64e | 64s | 64g |

-continued
65
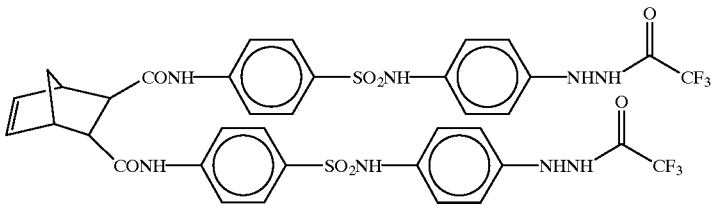
66
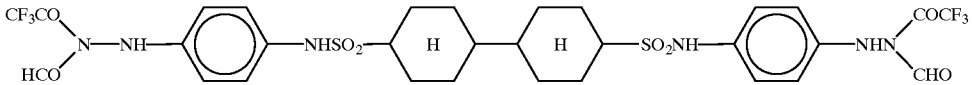
67
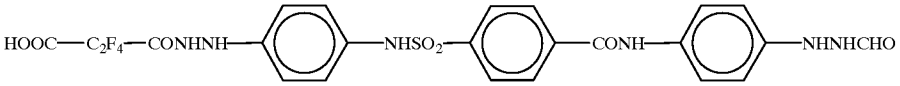
68
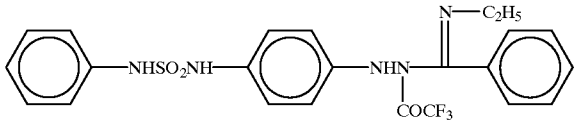
69
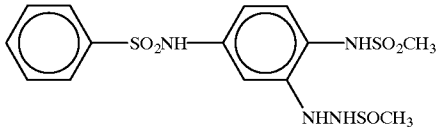

-continued
70
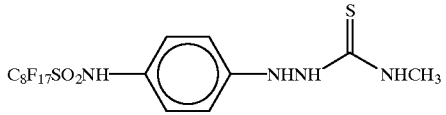
71
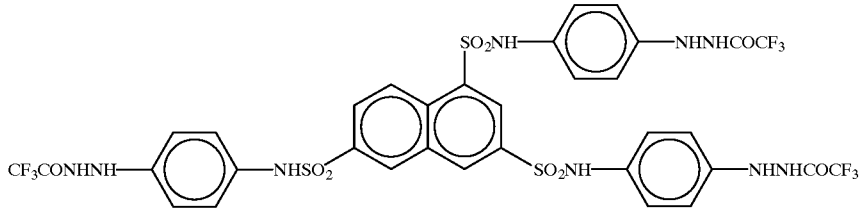
72
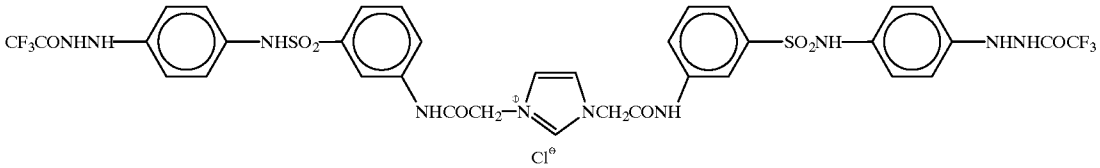

As the hydrazine derivatives for use in the present invention, in addition to the above, the following hydrazine derivatives can also preferably be used. The hydrazine derivatives for use in the present invention can be synthesized by various methods described in the following patents: compounds represented by (Chemical formula 1) described in JP-B-6-77138; specifically, compounds described on pages 3 and 4 of the publication; compounds represented by formula (I) described in JP-B-6-93082; specifically, Compounds 1 to 38 described on pages 8 to 18 of the publication; compounds represented by formulae (4), (5), and (6) described in JP-A-6-230497; specifically, Compound 4-1 to Compound 4-10 described on pages 25 and 26, Compound 5-1 to Compound 5-42 described on pages 28 to 36, and Compound 6-1 to Compound 6-7 described on pages 39 and 40 of the publication, respectively; compounds represented by formulae (1) and (2) described in JP-A-6-28952; specifically, Compounds 1-1) to 1-17) and 2-1) described on pages 5 to 7 of the publication; compounds represented by (Chemical formula 2) and (Chemical formula 3) described in JP-A-6-313936; specifically, compounds described on pages 6 to 19 of the publication; compounds represented by (Chemical formula 1) described in JP-A-6-313951; specifically, compounds described on pages 3 to 5 of the publication; compounds represented by formula (I) described in JP-A-7-5610; specifically, Compounds I-1 to I-38 described on pages 5 to 10 of the publication; compounds represented by formula (II) described in JP-A-7-77783; specifically, Compounds II-1 to II-102 described on pages 10 to 27 of the publication; compounds represented by formulae (H) and (Ha) described in JP-A-7-104426; specifically, Compounds H-1 to H-44 described on pages 8 to 15 of the publication; compounds that have an anionic group in the vicinity of the hydrazine group or a nonionic group for forming an intramolecular hydrogen bond with the hydrogen atom of the hydrazine; and especially, compounds represented by formulae (A), (B), (C), (D), (E), and (F), described in Japanese Patent Application No. 7-191007; specifically, Compounds N-1 to N-30 described in the specification thereof; and compounds represented by formula (1) described in Japanese patent application No. 7-191007; specifically, Compounds D-1 to D-55 described in the specification thereof.

The hydrazine-series nucleating agent for use in the present invention may be dissolved in an appropriate water-miscible organic solvent, such as an alcohol (e.g. methanol, ethanol, propanol, fluorinated alcohol), a ketone (e.g. acetone, methyl ethyl ketone), dimethylformamide, dimethylsulfoxide, or methyl cellosolve, before use.

Also, the hydrazine-series nucleating agent for use in the present invention may be dissolved using an oil, such as dibutyl phthalate, tricresyl phosphate, glyceryl triacetate, or diethyl phthalate; or using or an auxiliary solvent, such as ethyl acetate or cyclohexanone, by a conventionally well-known emulsion dispersion method, and mechanically processed into an emulsion dispersion before use. Alternatively, the hydrazine derivative powder may be dispersed in water by means of a ball mill, a colloid mill, or ultrasonic waves, according to a method known as a solid dispersion method, and used.

The hydrazine nucleating agent for use in the present invention may be added to a silver halide emulsion layer or to any of other hydrophilic colloid layers on the silver halide emulsion layer side of a support, but it is preferably added to the above-described silver halide emulsion layer or to a hydrophilic colloid layer adjacent thereto.

The addition amount of the nucleating agent for use in the present invention is preferably from $1\times10^{-6}$ to $1\times10^{-2}$ mol, more preferably from $1\times10^{-5}$ to $5\times10^{-3}$ mol, and most preferably from $2\times10^{-5}$ to $5\times10^{-3}$ mol, per mol of silver halide.

Examples of the nucleation accelerator (nucleating accelerator) for use in the present invention include an amine derivative, an onium salt, a disulfide derivative, and a hydroxymethyl derivative. Specific examples thereof are described below: compounds described in JP-A-7-77783, page 48, lines 2 to 37; specifically, Compounds A-1) to A-73) described on pages 49 to 58; compounds represented by (Chemical formula 21), (Chemical formula 22), and (Chemical formula 23) described in JP-A-7-84331; specifically, compounds described on pages 6 to 8 of the publication; compounds represented by formulae [Na] and [Nb] described in JP-A-7-104426; specifically, Compounds Na-1 to Na-22 and Compounds Nb-1 to Nb-12 described on pages 16 to 20 of the publication.

The nucleation accelerator for use in the present invention is most preferably an onium salt compound represented by formula (A-1), (A-2), (A-3), or (A-4). These are described in detail below.

Formula (A-1) is first described.

formula (A-1)

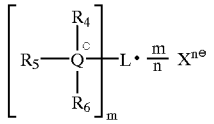

In the formula, $R_4$, $R_5$, and $R_6$ each represent an alkyl group, a cycloalkyl group, an aralkyl group, an aryl group, an alkenyl group, a cycloalkenyl group, an alkynyl group or a heterocyclic group, and these groups may each further have a substituent. Q represents a phosphorus atom or a nitrogen atom.

L represents an m-valent organic group bonded to $Q^+$ through its carbon atom, and m represents an integer of from 1 to 4. $X^{n-}$ represents an n-valent counter anion, and n represents an integer of from 1 to 3; with the proviso that, when $R_4$, $R_5$, $R_6$, or L has an anion group on the substituent thereof and forms an inner salt with $Q^+$, $X^{n-}$ can be omitted.

Examples of the group represented by $R_4$, $R_5$, or $R_6$ include a linear or branched alkyl group, such as methyl, ethyl, propyl, isopropyl, butyl, isobutyl, sec-butyl, tert-butyl, octyl, 2-ethylhexyl, dodecyl, hexadecyl, and octadecyl; an aralkyl group, such as a substituted or unsubstituted benzyl; a cycloalkyl group, such as cyclopropyl, cyclopentyl, and cyclohexyl; an aryl group, such as phenyl, naphthyl, and phenanthryl; an alkenyl group, such as allyl, vinyl, and 5-hexenyl; a cycloalkenyl group, such as cyclopentenyl and cyclohexenyl; an alkynyl group, such as phenylethynyl; and a heterocyclic group, such as pyridyl, quinolyl, furyl, imidazolyl, thiazolyl, thiadiazolyl, benzotriazolyl, benzothiazolyl, morpholyl, pyrimidyl, and pyrrolidyl.

Examples of the substituent substituted on these groups include, in addition to the groups represented by $R_4$, $R_5$, and $R_6$, a halogen atom, such as fluorine, chlorine, bromine, and iodine; a nitro group, an alkyl- or aryl- amino group, an alkoxy group, an aryloxy group, an alkyl- or aryl- thio group, a carbonamido group, a carbamoyl group, a sulfonamido group, a sulfamoyl group, a hydroxyl group, a sulfoxy group, a sulfonyl group, a carboxyl group (including carboxylate), a sulfonic acid group (including sulfonate), a cyano group, an oxycarbonyl group, and an acyl group.

Examples of the group represented by L, when m represents 1, include those exemplified for $R_4$, $R_5$, and $R_6$, as well as when m represents an integer of 2 or greater, examples include a polymethylene group, such as trimethylene, tetramethylene, hexamethylene, pentamethylene, octamethylene, and dodecamethylene; an arylene group, such as phenylene, biphenylene, and naphthylene; a polyvalent alkylene group, such as trimethylenemethyl and tetramethylenemethyl, and a polyvalent arylene group, such as phenylene-1,3,5-toluyl and phenylene-1,2,4,5-tetrayl.

Examples of the counter anion represented by $X^{n-}$ include a halogen ion, such as chlorine ion, bromine ion, and iodine ion; a carboxylate ion, such as acetate ion, oxalate ion, fumarate ion, and benzoate ion; a sulfonate ion, such as p-toluenesulfonate, methanesulfonate, butanesulfonate, and benzenesulfonate; a sulfate ion, a perchlorate ion, a carbonate ion, and a nitrate ion.

In formula (A-1), $R_4$, $R_5$, and $R_6$ are each preferably a group having 20 or less carbon atoms, especially preferably an aryl group having 15 or less carbon atoms—when Q represents a phosphorus atom—and especially preferably an alkyl, aralkyl, or aryl group having 15 or less carbon atoms—when Q represents a nitrogen atom. m is preferably 1 or 2. When m represents 1, L is preferably a group having 20 or less carbon atoms, especially preferably an alkyl, aralkyl, or aryl group having a total carbon atom number of 15 or less. When m represents 2, the divalent organic group represented by L is preferably an alkylene group, an arylene group, an aralkylene group, or a divalent group formed of a combination of one of these groups with a —CO—, —O—, —N(NR')— (wherein NR' represents a hydrogen atom or the group described for $R_4$, $R_5$, and $R_6$, and when a plurality of NR' groups are present within the molecule, they are the same or different or may be bonded to each other), —S—, —SO—, or —$SO_2$— group. When m represents 2, L is preferably a divalent group bonding to $Q^+$ through the carbon atom thereof and having a total carbon atom number of 20 or less. When m represents an integer of 2 or greater, plural $R_4$, $R_5$, or $R_6$ groups are present within the molecule, and the plural $R_4$, $R_5$, or $R_6$ groups may be the same or different.

The counter anion represented by $X^{n-}$ is preferably a halogen ion, a carboxylate ion, a sulfonate ion, or a sulfate ion, and n is preferably 1 or 2.

Many of the compounds represented by formula (A-1) for use in the present invention are known and commercially available as reagents. Examples of the general synthesis method include the following: when Q is a phosphorus atom, a method of reacting a phosphinic acid with an alkylating agent, such as an alkyl halide or a sulfonic acid ester, and a method of exchanging the counter anion of a phosphonium salt by a usual method; and when Q is a nitrogen atom, a method of reacting a primary, secondary, or tertiary amino compound with an alkylating agent, such as an alkyl halide or a sulfonic acid ester.

Specific examples of the compound represented by formula (A-1) are set forth below, but the present invention is by no means limited to the following compounds.

A-1

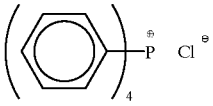

A-2

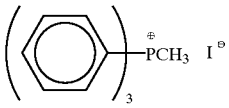

A-3

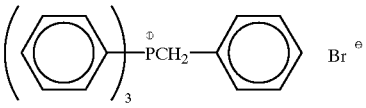

A-4

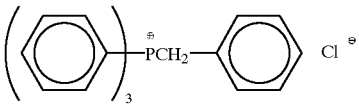

A-5

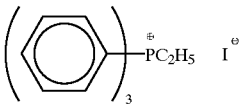

A-6

$(n\text{-}C_4H_9)_4\ P^{\oplus}\ Br^{\ominus}$

A-7

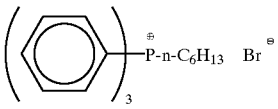

-continued
A-8
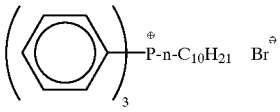
A-9
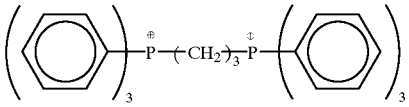
A-10
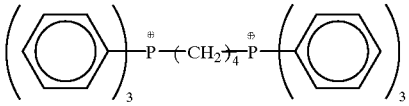
A-11
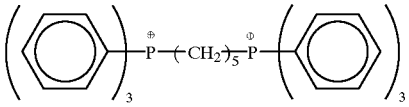
A-12
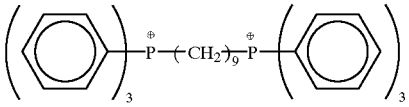
A-13
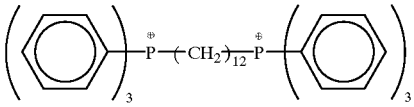
A-14
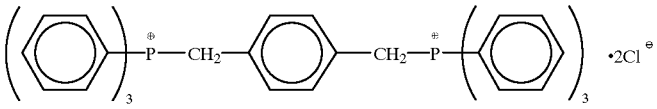
A-15
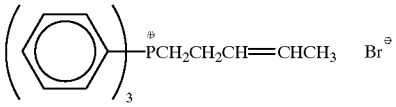
A-16
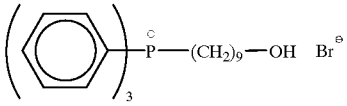
A-17
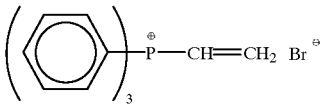
A-18
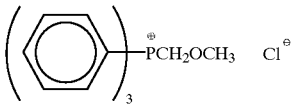
A-19
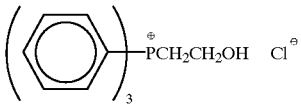

-continued
A-20
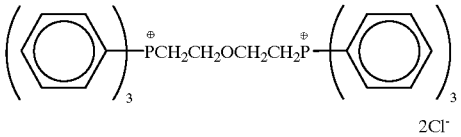
A-21
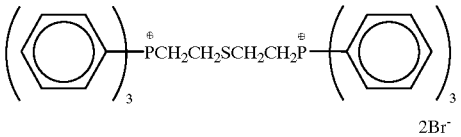
A-22
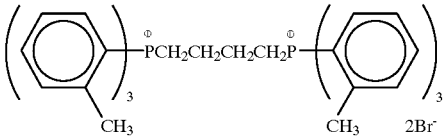
A-23
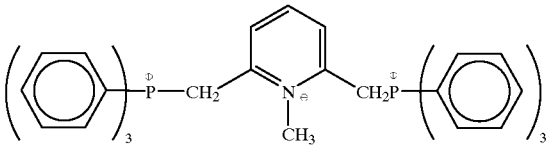
A-24
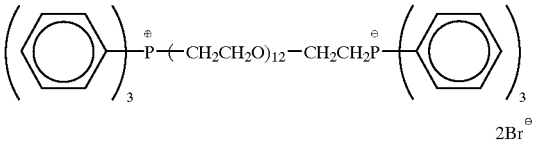
A-25
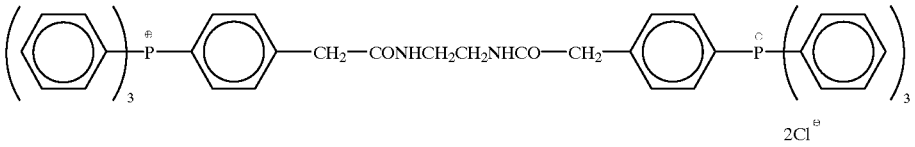
A-26
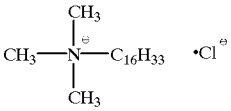
A-27
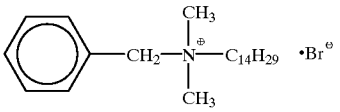
A-28
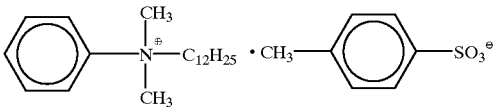
A-29
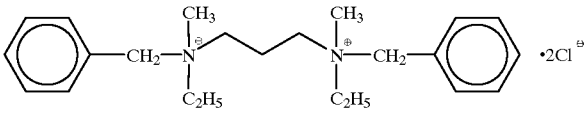

-continued
A-30
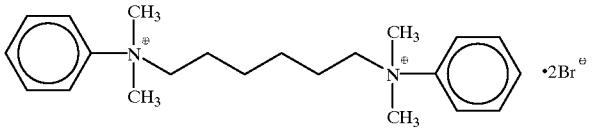
A-31
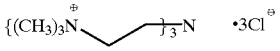
A-32
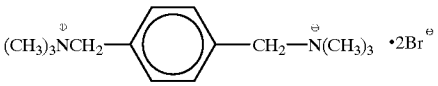
A-33
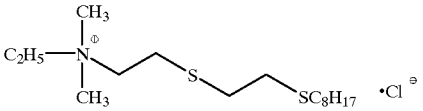
A-34
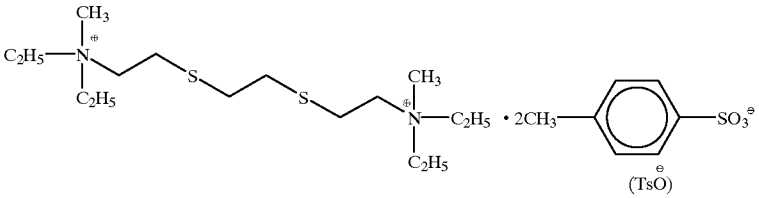
A-35
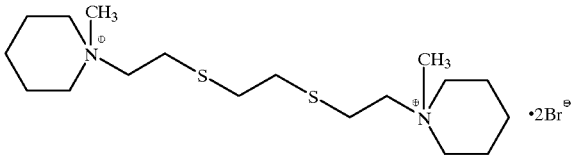
A-36
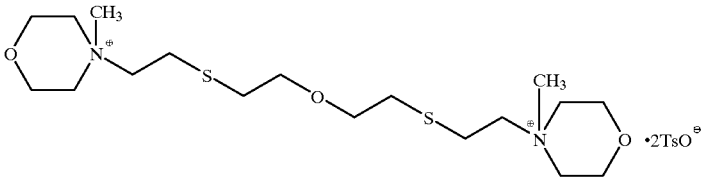
A-37
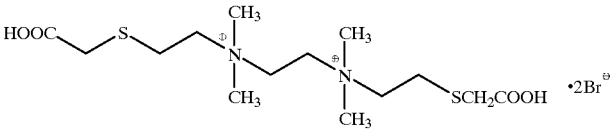
A-38
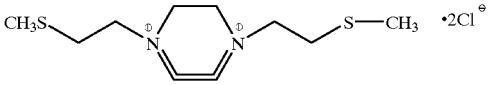
A-39
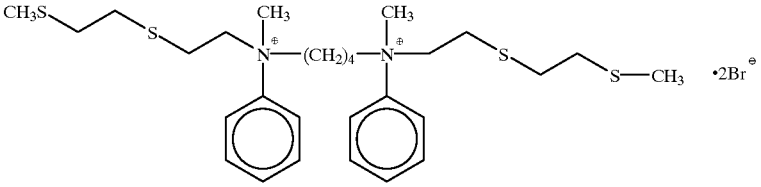

-continued

A-40

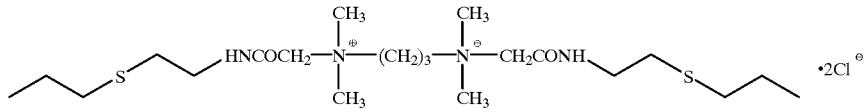

A-41

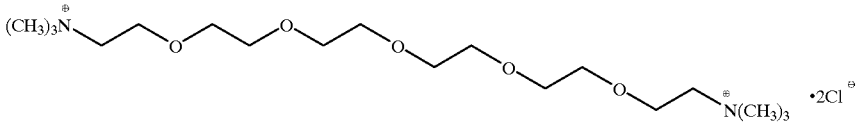

A-42

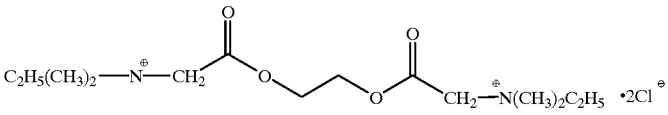

Next, formulae (A-2) and (A-3) are described.

formula (A-2)

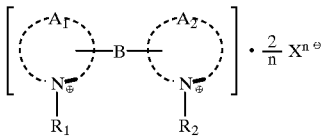

formula (A-3)

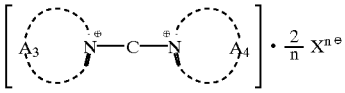

In the formulae, $A_1$, $A_2$, $A_3$, and $A_4$ each represent an organic residue for completing a substituted or unsubstituted unsaturated heterocycle containing the quaternized nitrogen atom, and the heterocycle may contain a carbon atom, a hydrogen atom, an oxygen atom, a nitrogen atom, or a sulfur atom, or it may be condensed with a benzene ring. Examples of the unsaturated heterocycle formed by $A_1$, $A_2$, $A_3$, or $A_4$ include a pyridine ring, a quinoline ring, an isoquinoline ring, an imidazole ring, a thiazole ring, a thiadiazole ring, a benzotriazole ring, a benzothiazole ring, a pyrimidine ring, and a pyrazole ring, with a pyridine ring, a quinoline ring, and an isoquinoline ring being particularly preferred.

The divalent group represented by B or C is preferably a group formed of alkylene, arylene, alkenylene, alkynylene, —$SO_2$—, —SO—, —O—, —S—, —N(RN)— (wherein RN represents an alkyl group, an aralkyl group, an aryl group or a hydrogen atom), —C(=O)—, or —P(=O)—, individually or in combination, especially preferably a group formed of alkylene, arylene, —C(=O)—, —O—, —S— and —N(RN)—, individually or in combination.

$R_1$ and $R_2$, which may be the same or different, are each preferably an alkyl group having 1 to 20 carbon atoms. The alkyl group may be substituted by a substituent, and examples of the substituent include a halogen atom (e.g. chlorine and bromine), a substituted or unsubstituted alkyl group (e.g. methyl and hydroxyethyl), a substituted or unsubstituted aryl group (e.g. phenyl, tolyl, and p-chlorophenyl), a substituted or unsubstituted acyl group (e.g. benzoyl, p-bromobenzoyl, and acetyl), an alkyloxycarbonyl group, an aryloxycarbonyl group, a sulfo group (including sulfonate), a carboxy group (including carboxylate), a mercapto group, a hydroxy group, an alkoxy group (e.g. methoxy and ethoxy), an aryloxy group, a carbonamido group, a sulfonamido group, a sulfamoyl group, a carbamoyl group, a ureido group, a thioureido group, an alkylamino group, an arylamino group, a cyano group, a nitro group, an alkylthio group, and an arylthio group.

$R_1$ and $R_2$ are each especially preferably an alkyl group having from 1 to 10 carbon atoms. Examples of preferred substituents include a carbamoyl group, an oxycarbonyl group, an acyl group, an aryl group, a sulfo group (including sulfonate), a carboxy group (including carboxylate), and a hydroxyl group.

The unsaturated heterocycle formed by $A_1$, $A_2$, $A_3$, or $A_4$, together with the quaternized nitrogen atom, may have a substituent, and examples of the substituent include the substituents described above as the substituent of the alkyl group represented by $R_1$ or $R_2$. Examples of preferred substituents include an aryl group, an alkyl group, a carbamoyl group, an alkylamino group, an arylamino group, an oxycarbonyl group, an alkoxy group, an aryloxy group, an alkylthio group, an arylthio group, a hydroxyl group, a carbonamido group, a sulfonamido group, a sulfo group (including sulfonate), and a carboxy group (including carboxylate), each having from 0 to 10 carbon atoms.

The counter anion represented by $X^{n-}$ is the same as that in formula (A-1), and the preferred range is also the same.

The compounds for use in the present invention can be easily synthesized by generally well-known methods. For example, they can be synthesized according to the method described in *Ouart. Rev.,* 16, 163 (1962).

Specific examples of the compound represented by formula (A-2) or (A-3) are set forth below, but the present invention is by no means limited thereto.

B-1
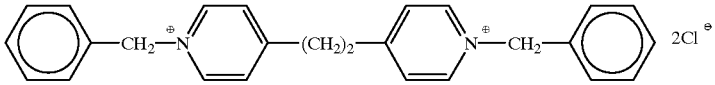
B-2
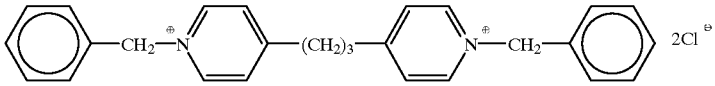
B-3
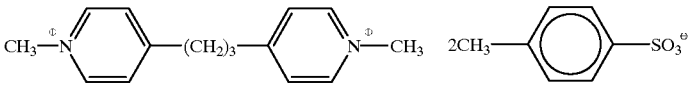
B-4
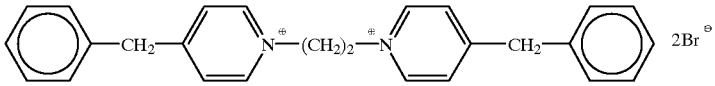
B-5
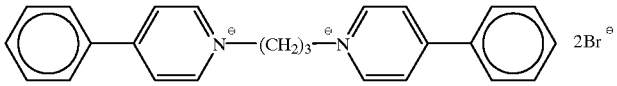
B-6
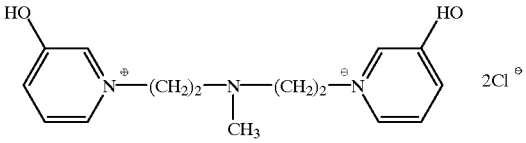
B-7
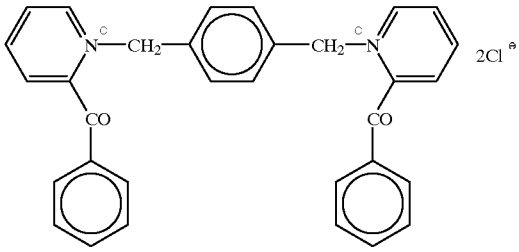
B-8
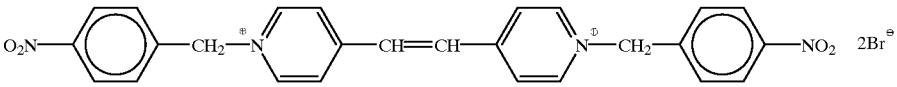
B-9
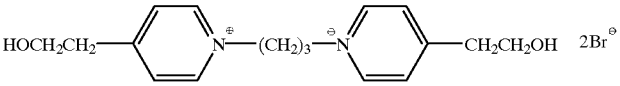
B-10
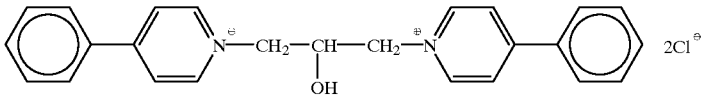
B-11
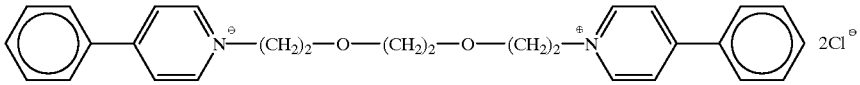
B-12
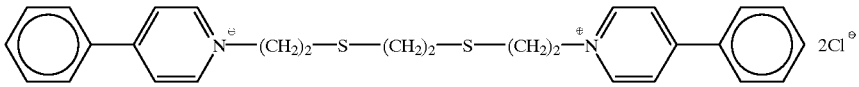

-continued
B-13
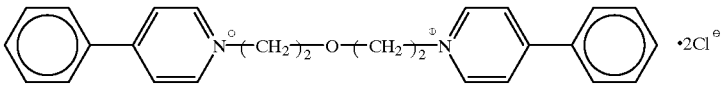
B-14
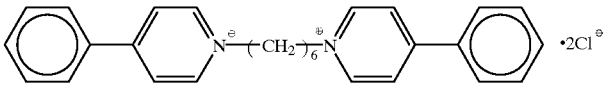
B-15
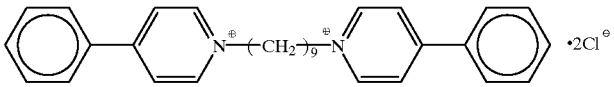
B-16
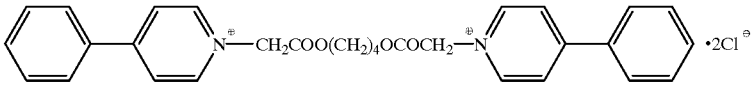
B-17
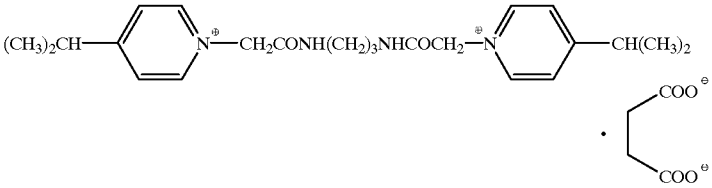
B-18
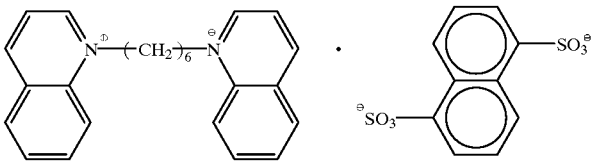
B-19
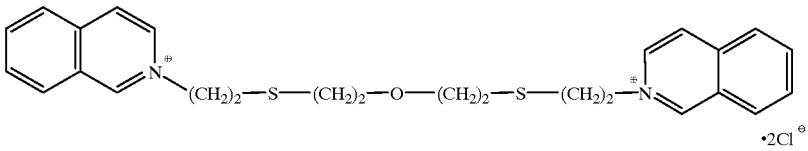
B-20
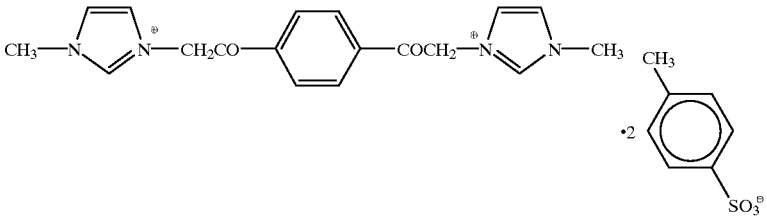
B-21
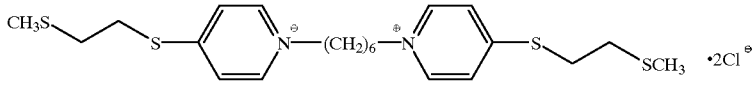
B-22
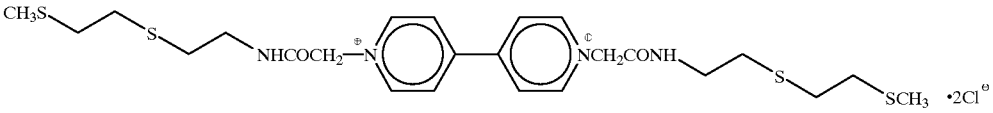

-continued

B-23

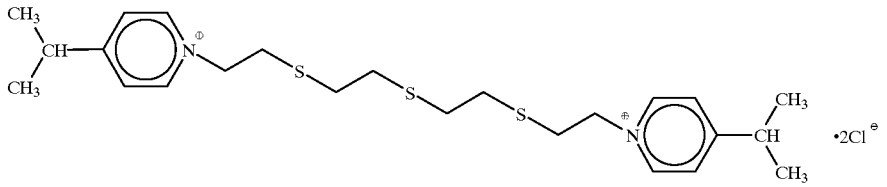

B-24

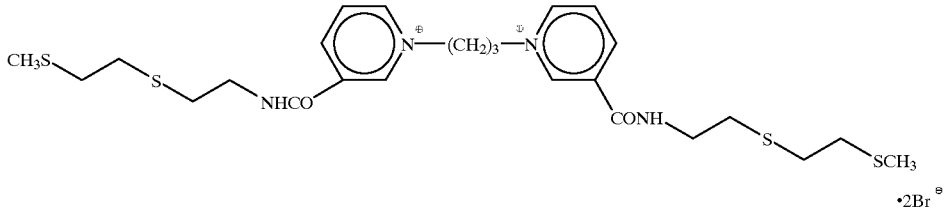

B-25

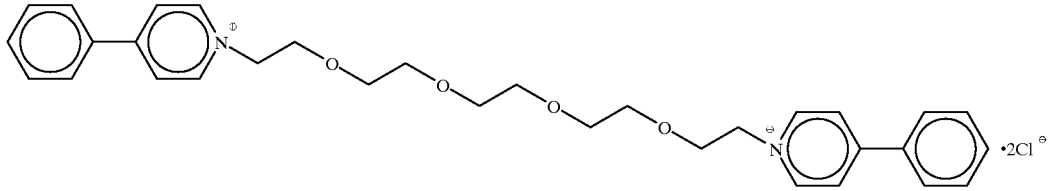

B-26

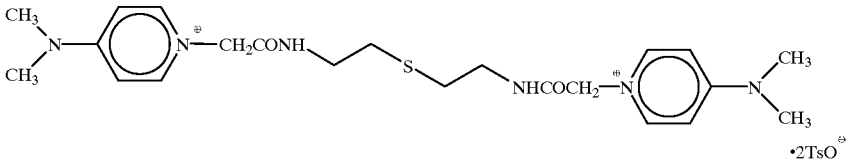

B-27

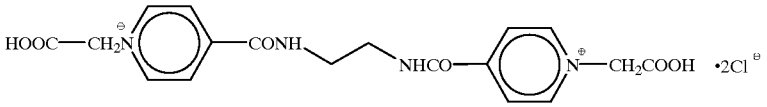

B-28

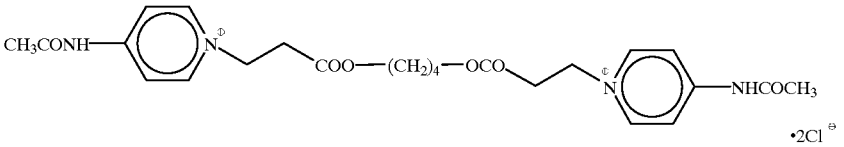

Next, formula (A-4) is described.

formula (A-4)

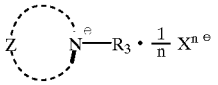

The nitrogen-containing unsaturated heterocycle containing Z may contain, in addition to the nitrogen atom, a carbon atom, a hydrogen atom, an oxygen atom, or a sulfur atom; further, the heterocycle may be condensed with a benzene ring, or it may have a substituent. Examples of the heterocycle formed include those described above as the nitrogen-containing unsaturated heterocycle formed by $A_1$, $A_2$, $A_3$, or $A_4$ in formula (A-2) or (A-3). The preferred range is also the same, and a pyridine ring, a quinoline ring, and an isoquinoline ring are preferred.

When the nitrogen-containing unsaturated heterocycle containing Z has a substituent, examples of the substituent include those described above as the substituent of the nitrogen-containing unsaturated heterocycle formed by $A_1$, $A_2$, $A_3$, or $A_4$ in formula (A-2) or (A-3), and the preferred range is also the same.

$R_3$ represents an alkyl group or an aralkyl group, and the alkyl or aralkyl group may be a substituted or unsubstituted, linear, branched, or cyclic alkyl or aralkyl group having from 1 to 20 carbon atoms. Examples of the substituent include the same as those described above as the substituent of the alkyl group represented by $R_1$ or $R_2$ in formula (A-2), and the preferred range is also the same.

The counter anion represented by $X^{n-}$ is the same as that in formula (A-1), and the preferred range is also the same.

The compound represented by formula (A-4) for use in the present invention can be easily synthesized by generally well-known methods, for example, *Ouart. Rev.,* 16, 163 (1962) may be referred to.

Specific examples of the compound represented by formula (A-4) for use in the present invention are set forth below, but the present invention is by no means limited thereto.

C-1

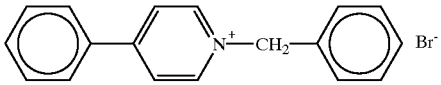

C-2

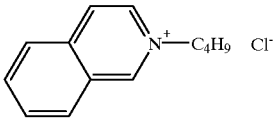

C-3

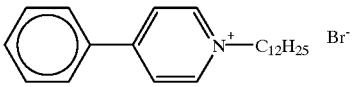

C-4

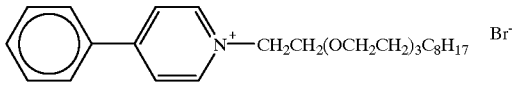

C-5

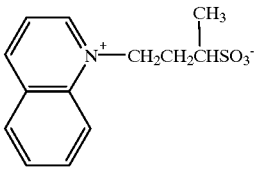

C-6

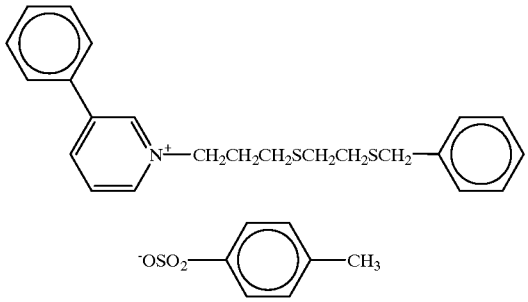

C-7

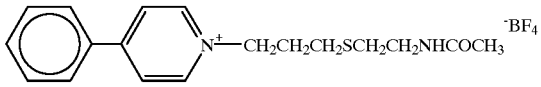

C-8

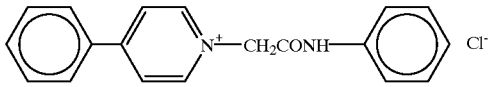

C-9

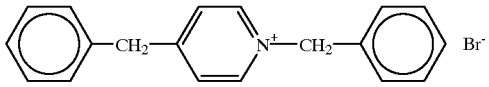

-continued

C-10

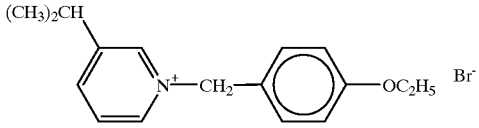

C-11

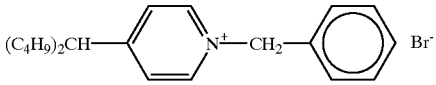

C-12

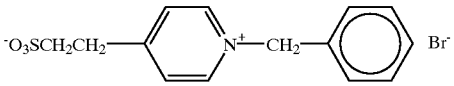

C-13

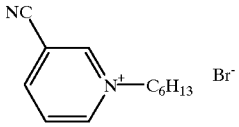

C-14

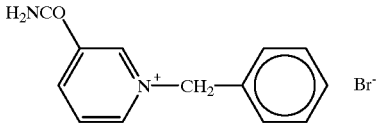

Further, amino compounds are also preferably used as a nucleation accelerator. Specific examples of the amino compounds that are preferably used include the following: Compounds represented by (Chemical formula 21), (Chemical formula 22), and (Chemical formula 23) described in JP-A-7-84331; specifically, compounds described on pages 6 to 8 of the publication; compounds represented by formula [Na] described in JP-A-7-104426; specifically, Compounds Na-1 to Na-22 described on pages 16 to 20 of the publication; compounds represented by formulae (1), (2), (3), (4), (5), (6), and (7) described in Japanese Patent Application No. 37817/1995; specifically, Compounds 1-1 to 1-19, Compounds 2-1 to 2-22, Compounds 3-1 to 3-36, Compounds 4-1 to 4-5, Compounds 5-1 to 5-41, Compounds 6-1 to 6-58, and Compounds 7-1 to 7-38 described in the specification thereof.

The nucleation accelerator for use in the present invention may be dissolved in an appropriate water-miscible organic solvent before use, and examples of the solvent include alcohols (e.g. methanol, ethanol, propanol, fluorinated alcohols), ketones (e.g. acetone and methyl ethyl ketone), dimethylformamide, dimethylsulfoxide, and methyl cellosolve.

Alternatively, the nucleation accelerator may be used as an emulsion dispersion obtained by dissolving the compound according to an already well-known emulsion dispersion method, using an oil, such as dibutyl phthalate, tricresyl phosphate, glyceryl triacetate, or diethyl phthalate, or using an auxiliary solvent, such as ethyl acetate or cyclohexanone, and mechanically forming it into an emulsion dispersion. Further, powder of a nucleation accelerator may be used by dispersing it in water, according to a method known as a solid dispersion method, using a ball mill, a colloid mill, or ultrasonic waves.

The nucleation accelerator for use in the present invention may be added to any of silver halide emulsion layers and other hydrophilic colloid layers on the silver halide emulsion layer side of the support, but it is preferably added to the silver halide emulsion layer or a hydrophilic colloid layer adjacent thereto.

The nucleation accelerator for use in the present invention is preferably added in an amount of from $1\times10^{-6}$ to $2\times10^{-2}$ mol, more preferably from $1\times10^{-5}$ to $2\times10^{-2}$ mol, and most preferably from $2\times10^{-5}$ to $1\times10^{-2}$ mol, per mol of silver halide.

In the present invention, the layer containing a nitrogen-containing heterocyclic compound, a nucleating agent, or a nucleation accelerator may be the same layer or different respective layers. Further, the layer containing at least one of these compounds may be a plurality of layers, unless otherwise specified.

The processing agents, such as the developer and the fixing solution, and the processing method for use in the present invention are described below, but the invention is by no means limited to the following description and specific examples.

The development for use in the present invention may be performed by any known method, and a known development processing solution may be used.

The developing agent for use in the developer (the development-initiating solution and the development replenisher are collectively called a developer, hereinafter the same) used in the present invention is not particularly restricted, but it preferably contains a dihydroxybenzene compound, or a hydroquinone monosulfonate, individually or in combination. In view of the developing capability, a combination of a dihydroxybenzene compound with a 1-phenyl-3-pyrazolidone compound, and a combination of a dihydroxybenzene compound with a p-aminophenol compound, are preferred.

Examples of the dihydroxybenzene developing agent for use in the present invention include hydroquinone, chlorohydroquinone, isopropylhydroquinone, and methylhydroquinone, with hydroquinone being particularly preferred.

Examples of the 1-phenyl-3-pyrazolidones or derivatives thereof as the developing agent for use in the present invention include 1-phenyl-3-pyrazolidone, 1-phenyl-4,4-dimethyl-3-pyrazolidone, and 1-phenyl-4-methyl-4-hydroxymethyl-3-pyrazolidone.

Examples of the p-aminophenol-series developing agent for use in the present invention include N-methyl-p-aminophenol, p-aminophenol, N-(β-hydroxyphenyl)-p-aminophenol, N-(4-hydroxyphenyl)glycine, o-methoxy-p-(N,N-dimethylamino)phenol, and o-methoxy-p-(N-methylamino)phenol, with N-methyl-p-aminophenol and aminophenols, described in Japanese Patent Application Nos. 8-70908 and 8-70935, being preferred.

The dihydroxybenzene-series developing agent is preferably used in an amount of generally from 0.05 to 0.8 mol/L. When a dihydroxybenzene compound and a 1-phenyl-3-pyrazolidone compound or a p-aminophenol compound are used in combination, the former is preferably used in an amount of from 0.05 to 0.6 mol/L, more preferably from 0.23 to 0.5 mol/L, and the latter is preferably used in an amount of 0.06 mol/L or less, more preferably from 0.003 to 0.03 mol/L.

The developer used in processing the light-sensitive material of the present invention may contain additives (e.g. a developing agent, an alkali agent, a pH buffer, a preservative, a chelating agent) that are commonly used. Specific examples thereof are described below, but the present invention is by no means limited thereto.

Examples of the buffer for use in the developer used in development-processing the light-sensitive material of the present invention include carbonates, boric acids described in JP-A-62-186259, saccharides (e.g. saccharose) described in JP-A-60-93433, oximes (e.g. acetoxime), phenols (e.g. 5-sulfosalicylic acid), and tertiary phosphates (e.g. sodium salt and potassium salt), with carbonates and boric acids being preferred. The buffer, particularly the carbonate, is preferably used in an amount of 0.1 mol/L or more, particularly preferably from 0.2 to 1.5 mol/L.

Examples of the preservative for use in the present invention include sodium sulfite, potassium sulfite, lithium sulfite, ammonium sulfite, sodium bisulfite, sodium methabisulfite, and formaldehyde-sodium bisulfite. The sulfite is used in an amount of generally 0.2 mol/L or more, preferably 0.3 mol/L or more, but if it is added too excessively, silver staining in the developer is caused. Accordingly, the upper limit is preferably 1.2 mol/L. The amount is particularly preferably from 0.35 to 0.7 mol/L.

Examples of additives to be used other than those described above include a development inhibitor, such as sodium bromide and potassium bromide, an organic solvent, such as ethylene glycol, diethylene glycol, triethylene glycol, and dimethylformamide; a development accelerator, such as an alkanolamine including diethanolamine and triethanolamine, and an imidazole and derivatives thereof; and a physical development unevenness inhibitor, such as a heterocyclic mercapto compound (e.g. sodium 3-(5-mercaptotetrazol-1-yl)benzene sulfonate, 1-phenyl-5-mercaptotetrazole) and the compounds described in JP-A-62-212651.

Further, a mercapto-series compound, an indazole-series compound, a benzotriazole-series compound, or a benzimidazole-series compound may be added, as an antifoggant or a black spot (black pepper) inhibitor. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-((2-mercapto-1,3,4-thiadiazol-2-yl)thio)butanesulfonate, 5-amino-1,3,4-thiadiazole-2-thiol, methylbenzotriazole, 5-methylbenzotriazole, and 2-mercaptobenzotriazole. The addition amount thereof is generally from 0.01 to 10 mmol, preferably from 0.1 to 2 mmol, per liter of the developer.

Further, various kinds of organic or inorganic chelating agents can be used individually or in combination in the developer for use in the present invention.

Examples of the inorganic chelating agent include sodium tetrapolyphosphate and sodium hexametaphosphate.

Examples of the organic chelating agent include organic carboxylic acid, aminopolycarboxylic acid, organic phosphonic acid, aminophosphonic acid, and organic phosphonocarboxylic acid.

Examples of the organic carboxylic acid include acrylic acid, oxalic acid, malonic acid, succinic acid, glutaric acid, gluconic acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid, and tartaric acid.

Examples of the aminopolycarboxylic acid include iminodiacetic acid, nitrilotriacetic acid, nitrilotripropionic acid, ethylenediaminemonohydroxyethyltriacetic acid, ethylenediaminetetraacetic acid, glycolethertetraacetic acid, 1,2-diaminopropanetetraacetic acid, diethylenetriaminepentaacetic acid, triethylenetetraminehexaacetic acid, 1,3-diamino-2-propanoltetraacetic acid, glycoletherdiaminetetraacetic acid, and compounds described in JP-A-52-25632, JP-A-

55-67747, JP-A-57-102624 and JP-B-53-40900.

Examples of the organic phosphonic acid include hydroxyalkylidene-diphosphonic acid, described in U.S. Pat. Nos. 3,214,454 and 3,794,591 and West German Patent Publication (OLS) No. 2,227,369, and the compounds described in *Research Disclosure,* Vol. 181, Item 18170 (May 1979).

Examples of the aminophosphonic acid include aminotris(methylenephosphonic acid), ethylenediamine tetramethylenephosphonic acid, aminotrimethylenephosphonic acid, and the compounds described in *Research Disclosure, No.* 18170 (supra), JP-A-57-208554, JP-A-54-61125, JP-A-55-29883, and JP-A-56-97347.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956, and *Research Disclosure,* No. 18170 (supra).

The organic and/or inorganic chelating agents are not limited to those described above. The organic and/or inorganic chelating agents may be used in the form of an alkali metal salt or an ammonium salt. The amount of the chelating agent added is preferably from $1\times10^{-4}$ to $1\times10^{-1}$ mol, more preferably from $1\times10^{-3}$ to $1\times10^{-2}$ mol, per liter of the developer.

Examples of the silver stain inhibitor added to the developer include the compounds described in JP-A-56-24347, JP-B-56-46585, JP-B-62-2849, JP-A-4-362942, and JP-A-8-6215; triazines having one or more mercapto groups (for example, the compounds described in JP-B-6-23830, JP-A-3-282457, and JP-A-7-175178); pyrimidines having one or more mercapto groups (e.g. 2-mercaptopyrimidine, 2,6-dimercaptopyrimidine, 2,4-dimercaptopyrimidine, 5,6-diamino-2,4-dimercaptopyrimidine, 2,4,6-trimercaptopyrimidine); pyridines having one or more mercapto groups (e.g. 2-mercaptopyrine, 2,6-dimercaptopyridine, 3,5-dimercaptopyridine, 2,4,6-trimercaptopyridine, compounds described in JP-A-7-248587); pyrazines having one or more mercapto groups (e.g. 2-mercaptopyrazine, 2,6-dimercaptopyrazine, 2,3-dimercaptopyrazine, 2,3,5-trimercaptopyrazine); pyridazines having one or more mercapto groups (e.g. 3-mercaptopyridazine, 3,4-dimercaptopyridazine, 3,5-dimercaptopyridazine, 3,4,6-trimercaptopyridazine); the compounds described in JP-A-7-175177, and polyoxyalkylphosphates described in U.S. Pat. No. 5,457,011. These silver stain inhibitors may be used individually or in combination of two or more of these.

The addition amount thereof is preferably from 0.05 to 10 mmol, more preferably from 0.1 to 5 mmol, per liter of the developer.

The developer may contain the compounds described in JP-A-61-267759, as a dissolution aid. Further, the developer may contain a color toner, a surface-active agent, a defoaming agent, or a hardening agent, if necessary.

The developer preferably has a pH of from 9.0 to 11.0, particularly preferably from 9.5 to 11.0. The alkali agent used for adjusting the pH may be a usual water-soluble inorganic alkali metal salt (e.g. sodium hydroxide, potassium hydroxide, sodium carbonate, potassium carbonate).

With respect to the cation of the developer, potassium ion does not inhibit development but causes small indentations, called a fringe, on the periphery of the blacked portion, as compared with sodium ion. When the developer is stored as a concentrated solution, potassium salt is generally preferred, because of its higher solubility. However, since, in the fixing solution, potassium ion causes fixing inhibition on the same level as caused by silver ion, if the developer has a high potassium ion concentration, the developer is carried over by the light-sensitive material, to disadvantageously increase the potassium ion concentration in the fixing solution. Accordingly, the molar ratio of potassium ion to sodium ion in the developer is preferably between 20:80 and 80:20. The ratio of potassium ion to sodium ion can be freely controlled within the above-described range by a counter cation, such as a pH buffer, a pH-adjusting agent, a preservative, or a chelating agent.

The replenishing amount of the developer replenisher is generally 330 ml or less, preferably from 30 to 330 ml, and most preferably from 120 to 330 ml, per $m^2$ of the light-sensitive material. The developer replenisher may have the same composition and/or concentration as the development initiating solution, or it may have a different composition and/or concentration from the initiating solution.

Examples of the fixing agent in the fixing processing agent for use in the present invention include ammonium thiosulfate, sodium thiosulfate, and ammonium sodium thiosulfate. The amount to be used of the fixing agent may be varied appropriately, but it is generally from about 0.7 to about 3.0 mol/L.

The fixing solution for use in the present invention may contain a water-soluble aluminum salt or a water-soluble chromium salt, which acts as a hardening agent, and of these salts, a water-soluble aluminum salt is preferred. Examples thereof include aluminum chloride, aluminum sulfate, potassium alum, ammonium aluminum sulfate, aluminum nitrate, and aluminum lactate. These are each preferably contained, in terms of an aluminum ion concentration in the use solution, in an amount of from 0.01 to 0.15 mol/L.

When the fixing solution is stored as a concentrated solution or a solid agent, it may be constituted by a plurality of parts, preparing a hardening agent or the like as a separate part, or it may be constituted as a one-part agent containing all components.

The fixing processing agent may contain, if desired, a preservative (e.g. sulfite, bisulfite, metabisulfite; in an amount of generally 0.015 mol/L or more, preferably from 0.02 to 0.3 mol/L), a pH buffer (e.g. acetic acid, sodium acetate, sodium carbonate, sodium hydrogencarbonate, phosphoric acid, succinic acid, adipic acid; in an amount of generally from 0.1 to 1 mol/L, preferably from 0.2 to 0.7 mol/L), or a compound having aluminum-stabilizing ability or hard-water-softening ability (e.g. gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, crysteine, ethylenediaminetetraacetic acid, nitrilotriacetic acid, and a derivative and salt thereof, saccharides, and boric acid; in an amount of generally from 0.001 to 0.5 mol/L, preferably from 0.05 to 0.3 mol/L).

In addition, the fixing processing agent may contain a compound described in JP-A-62-78551, a pH-adjusting agent (e.g. sodium hydroxide, ammonia, sulfuric acid), a surface-active agent, a wetting agent, or a fixing accelerator. Examples of the surface-active agent include anionic surface-active agents, such as sulfated products and sulfonated products; polyethylene-series surface-active agents, and amphoteric surface-active agents described in JP-A-57-6840. A known deforming agent may also be used. Examples of the wetting agent include alkanolamines and alkylene glycols. Examples of the fixing accelerator include alkyl- or aryl-substituted thiosulfonic acids and salts thereof described in JP-A-6-308681; thiourea derivatives described in JP-B-45-35754, JP-B-58-122535, and JP-B-58-122536; alcohols having a triple bond within the molecule; thioether compounds described in U.S. Pat. No. 4,126,459; mercapto compounds described in JP-A-64-4739, JP-A-1-159645, and JP-A-3-101728; thiocyanates and meso-ionic compounds described in JP-A-4-170539.

The fixing solution for use in the present invention has a pH of generally 4.0 or more, preferably from 4.5 to 6.0. The pH of the fixing solution increases due to mingling of the developer upon processing, and in this case, the hardening fixing solution has a pH of generally 6.0 or less, preferably 5.7 or less, and the non-hardening fixing solution has a pH of generally 7.0 or less, preferably 6.7 or less.

The replenishing amount of the fixing solution is generally 5,000 ml or less, preferably 300 ml or less, more preferably from 60 to 200 ml, per 1 $m^2$ of the light-sensitive material. The replenisher may have the same composition and/or concentration as the initiating solution, or it may have a composition and/or a concentration different from the initiating solution.

The fixing solution may be regenerated and reused using a known fixing solution regenerating method, such as electrolytic silver recovery. Examples of the regeneration apparatus include Reclaim R-60, trade name, manufactured by Fuji Hunt KK.

It is also preferred to remove dyes or the like through an adsorption filter, such as activated carbon. The light-sensitive material processed through development and fixing is then subjected to water-washing or stabilization (hereinafter, unless otherwise specified, water-washing includes stabilization, and the solution for use therein is called water or washing water). The water for use in water-washing may be tap water, ion exchanged water, distilled water, or a stabilizing solution. The replenishing amount of the washing water is generally from about 8 to about 17 liter per $m^2$ of the light-sensitive material, but a replenishing amount lower than the above-described range may also be used. In particular, when the replenishing amount is 3 liter or less (including 0, namely, standing water washing), not only can the processing achieve water savings, it can also dispense with piping for installation of an automatic developing machine. When water-washing is performed with a small replenishing amount of water, a rinsing tank of a squeeze roller or a crossover roller, described in JP-A-63-18350 and JP-A-62-287252, is preferably provided. Alternatively, addition of various oxidizing agents (e.g. ozone, hydrogen peroxide, sodium hypochlorite, active halogen, chlorine dioxide, sodium carbonate hydrogen peroxide salt) or filter filtration may be combined, so as to reduce the pollution load, which is a problem incurred in the case of water-washing with a small amount of water, or for preventing water scale.

As the method for reducing the replenishing amount of washing water, a multi-stage countercurrent system (for example, two or three stages) has been known for a long time, and the replenishing amount of washing water is preferably from 50 to 200 ml per $m^2$ of the light-sensitive material. This effect can also be obtained similarly in the case of an independent multi-stage system (a method of not using a countercurrent system but supplying a new solution individually to the multi-stage water-washing tanks).

In the method in the present invention, a means for preventing water scale may be provided in the water-washing step. The water-scale-preventing means is not particularly restricted, and a known means may be used. Examples thereof include a method of adding a fungicide (a so-called water scale inhibitor), a method of passing electricity, a method of irradiating ultraviolet rays, infrared rays, or far infrared rays; a method of applying a magnetic field, a method of treating with ultrasonic waves, a method of applying heat, and a method of evacuating the tank on standing. The water-scale-preventing means may be applied according to the processing of the light-sensitive material; it may be applied at a predetermined interval irrespective of the use state, or it may be applied only in the period of non-processing time, such as nighttime. Further, the washing water may be previously treated with a water-scale-preventing means and then replenished. Further, in view of preventing generation of resistant microbes, it is preferred to perform different water-scale-preventing means at predetermined intervals.

The fungicide is not particularly restricted, and a known fungicide may be used. Examples thereof include, in addition to the above-described oxidizing agents, a glutaraldehyde, a chelating agent, such as aminopolycarboxylic acid; a cationic surface-active agent, and a mercaptopyridine oxide (e.g. 2-mercaptopyridine-N-oxide), and a sole fungicide may be used, or a plurality of fungicides may be used in combination.

The electricity may be passed according to the method described in JP-A-3-224685, JP-A-3-224687, JP-A-4-16280, or JP-A-4-18980.

In addition, a known water-soluble surface-active agent or defoaming agent may be added, so as to prevent uneven processing due to bubbling, or to prevent transfer of stains. Further, a dye adsorbent described in JP-A-63-163456 may be provided in the water-washing system, so as to prevent stains due to a dye dissolved out from the light-sensitive material.

The overflow solution from the water-washing step may be partly or wholly used by mixing it with the processing solution having fixing ability, as described in JP-A-60-235133. It is also preferred, in view of conservation of the natural environment, to reduce the biochemical oxygen demand (BOD), chemical oxygen demand (COD), or iodine consumption before discharge, by subjecting the solution to microorganism treatment (for example, sulfur oxidation bacteria or activated sludge treatment, or treatment with a filter comprising a porous carrier, such as activated carbon or ceramic, having carried thereon microorganisms) or oxidation treatment with an oxidizing agent or electrification, or to reduce the silver concentration in waste water by passing the solution through a filter, using a polymer having affinity for silver, or by adding a compound that forms a hardly soluble silver complex, such as trimercaptotriazine, to precipitate silver, and then passing the solution through a filter.

In some cases, stabilization may be performed subsequent to the water-washing, and as one example, a bath containing the compounds described in JP-A-2-201357, JP-A-2-132435, JP-A-1-102553, and JP-A-46-44446 may be used as a final bath of the light-sensitive material. This stabilization bath may also contain, if desired, an ammonium compound, a metal compound, such as Bi or Al, a fluorescent brightening agent, various chelating agents, a layer pH-adjusting agent, a hardening agent, a bactericide, a fungicide, an alkanolamine, or a surface-active agent.

The additives, such as a fungicide and the stabilizing agent added to the water-washing or stabilization bath, may be formed into a solid agent, similarly to the above-described development and fixing processing agents.

Wastewater of the developer, the fixing solution, the washing water, or the stabilizing solution for use in the present invention, is preferably burned for disposal. The wastewater can also be formed into a concentrated solution or a solid by a concentrating apparatus, as described, for example, in JP-B-7-83867 and U.S. Pat. No. 5,439,560, and then disposed.

When the replenishing amount of the processing agent is reduced, it is preferred to prevent evaporation or air oxidation of the solution, by reducing the contact area of the processing tank with air. A roller transportation-type automatic-developing machine is described, for example, in U.S. Pat. Nos. 3,025,779 and 3,545,971, and in the present specification, it is simply referred to as a roller transportation-type automatic processor. This automatic processor comprises four steps of development, fixing, water-washing, and drying, and it is most preferred to follow this four-step processing also in the present invention, though other steps (e.g. stopping step) are not excluded. Further, a rinsing bath may be provided between development and fixing, and/or between fixing and water-washing.

In the development in the present invention, the dry-to-dry time is preferably from 25 to 160 seconds, the development time and the fixing time are each generally 40 seconds or less, preferably from 6 to 35 seconds, and the temperature of each solution is preferably from 25 to 50° C., more preferably from 30 to 40° C. The temperature and the time of water-washing are preferably from 0 to 50° C. and 40 seconds or less, respectively. According to the method in the present invention, the light-sensitive material after development, fixing, and water-washing may be passed through squeeze rollers, for squeezing washing water, and then dried. The drying is generally performed at a temperature of from about 40° C. to about 100° C. The drying time may be appropriately varied depending upon the ambient state. The drying method is not particularly restricted, and any known method may be used, but hot-air drying, and drying by far infrared rays or a heat roller as described in JP-A-4-15534, JP-A-5-2256, and JP-A-5-289294 may be used, and a plurality of drying methods may also be used in combination.

Various additives for use in the light-sensitive material of the present invention are not particularly restricted, and, for example, those described in the following portions may be preferably used:

polyhydroxybenzene compounds described in JP-A-3-39948, from page 10, right lower column, line 11, to page 12, left lower column; line 5, specifically, Compound (III)-1 to 25 described in the publication;

compounds represented by formula (I) and having substantially no maximum absorption in the visible region, described in JP-A-1-118832; specifically, Compounds I-1 to I-26 described in the publication;

antifogging agents described in JP-A-2-103536, page 17, right lower column, line 19, to page 18, right upper column, line 4;

polymer latexes described in JP-A-2-103536, page 18, left lower column, lines 12 to 20; polymer latexes having an activated methylene group represented by formula (I) described in Japanese Patent Application No. 8-13592; specifically, Compounds I-1 to I-16 described in the specification thereof; polymer latexes having a core/shell structure described in Japanese Patent Application No. 8-13592; specifically, Compounds P-1 to P-55 described in the specification thereof;

matting agents, slipping agents, and plasticizers described in JP-A-2-103536, from page 19, left upper column, line 15, to right upper column, line 15; hardening agents described in JP-A-2-103536, page 18, right upper column, lines 5 to 17;

compounds having an acid group described in JP-A-2-103536, from page 18, right lower column, line 6, to page 19, left upper column, line 1;

electrically conductive materials described in JP-A-2-18542, from page 2, left lower column, line 13, to page 3, right upper column, line 7; specifically, metal oxides described in the publication, page 2, right lower column, lines 2 to 10, and electrically conductive high-molecular compounds of Compounds P-1 to P-7 described in the publication; water-soluble dyes described in JP-A-2-103536, page 17, right lower column, lines 1 to 18;

solid dispersion dyes represented by formulae (FA), (FA1), (FA2), and (FA3) described in Japanese Patent Application Nos. 350753/1995; specifically, Compounds F1 to F34 in the specification thereof, and Compounds (II-2) to (II-24), (III-5) to (III-18), and (IV-2) to (IV-7) described in JP-A-7-152112;

solid dispersion dyes described in JP-A-2-294638 and Japanese Patent Application No. 3-185773; surface-active agents described in JP-A-2-12236, from page 9, right upper column, line 7 to page 9, right lower column, line 3; PEC-series surface-active agents described in JP-A-2-103536, page 18, left lower column, lines 4 to 7; fluorosurface-active agents described in JP-A-3-39948, from page 12, left lower column, line 6, to page 13, right lower column, line 5; specifically, Compounds IV-1 to VI-15 described in the publication; and redox compounds capable of releasing a development inhibitor when oxidized, described in JP-A-5-274816, preferably redox compounds represented by formulae (R-1), (R-2), and (R-3) described in the publication; specifically, Compounds R-1 to R-68 described in the publication.

The silver halide photographic light-sensitive material of the present invention can be processed with a stable developing solution, and provides high sensitivity. Further, the formed image has extremely hard gradation and high blackening density, and residual color is lowered.

EXAMPLES

The present invention will be described in more detail with reference to the following examples, but the invention should not be construed as being limited thereto.

Example 1

Preparation of Emulsion A

| | |
|---|---|
| Solution 1 | |
| Water | 1 liter |
| Gelatin | 20 g |
| Sodium chloride | 3.0 g |
| 1,3-Dimethylimidazolidine-2-thione | 20 mg |
| Sodium benzenethiosulfonate | 8 mg |
| Solution 2 | |
| Water | 600 ml |
| Silver nitrate | 150 g |
| Solution 3 | |
| Water | 600 ml |
| Sodium chloride | 40.7 g |
| Potassium bromide | 31.5 g |
| Ammonium hexachloroiridate (III) (0.001% aqueous solution) | 20 ml |
| Potassium hexachlororhodate (III) (0.001% aqueous solution) | 6 ml |

-continued

| Preparation of Emulsion A | |
|---|---|
| To Solution 1 kept at 40° C. and pH 4.5, Solutions 1, 2 and 3 were added simultaneously, with stirring, over 23 minutes, to prepare core (nucleus) grains, and subsequently the following Solutions 4 and 5 were added thereto, over 8 minutes. Further, 0.15 g of potassium iodide was added to the resultant emulsion, to finish a grain formation. | |
| Solution 4 | |
| Water | 200 ml |
| Silver nitrate | 50 g |
| Solution 5 | |
| Water | 200 ml |
| Sodium chloride | 13.6 g |
| Potassium bromide | 10.5 g |
| Potassium hexacyanoferrate (II) (0.1% aqueous solution) | 10 ml |

Thereafter, the emulsion was washed with water by flocculation according to a usual method, and then 40 g of gelatin was added thereto.

After that, the pH and the pAg were adjusted to 5.7 and 7.5, respectively. Thereto, 1.0 mg of sodium thiosulfate, 4.0 mg of chloroauric acid, 1.5 mg of triphenylphosphineselenide, 8 mg of sodium benzenethiosulfonate, and 2 mg of sodium benzenethiosulfinate were added, and the mixture was subjected to chemical sensitization to give it an optimal sensitivity at 55° C.

Then, 100 mg of 4-hydroxy-6-methyl-1,3,3a,7-tetrazaindene as a stabilizing agent, and phenoxyethanol, as an antiseptic, were added. The resulting Emulsion A, containing silver chloroiodobromide cubic grains having an average grain size of 0.20 μm was obtained (average halogen composition: silver chloride 70 mol %, silver iodide 0.08 mol %; coefficient of variation of the grain size: 10%).

Preparation of Emulsion B

Emulsion B was prepared in the same manner as the Emulsion A, except that the amount of NaCl in the solution 1 of the Emulsion A was changed. As a result, the Emulsion B containing silver iodochlorobromide cubic grains having an average grain size of 0.15 μm was obtained (average halogen composition: silver chloride 70 mol %, silver iodide 0.08 mol %; coefficient of variation of the grain size: 14%).

Preparation of Emulsion C

Emulsion C was prepared in the same manner as the Emulsion B, except that after the solution 2 and the solution 3 were added at the time of preparation of the Emulsion B, Compound (I-1) was added in the amount of $3.0\times10^{-3}$ mol per mol of silver, and then the solution 4 and the solution 5 were added. As a result, the Emulsion C containing cubic silver iodochlorobromide grains having an average grain size of 0.15 μm was obtained (average halogen composition: silver chloride 70 mol %, silver iodide 0.08 mol %; coefficient of variation of the grain size: 16%).

Preparation of Emulsion D

Emulsion D was prepared in the same manner as the Emulsion B, except that after the solution 2 and the solution 3 were added at the time of preparation of the Emulsion B, Compound (I-2) was added in the amount of $3.0\times10^{-3}$ mol per mol of silver, and then the solution 4 and the solution 5 were added. As a result, the Emulsion D containing cubic silver iodochlorobromide grains having an average grain size of 0.15 μm was obtained (average halogen composition: silver chloride 70 mol %, silver iodide 0.08 mol %; coefficient of variation of the grain size: 15%).

Preparation of Emulsion E

Emulsion E was prepared in the same manner as the Emulsion B, except that after the solution 2 and the solution 3 were added at the time of preparation of the Emulsion B, Compound (I-3) was added in the amount of $3.0\times10^{-3}$ mol per mol of silver, and then the solution 4 and the solution 5 were added. As a result, the Emulsion E containing cubic silver iodochlorobromide grains having an average grain size of 0.15 μm was obtained (average halogen composition: silver chloride 70 mol %, silver iodide 0.08 mol %; coefficient of variation of the grain size: 16%).

Preparation of Emulsion F

Emulsion F was prepared in the same manner as the Emulsion E, except that the amount of NaCl in the solution 1 of the Emulsion E was changed. As a result, the Emulsion F containing a cubic silver iodochlorobromide grains having an average grain size of 0.20 μm was obtained (average halogen composition: silver chloride 70 mol %, silver iodide 0.08 mol %; coefficient of variation of the grain size: 12%).

Preparation of Coated Sample 1

Emulsion A was spectrally sensitized by adding $5.7\times10^{-4}$ mol/mol-Ag of Sensitizing dye (1) thereto. Further, to the Emulsion A, $3.4\times10^{-4}$ mol/mol-Ag of KBr, $3.2\times10^{-4}$ mol/mol-Ag of Compound (1), $8.0\times10^{-4}$ mol/mol-Ag of Compound (2), $1.2\times10^{-2}$ mol/mol-Ag of hydroquinone, $3.0\times10^{-3}$ mol/mol-Ag of citric acid, $1.5\times10^{-4}$ mol/mol-Ag of Compound (3), and $6.0\times10^{-4}$ mol/mol-Ag of Compound (4) were added. Furthermore, polyethylacrylate latex and colloidal silica, having an average particle size of 0.01 μm, were added, to give a coated amount in terms of the ratio of 30% to a gelatin binder, respectively. Further, 100 mg/m$^2$ of Aqueous latex (5), 150 mg/m$^2$ of a polyethylacrylate dispersion, 150 mg/m$^2$ of methyl acrylate/sodium 2-acrylamido-2-methylpropanesulfonate/2-acetoacetoxyethyl methacrylate latex copolymer (polymerization ratio by weight 88:5:7), 150 mg/m$^2$ of core/shell-type latex (core: styrene/butadiene copolymer (polymerization ratio by weight 37/63), shell: styrene/2-acetoacetoxyethyl methacrylate (polymerization ratio by weight 84/16), core/shell ratio=50/50), and 4 wt % of Compound (6) based on gelatin, were added. The resulting solution was adjusted to have a pH of 5.5 using a citric acid, and then coated on a polyester support undercoated by a moisture-proofing layer containing vinylidene chloride, in a coated silver amount of 3.3 g/m$^2$ and a coated gelatin amount of 1.4 g/m$^2$.

| Upper layer of protective layer | |
|---|---|
| Gelatin | 0.3 g/m$^2$ |
| Silica matting agent of av. 3.5 μm | 25 mg/m$^2$ |
| Compound (7) (gelatin dispersion) | 20 mg/m$^2$ |
| Colloidal silica having grain diameter of 10 to 20 μm | 30 mg/m$^2$ |
| Compound (8) | 50 mg/m$^2$ |
| Sodium dodecylbenzenesulfonate | 20 mg/m$^2$ |
| Compound (9) | 20 mg/m$^2$ |
| Compound (10) | 25 mg/m$^2$ |
| Lower layer of protective layer | |
| Gelatin | 0.5 g/m$^2$ |
| Compound (11) | 15 mg/m$^2$ |
| 1,5-Dihydoroxy-2-benzaldoxim | 10 mg/m$^2$ |
| Polyethyl acrylate latex | 150 mg/m$^2$ |
| UL layer | |
| Gelatin | 0.5 g/m$^2$ |
| Polyethyl acrylate latex | 150 mg/m$^2$ |

-continued

| | |
|---|---|
| Compound (6) | 40 mg/m$^2$ |
| Compound (12) | 10 mg/m$^2$ |

Further, the support of samples used in the samples of the present invention each have a backing layer and an electrically conductive layer having the following compositions.

Backing layer

| | |
|---|---|
| Gelatin | 3.3 g/m$^2$ |
| Compound (13) | 40 mg/m$^2$ |
| Compound (14) | 20 mg/m$^2$ |
| Compound (15) | 90 mg/m$^2$ |
| Compound (16) | 40 mg/m$^2$ |
| Compound (17) | 26 mg/m$^2$ |
| 1,3-Divinylsulfonyl-2-propanol | 60 mg/m$^2$ |

-continued

| | |
|---|---|
| Fine grain of polymethyl methacrylate (av. grain diameter of 6.5 $\mu$m) | 30 mg/m$^2$ |
| Liquid paraffin | 78 mg/m$^2$ |
| Compound (6) | 120 mg/m$^2$ |

Electrically conductive layer

| | |
|---|---|
| Gelatin | 0.1 g/m$^2$ |
| Sodium dodecylbenzenesulfonate | 20 mg/m$^2$ |
| $SnO_2$/Sb (9/1 wt. ratio, av. grain diameter of 0.25 $\mu$m) | 200 mg/m$^2$ |

Compound (I-1)

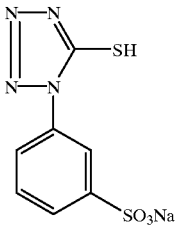

Compound (I-2)

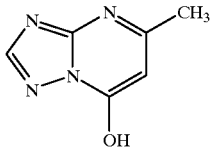

Compound (I-3)

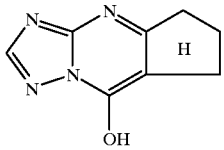

Sensitizing dye (1)

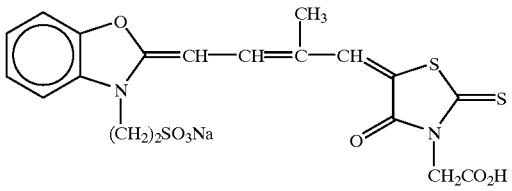

Compound (1)

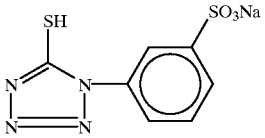

-continued
Compound (2)
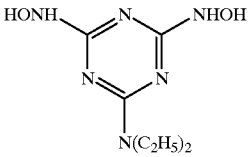
Compound (3) (a hydrazine-series nucleator)
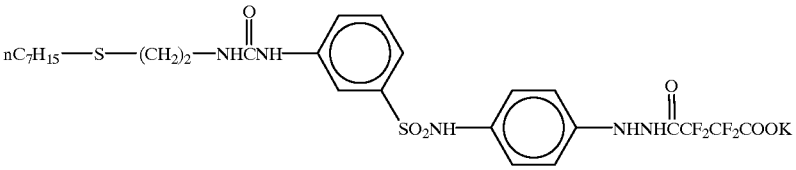
Compound (4) (nucleating accelerator)
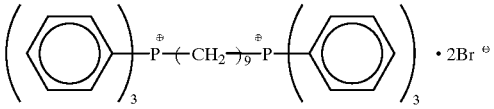
Water-soluble latex (5)
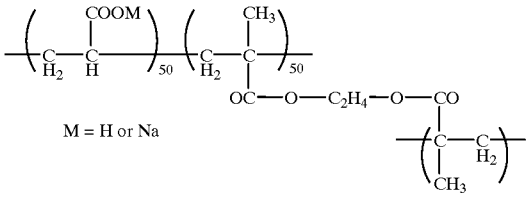
M = H or Na
Compound (6)
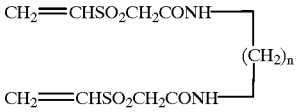
3:1 mix of n = 2 and n = 3
Compound (7)
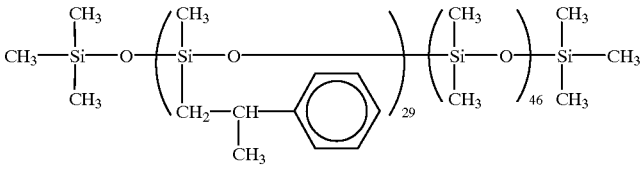
Compound (8)
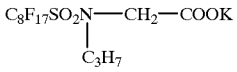
Compound (9)
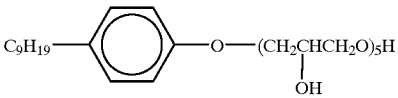
Compound (10)
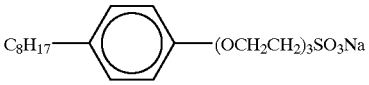

-continued
Compound (11)
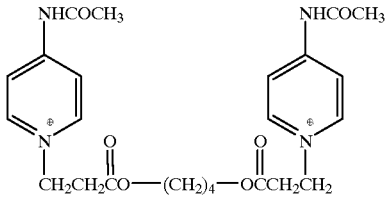
Compound (12)
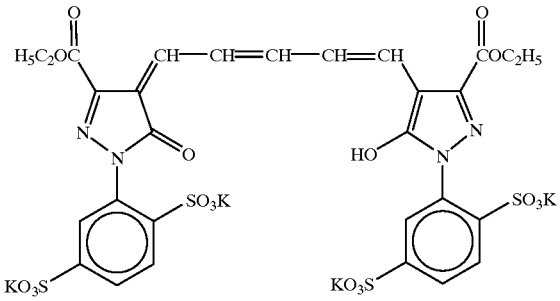
Compound (13)
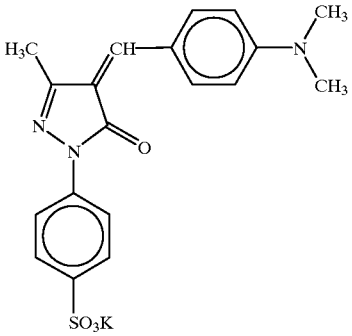
Compound (14)
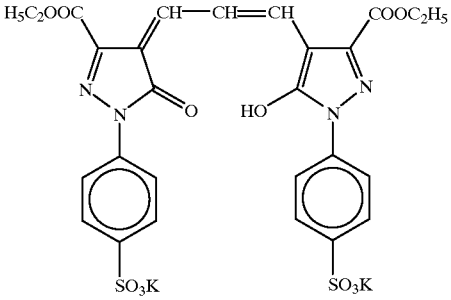
Compound (15)
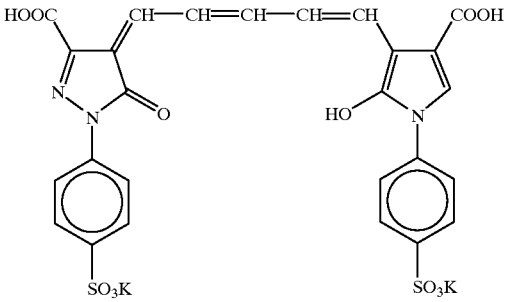
Compound (16)
$CH_3(CH_2)_{11}CH{=}CHSO_3Na$ -continued Compound (17)

$CH_3(CH_2)_{11}CH_2—CH_2SO_3Na$

Preparation of Coated Samples 2 to 7

Coated samples 2 to 7 were prepared exactly in the same manner as the Coated sample 1, except that a mixture of two emulsions selected from the Emulsions A to F was used in place of the Emulsion A, and the amount of the sensitizing dye (1) to be added was changed, as shown in Table 13 at the time of preparation of the Coated sample 1. Herein, the ratio of the mixed emulsions is 1:2 based on the amount of silver. In Table 13, "A+B" indicates a mixed emulsion wherein the Emulsion A : the Emulsion B=1:2 based on the amount of silver.

The thus-prepared samples were each exposed to a xenon flash light, through a step wedge via an interference filter having a peak at 633 nm, for an radiation time of $10^{-6}$ sec, and then they were subjected to development with Developing solution A, set forth below, at 35° C. for 30 seconds, in an automatic developing machine, AP-560, trade name, manufactured by Fuji Photo Film Co., Ltd., followed by fixing, water-washing, and drying.

The sensitivity was expressed by the reciprocal of the exposure amount necessary to give a density of 1.5, and a relative value of each of the samples was calculated, assuming the sensitivity of the Coated samplel to be 100, which was designated as $S_{1.5}$. The higher the value, the higher the sensitivity.

Developing solution A

The composition of Developing solution A per liter of its concentrated solution is shown below.

| | |
|---|---|
| Potassium hydroxide | 60.0 g |
| Diethylenetriamine-pentaacetate | 3.0 g |
| Potassium carbonate | 90.0 g |
| Sodium metabisulfite | 105.0 g |
| Potassium bromide | 10.5 g |
| Hydroquinone | 60.0 g |
| 5-Methylbenzotriazole | 0.53 g |
| 4-Hydroxymethyl-4-methyl-1-phenyl-3-pyrazolidone | 2.3 g |
| Sodium 2-mercaptobenzoimidazole-5-sulfonate | 0.45 g |
| Sodium 3-(5-mercaptotetrazole-1-yl)-benzenesulfonate | 0.15 g |
| Sodium erysorbate | 9.0 g |
| Diethylene glycol | 7.5 g |
| Compound (18) | 1.5 g |
| Compound (19) | 0.5 g |
| pH | 10.79 |

When use was made, 2 parts of the above concentrated solution was diluted with 1 parts of water. pH of the used solution was 10.65.

Compound (18)

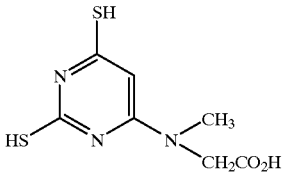

-continued

Compound (19)

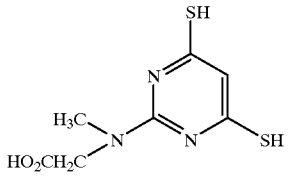

The fixing solution having the following composition was used.

(Composition of a fixing solution)

| | |
|---|---|
| Ammonium thiosulfate | 359.1 g |
| Ethylenediaminetetraacetic acid 2Na dihydrate | 0.09 g |
| Sodium thiosulfate pentahydrate | 32.8 g |
| Sodium sulfite | 64.8 g |
| NaOH | 37.2 g |
| Glacial acetic acid | 87.3 g |
| Tartaric acid | 8.76 g |
| Sodium gluconate | 6.6 g |
| Alminium sulfate | 25.3 g |

Water was added to make 3 liter, and pH was adjusted to 4.85 with sulfuric acid or sodium hydroxide.

Fixing was carried out with a replenishing amount of 250 $ml/m^2$.

Further, a test pattern having 16 steps of dot % was obtained as output while changing the LS value (light step value) at 175 lines/inch, using a helium-neon light source color scanner SG-608, manufactured by Dainippon Screen Mfg. Co., Ltd. Thereafter, processing was carred out under the above-described processing conditions, and the density of the portion having 100% dot obtained by exposing the portion with such an exposure that the 8th step shows 49% dot, is designated as the Dm. Herein, the dot % was measured using a Macbeth TD 904 (tradename).

The evaluation of residual color was performed by processing an unexposed sample, and then placing the sample on a white paper, followed by visual inspection. The processing condition for this evaluation was the same as the evaluation condition of photographic properties, except that the temperature of the washing water was kept at 5° C. or lower. Residual color was evaluated by a 5-stage rating method, wherein the state of non-coloring was rated "5," the state of a very slight residual color was rated "4," the state in which a residual color was noticed clearly was rated "3," the state in which a somewhat strong residual color was noticed was rated "2," and the state in which a strong residual color was noticed was rated "1." The ranks "4" and "5" are practically allowable levels.

It can be seen from the results shown in Table 13 that samples of the present invention, wherein two kinds of emulsions according to the present invention are mixed, one of which is an emulsion in which silver halide grains have been formed and grown in the presence of the nitrogen-containing heterocyclic compound that are capable of forming a complex with silver, shows high sensitivity giving a high photographic black density with addition of a small amount of the dye, and they are also excellent in prevention of residual color. In particular, when the emulsion in which silver halide grains have been formed and grown in the presence of the compound represented by formula (I) according to the present invention is used, such effect obtained thereby is outstanding. Further, photographic properties of desired ultrahigh-contrast were obtained in this Example and other Examples hereinafter described.

TABLE 13

| Coated sample | Emulsion | Dye | Added amount $\times 10^{-4}$ (mol/mol-Ag) | Sensitivity $S_{1.5}$ | Dm | Residual color (5-stage rating method) | Remarks |
|---|---|---|---|---|---|---|---|
| 1 | A | Sensitizing dye (1) | 5.7 | 100 | 4.5 | 4 | Comparative example |
| 2 | A + B | " | " | 70 | 5.2 | 4 | " |
| 3 | A + C | " | " | 89 | 5.2 | 4 | This invention |
| 4 | A + D | " | " | 102 | 5.1 | 4 | " |
| 5 | A + E | " | " | 108 | 5.2 | 4 | " |
| 6 | A + F | " | " | 102 | 5.1 | 4 | " |
| 7 | E + F | " | " | 50 | 5.1 | 4 | Comparative example |

Similar results to those of the samples of this invention in Table 13 were also obtained by using the surface-active agents described below in place of the surface-active agents of sodium dodecylbenzenesulfonate and Compounds (9) and (10) in Example 1.

W-1

$C_{12}H_{25}OSO_3Na$

W-2

$C_{14}H_{29}SO_3Na$

W-3

$C_{11}H_{23}CH(OH)—CH_2CH_2SO_3Na$ $C_{11}H_{23}CH{=}CHCH_2SO_3Na$ 40/60 (wt)mixture

W-4

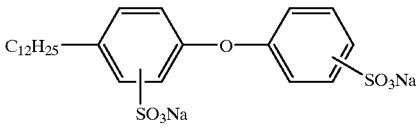

W-5

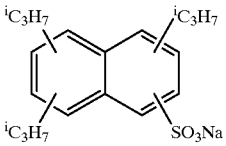

W-6

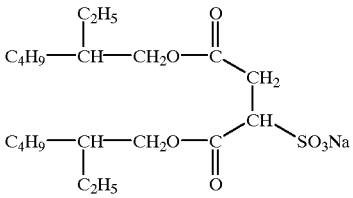

W-7

$C_{11}H_{23}CON(CH_3)CH_2CH_2SO_3Na$

W-8

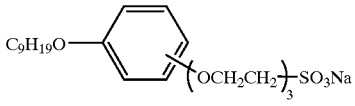

-continued

W-9

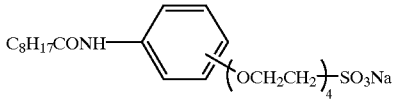

-continued

W-10

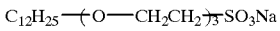

W-11

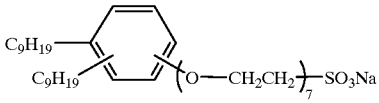

W-12

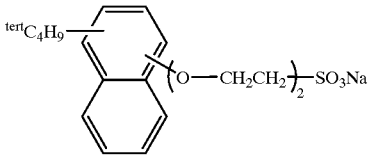

W-13

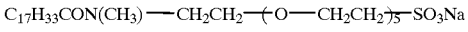

W-14

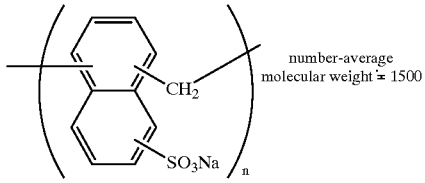

number-average molecular weight ≒ 1500

W-15

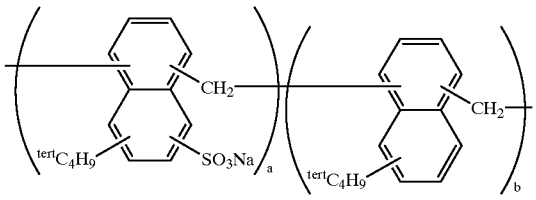

number-average weight ≒ 1500 a/b ≒ 20/80 (wt)

W-16

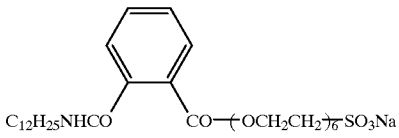

-continued

W-17

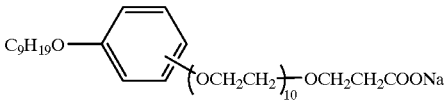

W-18

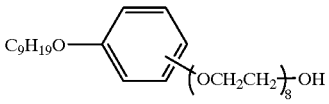

W-19

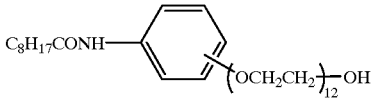

W-20

$C_{12}H_{25}$—(O—$CH_2CH_2$)$_{15}$—OH

W-21

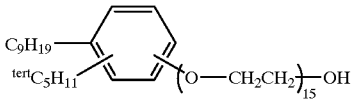

W-22

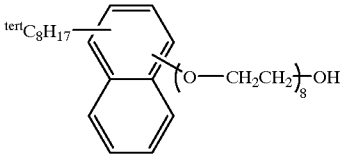

W-23

$C_{17}H_{33}CON(CH_3)$—$CH_2CH_2$—(O—$CH_2CH_2$)$_{14}$—OH

W-24

H—($OCH_2CH_2$)$_a$—($OCH(CH_3)CH_2$)$_b$—($OCH_2CH_2$)$_c$—OH a+c/b = 207/39 (polymerization ratio)

W-25

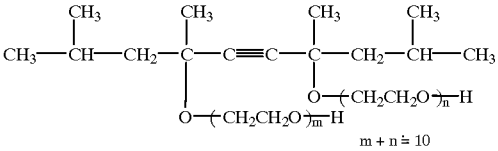

m + n ≒ 10

W-26

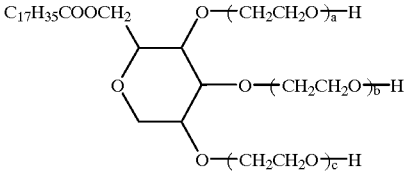

-continued

W-27

$C_{11}H_{23}CO$—(O—$CH_2CH_2$)$_{12}$—OH

Example 2

Preparation of Coated Samples 10 to 12

Coated samples 10 to 12 were prepared exactly in the same manner as the Coated sample 1, except that at the time of preparation of the Coated sample 1, as shown in Table 14, a mixture of the emulsions (the ratio of each emulsions in the mixture is the same as in the Coated samples 2 to 7) was used in place of the Emulsion A, or the Sensitizing dye (2) and the Sensitizing dye (3) were used in combination in place of the Sensitizing dye (1).

Preparation of Coated Samples 21 to 26

Coated samples 21 to 26 were prepared exactly in the same manner as the Coated sample 1, except that at the time of preparation of the Coated sample 1, as shown in Table 15, a mixture of the emulsions (the ratio of each emulsions in the mixture is the same as in the Coated samples 2 to 7) was used in place of the Emulsion A, or the Sensitizing dye (4) were used in place of the Sensitizing dye (1).

Preparation of Coated Samples 27 to 32

Coated samples 27 to 32 were prepared exactly in the same manner as the Coated sample 1, except that at the time of preparation of the Coated sample 1, as shown in Table 16, a mixture of the emulsions (the ratio of each emulsions in the mixture is the same as in the Coated samples 2 to 7) was used in place of the Emulsion A, or Sensitizing dye (5) were used in place of the Sensitizing dye (1).

Sensitizing dye (2)

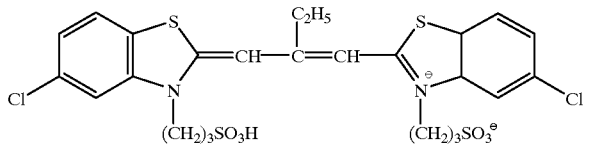

-continued

Sensitizing dye (3)

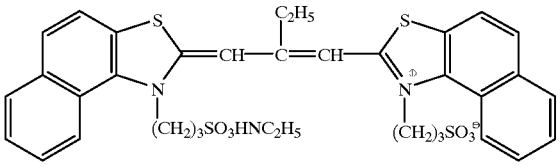

Sensitizing dye (4)

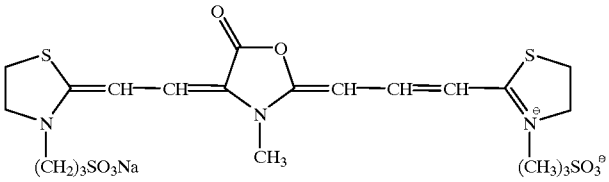

Sensitizing dye (5)

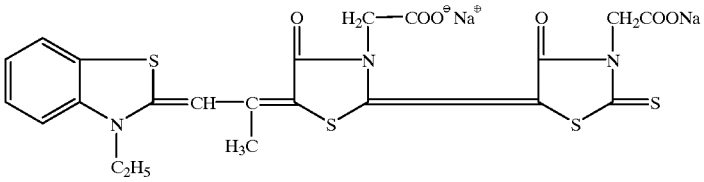

It can be seen from the results in Tables 13, 14, 15 and 16, that the samples of the present invention exhibit a high sensitivity, and especially when the spectral sensitizing dye represented by the formula (II), (III), or (IV) is used, residual color is lowered.

TABLE 14

| Coated sample | Emulsion | Dye | Added amount $\times 10^{-4}$ (mol/mol-Ag) | Sensitivity $S_{1.5}$ | Dm | Residual color (5-stage rating method) | Remarks |
|---|---|---|---|---|---|---|---|
| 10 | A | Sensitizing dye (2)/(3) | 0.87/0.87 | 76 | 4.6 | 4 | Comparative example |
| 11 | A + B | " | " | 53 | 5.1 | 4 | " |
| 12 | A + D | " | " | 92 | 5.3 | 4 | This invention |

TABLE 15

| Coated sample | Emulsion | Dye | Added amount $\times 10^{-4}$ (mol/mol-Ag) | Sensitivity $S_{1.5}$ | Dm | Residual color (5-stage rating method) | Remarks |
|---|---|---|---|---|---|---|---|
| 21 | A | Sensitizing dye (4) | 4 | 98 | 4.5 | 4 | Comparative example |
| 22 | A + B | " | " | 67 | 5.1 | 4 | " |
| 23 | A + D | " | " | 97 | 5.2 | 4 | This invention |
| 24 | A | " | 2.7 | 62 | 4.4 | 5 | Comparative example |
| 25 | A + B | " | " | 40 | 5.1 | 5 | " |
| 26 | A + D | " | " | 95 | 5.1 | 5 | This invention |

TABLE 16

| Coated sample | Emulsion | Dye | Added amount $\times 10^{-4}$ (mol/mol-Ag) | Sensitivity $S_{1.5}$ | Dm | Residual color (5-stage rating method) | Remarks |
|---|---|---|---|---|---|---|---|
| 27 | A | Sensitizing dye (5) | 4 | 92 | 4.4 | 4 | Comparative example |
| 28 | A + B | " | " | 67 | 5.2 | 4 | " |
| 29 | A + D | " | " | 95 | 5.2 | 4 | This invention |
| 30 | A | " | 2.7 | 58 | 4.5 | 5 | Comparative example |
| 31 | A + B | " | " | 42 | 5.3 | 5 | " |
| 32 | A + D | " | " | 95 | 5.2 | 5 | This invention |

Example 3

The Coated samples 1 to 32 were each exposed to light and subjected to development in the same manner as in Example 1, except that Developing solution B set forth below was used in place of Developing solution A, and the samples were evaluated on the same photographic properties as in Example 1. As a result, similar effects to the samples of this invention in Example 1 were obtained in the samples of this invention.

| Developing solution B | |
|---|---|
| Diethylenetriamine-pentaacetic acid | 2 g |
| Potassium carbonate | 33 g |
| Sodium carbonate | 28 g |
| Sodium hydrogencarbonate | 25 g |
| Sodium erysorbate | 45 g |
| N-Methyl-p-aminophenol | 7.5 g |
| KBr | 2 g |
| 5-Methylbenzotriazole | 0.004 g |
| 1-Phenyl-5-mercaptotetrazole | 0.02 g |
| Sodium sulfite | 10 g |
| Compound (18) | 0.9 g |
| Compound (19) | 0.3 g |
| Water was added to make 1 liter, and pH was adjusted to 9.7. | |

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide photographic light-sensitive material comprising a support having thereon at least one of spectrally sensitized light-sensitive silver halide emulsion layers; wherein at least one of the silver halide emulsion layers contains at least two kinds of silver halide emulsions, at least one kind of the emulsions being one in which silver halide grains have been formed and grown in the presence of at least one of nitrogen-containing heterocyclic compounds that are capable of forming a complex with silver, and at least one kind of the emulsions being one in which silver halide grains have been formed and grown in the absence of nitrogen-containing heterocyclic compounds that are capable of forming a complex with silver; and wherein at least one of the said emulsion layers or another hydrophilic colloid layer contains at least one hydrazine derivative nucleating agent, and also at least one nucleating accelerator selected from a group consisting of amine derivatives, onium salts, disulfide derivatives, and hydroxymethyl derivatives.

2. The silver halide photographic light-sensitive material as claimed in claim 1, wherein the nitrogen-containing heterocyclic compound that is capable of forming a complex with silver, is a compound represented by formula (I) described below:

formula (I)

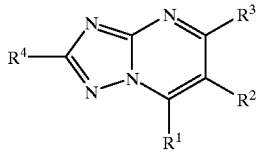

wherein $R^1$, $R^2$, $R^3$ and $R^4$, which may be the same, or different, each represent a hydrogen atom, an alkyl group, an aryl group, an amino group, a hydroxyl group, an alkoxy group, an alkylthio group, a carbamoyl group, a halogen atom, a cyano group, a carboxyl group, an alkoxycarbonyl group, or a heterocyclic residual group; $R^1$ and $R^2$, or $R^2$ and $R^3$ may bond together to form a 5- or 6-membered ring, with the proviso that at least one of $R^1$ and $R^3$ represents a hydroxyl group.

3. The silver halide photographic light-sensitive material as claimed in claim 1, wherein the silver halide emulsion is spectrally sensitized with at least one spectral sensitizing dye selected from compounds represented by formula (II), (III), or (IV) described below:

formula (II)

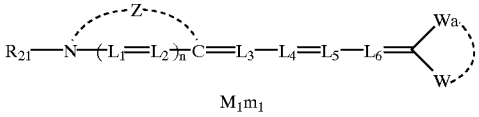

$M_1m_1$

-continued formula (III)

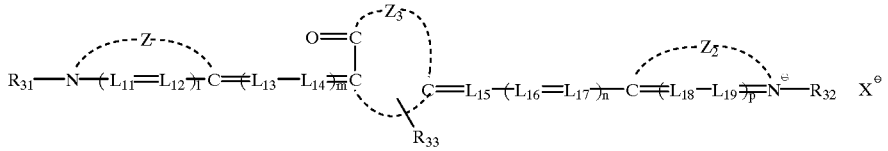

formula (IV)

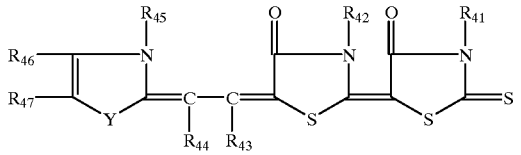

wherein $R_{21}$ represents an alkyl group, Z represents an atomic group necessary to form a 5- or a 6-membered, nitrogen-containing heterocyclic ring; W and $W_a$ each represent an atomic group necessary to form an acyclic or cyclic acidic nucleus; $L_1$, $L_2$, $L_3$, $L_4$, $L_5$ and $L_6$ each represent a methine group; $M_1$ represents a counter ion to neutralize a charge, $m_1$ is a number of 0 or more necessary to neutralize a charge in a molecule, n represents 0 or 1; $Z_1$ and $Z_2$ each represent an atomic group necessary to a 5- or 6-membered heterocyclic ring, $Z_3$ represents an atomic group necessary to a 5- or 6-membered, nitrogen-containing heterocyclic ring, wherein the nitrogen atom has a substituent ($R_{33}$); $R_{31}$ and $R_{32}$ each represent an alkyl group, an alkenyl group, an aralkyl group, or an aryl group; $R_{33}$ has the same meaning as $R_{31}$ or $R_{32}$ and may be the same or different from $R_{31}$ or $R_{32}$, or $R_{33}$ represents a substituted amino group, an amide group, an imino group, an alkoxy group, or a heterocyclic group; at least one of $R_{31}$, $R_{32}$ and $R_{33}$ represents a water-soluble group; $L_{11}$ to $L_{19}$ each represent a methine group; m and n each represent 0, 1, or 2; 1 and p each represent 0 or 1, X represents a counter ion; Y represents —S—, or —Se—; at least two of $R_{41}$, $R_{42}$, $R_{43}$, $R_{44}$ and $R_{45}$ represent an organic group having at least one water-soluble group; the other group(s) of $R_{41}$ to $R_{45}$ that do not represent the above-described organic group having at least one water-soluble group, each represent a hydrogen atom, a substituted or unsubstituted alkyl group, a substituted or unsubstituted alkenyl group, or a substituted or unsubstituted aryl group; $R_{46}$ and $R_{47}$, which may be the same or different, each represents a substituted or unsubstituted, alkyl group, alkenyl group, alkynyl group, alkoxy group, alkylthio group, arylthio group, aryl group, acyl group, alkoxycarbonyl group, alkylsulfonyl group, carbamoyl group, or sulfamoyl group, a hydrogen atom, a hydroxyl group, a halogen atom, a carboxyl group, or a cyano group; further, $R_{46}$ and $R_{47}$ may bond together to complete a carbocyclic ring series; each of the above-described ring series may have one or more substituents, which may be the same or different, selected from the above-described substituents for $R_{46}$ and $R_{47}$.

4. The silver halide photographic light-sensitive material as claimed in claim 1, wherein at least one of the silver halide emulsions contains at least one group VIII metal compound.

5. The silver halide photographic light-sensitive material as claimed in claim 4, wherein the group VIII metal compound is a rhodium compound.

6. The silver halide photographic light-sensitive material as claimed in claim 4, wherein the group VIII metal compound is an iridium compound.

7. The silver halide photographic light-sensitive material as claimed in claim 1, wherein at least one of the silver halide emulsions is subjected to selenium sensitization and/or tellurium sensitization.

8. The silver halide photographic light-sensitive material as claimed in claim 1, wherein at least one of the silver halide emulsions comprises a silber halide having silver chloride content of 50 mol % or more.

9. The silver halide photographic light-sensitive material as claimed in claim 1, wherein a ratio of the silver halide emulsion in which silver halide grains have been formed and grown in the absence of nitrogen-containing heterocyclic compounds that are capable of forming a complex with silver, to the silver halide emulsion in which silver halide grains have been formed and grown in the presence of at least one of nitrogen-containing heterocyclic compounds that are capable of forming a complex with silver, is 1:1 to 1:20, based on the amount of silver contained in the silver halide emulsions.

* * * * *